US012297611B2

(12) United States Patent
Sicking et al.

(10) Patent No.: US 12,297,611 B2
(45) Date of Patent: May 13, 2025

(54) GUARDRAIL TERMINAL

(71) Applicant: Sicking Safety Systems LLC, Indian Springs Village, AL (US)

(72) Inventors: Dean L. Sicking, Indian Springs Village, AL (US); Dakotah Sicking, Keller, TX (US); Steven D. Thompson, Bessemer, AL (US); Kenneth Walls, Trussville, AL (US); Kevin D. Schrum, Pelham, AL (US); Joseph Schwertz, Birmingham, AL (US); David Littlefield, Vestavia Hills, AL (US); Andrew Dameron, Birmingham, AL (US)

(73) Assignee: Sicking Safety Systems LLC, Indian Springs Village, AL (US)

( * ) Notice: Subject to any disclaimer, the term of this patent is extended or adjusted under 35 U.S.C. 154(b) by 0 days.

(21) Appl. No.: 18/540,497

(22) Filed: Dec. 14, 2023

(65) Prior Publication Data

US 2024/0117580 A1 Apr. 11, 2024

Related U.S. Application Data

(63) Continuation of application No. 18/045,060, filed on Oct. 7, 2022, now Pat. No. 11,846,077, which is a (Continued)

(51) Int. Cl.
*E01F 15/14* (2006.01)
*E01F 15/04* (2006.01)

(52) U.S. Cl.
CPC ..... *E01F 15/143* (2013.01); *E01F 15/0423* (2013.01); *E01F 15/0461* (2013.01)

(58) Field of Classification Search
None
See application file for complete search history.

(56) References Cited

U.S. PATENT DOCUMENTS 4,928,928 A 5/1990 Buth et al.
5,078,366 A 1/1992 Sicking et al.
(Continued)

FOREIGN PATENT DOCUMENTS

EP 2017387 B1 12/2009
EP 2 313 560 B1 11/2017
(Continued)

OTHER PUBLICATIONS

An Office Action issued by Eurasian Patent Office on Mar. 4, 2022, which corresponds to EAPO Patent Application No. 202191290 and is related to U.S. Appl. No. 16/708,129.
(Continued)

*Primary Examiner* — Jonathan P Masinick
(74) *Attorney, Agent, or Firm* — Studebaker Brackett PLLC

(57) ABSTRACT

Guardrail, guardrail terminal, and support post designs that improve control of a vehicle during collisions are described. The disclosed designs also reduce the likelihood of intrusion into vehicle systems and the occupant compartment(s). Embodiments include folding and/or flattening of the guardrail and controlling the folded and flattened guardrail to avoid intrusion into the vehicle. Other embodiments include containing the guardrail in an impact head of a guardrail terminal, which also avoids vehicle intrusion.

20 Claims, 40 Drawing Sheets

Related U.S. Application Data continuation of application No. 16/708,129, filed on Dec. 9, 2019, now Pat. No. 11,466,415.

(60) Provisional application No. 62/776,914, filed on Dec. 7, 2018.

(56) References Cited

U.S. PATENT DOCUMENTS

| | | | | |
|---|---|---|---|---|
| 5,775,675 | A | 7/1998 | Sicking et al. | |
| 5,797,591 | A | 8/1998 | Krage | |
| 6,036,399 | A | 3/2000 | Schalk | |
| 6,089,782 | A | 7/2000 | Bligh et al. | |
| 6,554,256 | B2 | 4/2003 | Ochoa | |
| 6,715,735 | B2 | 4/2004 | Bligh et al. | |
| 6,719,483 | B1 | 4/2004 | Welandsson | |
| 7,185,882 | B2 * | 3/2007 | Buth | E01F 15/143 248/66 |
| 7,694,941 | B2 | 4/2010 | Abu-Odeh et al. | |
| 7,883,075 | B2 | 2/2011 | Abu-Odeh et al. | |
| 8,882,082 | B2 | 11/2014 | Abu-Odeh et al. | |
| 8,905,382 | B2 | 12/2014 | Smith et al. | |
| 9,145,943 | B2 | 9/2015 | Sicking | |
| 9,689,124 | B2 | 6/2017 | Harman et al. | |
| 9,714,493 | B1 | 7/2017 | Dyke et al. | |
| 9,732,484 | B2 | 8/2017 | Rohde et al. | |
| 9,963,844 | B2 | 5/2018 | Rohde et al. | |
| 10,036,132 | B2 | 7/2018 | Sicking | |
| 10,119,231 | B1 | 11/2018 | Rohde et al. | |
| 10,364,538 | B2 | 7/2019 | Dyke et al. | |
| 10,851,503 | B2 | 12/2020 | Alberson et al. | |
| 10,914,044 | B2 | 2/2021 | Rohde et al. | |
| 2001/0013596 | A1 | 8/2001 | Sicking et al. | |
| 2002/0007994 | A1 | 1/2002 | Reid et al. | |
| 2006/0102884 | A1 | 5/2006 | Rohde et al. | |
| 2007/0147957 | A1 | 6/2007 | Buth et al. | |
| 2017/0051461 | A1 | 2/2017 | Alberson et al. | |
| 2017/0275837 | A1 | 9/2017 | Rohde et al. | |
| 2021/0198855 | A1 | 7/2021 | Sicking et al. | |

FOREIGN PATENT DOCUMENTS

| | | | | |
|---|---|---|---|---|
| KR | 20090048021 | A * | 5/2009 | |
| RU | 2312948 | C1 | 12/2007 | |
| WO | 2002/018708 | A2 | 3/2002 | |
| WO | WO-2010139027 | A1 * | 12/2010 | E01F 15/0407 |
| WO | 2012/106301 | A1 | 8/2012 | |
| WO | 2016/014013 | A1 | 1/2016 | |

OTHER PUBLICATIONS

International Search Report issued in PCT/US2019/065289; mailed Jul. 3, 2020.

Written Opinion issued in PCT/US2019/065289; mailed Jul. 3, 2020.

An Office Action and Search Report issued by Russian Patent Office on Jun. 29, 2020, which corresponds to Russian Patent Application No. 2020114392/03(024014) and is related to U.S. Appl. No. 16/708,129.

Phillips et al., Cable Guiderail Breakaway Terminal Ends, Research Report 148, Engineering Research and Development Bureau, New York State Department of Transportation, Mar. 1990.

The partial European search report issued by the European Patent Office on Sep. 12, 2024, which corresponds to EP 24166479.6-1005 and is related to U.S. Appl. No. 18/540,497.

* cited by examiner

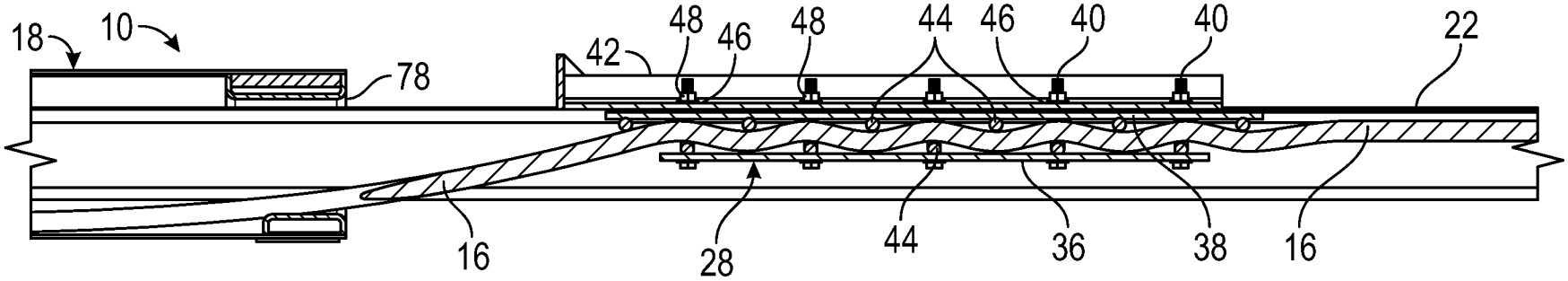
FIG. 8
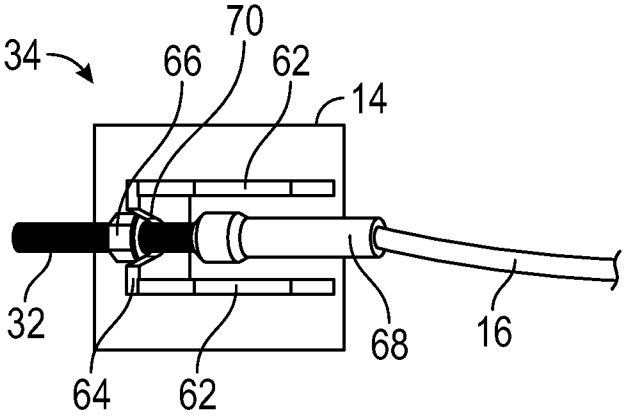
FIG. 10
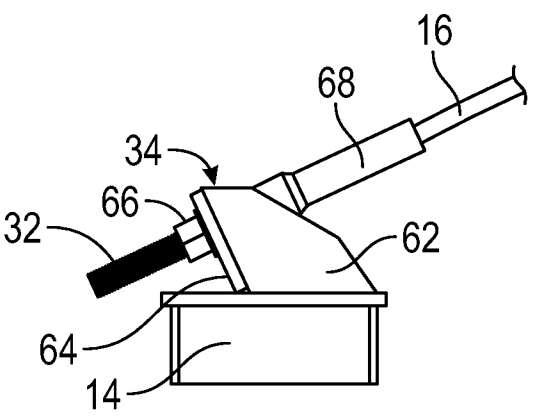
FIG. 11
FIG. 9

Front Views with Cable Attachments

| | Average Force 0º (kip-ft/ft) | Average Force 15º (kip-ft/ft) |
|---|---|---|
| Version 1 | 10.77 | 15.39 |
| Version 2 | 10.94 | 20.84 |
| Version 3 | 15.19 | 23.75 |
| Version 4 | 8.825 | 13.58 |
| Version 5 | 6.868 | 11.73 |

GUARDRAIL TERMINAL

CROSS-REFERENCE TO RELATED APPLICATIONS

This application is a Continuation of U.S. patent application Ser. No. 18/045,060, filed on Oct. 7, 2022, which is a Continuation of U.S. patent application Ser. No. 16/708,129, filed on Dec. 9, 2019, which claims priority to U.S. Provisional Patent Application No. 62/776,914, filed on Dec. 7, 2018, the contents of which are hereby incorporated by reference in their entirety.

This invention was made in part with government support under Subaward No. NCHRP-212, Unit Number 913, Project/Activity 163518-0399, awarded by the National Academy of Sciences, supported by Cooperative Agreement No. DTFH61-13-H-0024, dated Oct. 1, 2013, between the Federal Highway Administration (FHWA) and the Academy. The government may have certain rights in the invention.

TECHNICAL FIELD

This disclosure relates to guardrails for roads.

BACKGROUND

Guardrail terminals have three functions: anchor an end of a guardrail barrier to provide sufficient tension to redirect vehicles striking on a face of the guardrail; reduce the risk associated with end-on impacts with the terminal; and either slow impacting vehicles to a safe stop or allow them to penetrate behind the guardrail in a controlled manner. A W-beam guardrail is a membrane barrier system that relies on tension in a rail element to capture vehicles striking the face of the barrier. If the guardrail terminal does not provide an adequate anchor that can carry tension in the guardrail during an impact, the barrier system cannot fulfill its primary function of steering cars away from roadside hazards. Impact with the guardrail terminal can produce high deceleration rates, vehicle rollover, and penetration or intrusion into the occupant compartment. All these behaviors can produce fatalities or serious injuries. Accordingly, reducing the risk and, if possible, preventing of such behavior is preferred. Unfortunately, the roadside safety community has to date failed to appreciate the inherent risk of allowing a vehicle to gate through a terminal and travel behind the guardrail at high speed.

Guardrail terminals must mitigate the risk of vehicles striking the end of the terminal. The severity of end-on impacts can be reduced by providing a controlled collapse of the railing system. In conventional controlled collapse systems, the controlled collapse technology will become unstable any time the vehicle path is not perfectly aligned with the guardrail. In such situation, conventional terminals allow vehicles to penetrate through the end of the barrier, often without dissipating significant amounts of energy. In such conventional configurations, the terminal is designed to "gate" open and vehicles are allowed to travel behind the barrier at a high rate of speed. However, guardrails are used exclusively to protect motorists from roadside hazards, such as bridge piers, drop offs, steep embankments, or bodies of water. Hence, there is always a significant risk for vehicles traveling behind the barrier at a high rate of speed. In fact, the Fatal Accident Reporting System (FARS), operated by the National Highway Traffic Safety Administration in cooperation with the 50 states, the District of Columbia, and Puerto Rico, indicates that approximately 90 fatal crashes occur every year where striking a guardrail terminal is the first harmful event and the most harmful event was related to another off-road risk, such as those listed above. Gating through to a backside of a guardrail terminal represents approximately one third of the total number of fatal accidents associated with guardrail terminals.

The first energy absorbing guardrail terminal, the ET-2000, was introduced in the late 1980's. This terminal incorporated an impact head that fit over the end of the guardrail and, when struck by a car, the head was forced down the W-beam. As the guardrail was pushed through the impact head, it passed through a squeezer section and was flattened. The flattened guardrail was then curled out of the back of the impact head. The squeezing and curling of the guardrail dissipated large amounts of energy and thereby slowed impacting vehicles in a controlled manner. In-service performance studies of this terminal demonstrated outstanding safety performance and this terminal was adopted widely across the US and some foreign countries, including Canada and Australia. Competitors soon came to market, including the beam eating steel terminal (BEST), sequential kinking terminal (SKT), and the Flared Energy Absorbing Terminal (FLEAT). All of these designs provided energy absorption using a mechanism other than flattening, but the basic concept of using an impact head to slide down the rail, deform it, and deflect it out of the vehicle's path was included in each of these designs.

Each of these energy absorbing terminals produce compression in the guardrail as the impact head is pushed forward. Unfortunately, the compression forces can become excessive and cause the guardrail to buckle. When the guardrail buckles, the energy dissipation stops immediately and a 180-degree bend in the rail often develops. This type of bend is sometimes called a "knee" and this bend or knee can penetrate into an impacting vehicle and seriously injure or kill the occupants. A knee can also deform the occupant space such that occupants are injured by large deformations of the occupant space. This behavior has been labelled "intrusion" of the occupant space.

In 1999, the concept of a tension guardrail terminal was introduced. Although no product was brought to market, a patent was obtained on a device that incorporated an impact head that forced the guardrail to the ground and allowed vehicles to pass over the guardrail. The end of the barrier was permanently attached to a ground anchor to maintain tension in the guardrail system. By maintaining tension in the guardrail, the system could prevent buckling and thereby eliminate spearing or intrusion. Also, the impact head will tend to follow along the guardrail's path, which means the vehicle will be steered back toward the roadway. The first commercial implementation of this concept, called the "Soft Stop," was introduced almost a decade later and included a vertical compression of the W-beam as a primary energy absorber.

In order for tension guardrail terminals to function properly, they must maintain a strong, positive, or continuous connection with the vehicle throughout the impact. Unfortunately, the most popular tension-based guardrail terminal cannot create a strong mechanical interlock between the terminal's impact head and the front of an impacting vehicle. The most popular tension-based guardrail terminal also includes a steel tube attached to the impact head that extends under the impacting vehicle. The passing of the vertically compressed guardrail through the tube provides significant friction forces near the ground line. Impact forces are delivered near the center of gravity of the vehicle while the resistance forces from the W-beam are much closer to the ground. These two forces produce an overturning moment in the impact head which causes the tube under the vehicle to lift up and act as a spear to penetrate the oil pan, gas tank, or even the floorboard of an impacting vehicle. The head rotation also causes the impact plate to tilt backwards to produce a ramp that allows the impacting vehicle to ride up and over the terminal. Hence, Applicant appreciated that a non-gating guardrail terminal must be capable of keeping the guardrail under tension and producing a strong mechanical interlock between the end of the terminal and the front of the impacting vehicle without puncturing critical components of the vehicle.

The first tension-based energy absorbing guardrail system was introduced in late 2006. In theory, a tension-based guardrail terminal cannot cause the rail to buckle and thus should greatly reduce the risk of spearing or intrusion into the occupant space. The first tension terminal incorporated a cable that was threaded along a torturous path that produces friction to slow impacting vehicles. The cable is attached to a ground anchor to prevent buckling of the guardrail and reduce the risk of a penetration or intrusion of the occupant compartment. Further, this terminal system was designed to minimize the number of vehicles that travel behind the guardrail and encounter roadside hazards. Unfortunately, the attempt to capture more vehicles involved stiffening the terminal to the point that the safety performance for head-on impacts was compromised.

More recently, a patent application for a cannister guardrail was submitted to the USPTO. This design incorporates a squeezing system that flattens the guardrail and directs it into a round barrel where it is retained inside the impact head. This concept allows the terminal energy absorption rate to increase as the impact head is pushed further into the system. The downside of this impact attenuation system is that it cannot be restarted after a moderate impact. The reason this system cannot be restarted is that the entire coil of guardrail inside the impact head must rotate around the inside of the barrel for the energy management system to function. There is simply too much static friction between adjacent coils and too much inertia to resist restarting of the energy management process, once stopped. Even if the terminal head is still aligned with the guardrail, the energy management system cannot restart after even a relatively minor impact.

Additional problems that plague some existing guardrail terminals include steel bearing plates, used in most compression-based terminals, and steel posts cutting open the floor plan when impacting vehicles pass over the anchor or line posts during head-on crashes. Further, most guardrail terminals have difficulty providing adequate anchorage for vehicles striking the system on the face of the barrier near the end of the guardrail. Eliminating the need for a bearing plate and a detachable first post reduces the risk of cutting into a vehicle's floor pan.

SUMMARY

This disclosure provides a guardrail assembly comprising a w-shaped guardrail and a guardrail terminal. The w-shaped guardrail extends longitudinally and includes a first end and a second end in a transverse direction to the longitudinal direction. Each of the first end and the second end of the w-shaped guardrail extends in a first direction. The guardrail terminal has a first end and a second end, and the guardrail terminal is configured to receive the w-shaped guardrail at the first end of the guardrail terminal. The guardrail terminal includes a deflector positioned between the first end of the guardrail terminal and the second end of the guardrail terminal. The deflector is configured to fold the w-shaped guardrail such that the first end and the second end of the w-shaped guardrail are repositioned from extending in the first direction to extending in a second direction that is opposite to the first direction.

This disclosure also provides a guardrail terminal comprising a first end, a second end, a downwardly oriented opening, and a first deflector. The first end is configured to receive a w-shaped guardrail including a first end and a second end, each of the first end and the second end of the w-shaped guardrail extending in a first direction. The downwardly oriented opening is positioned adjacent the second end of the guardrail terminal. The first deflector is positioned between the first end of the guardrail terminal and the downwardly oriented opening. The first deflector is configured to fold the w-shaped guardrail such that the first end and the second end of the w-shaped guardrail are repositioned from extending in the first direction to extending in a second direction that is opposite to the first direction.

This disclosure also provides a guardrail assembly, comprising a w-shaped guardrail, a guardrail terminal, and a plurality of posts supporting the w-shaped guardrail. The guardrail terminal is configured to receive the w-shaped guardrail. The guardrail terminal includes an impact face and a deflector extending horizontally from an interior wall of the guardrail terminal. The guardrail terminal and deflector are configured to fold the w-shaped guardrail. The plurality of posts have plastic moments perpendicular to the w-shaped guardrail in a range from about 9,000 ft-lb to about 38,000 ft.-lbs.

Advantages and features of the embodiments of this disclosure will become more apparent from the following detailed description of exemplary embodiments when viewed in conjunction with the accompanying drawings.

BRIEF DESCRIPTION OF THE DRAWINGS

FIG. 8 shows a plan view of the friction-inducing subassembly shown in FIG. 4.

FIG. 9 shows a plan view of an anchor for the cable of the of the guardrail and guardrail terminal of FIG. 1.

FIG. 10 shows an elevation view of the anchor of FIG. 9.

FIG. 11 shows another elevation view of the anchor of FIG. 9.

DETAILED DESCRIPTION

Figure 1:
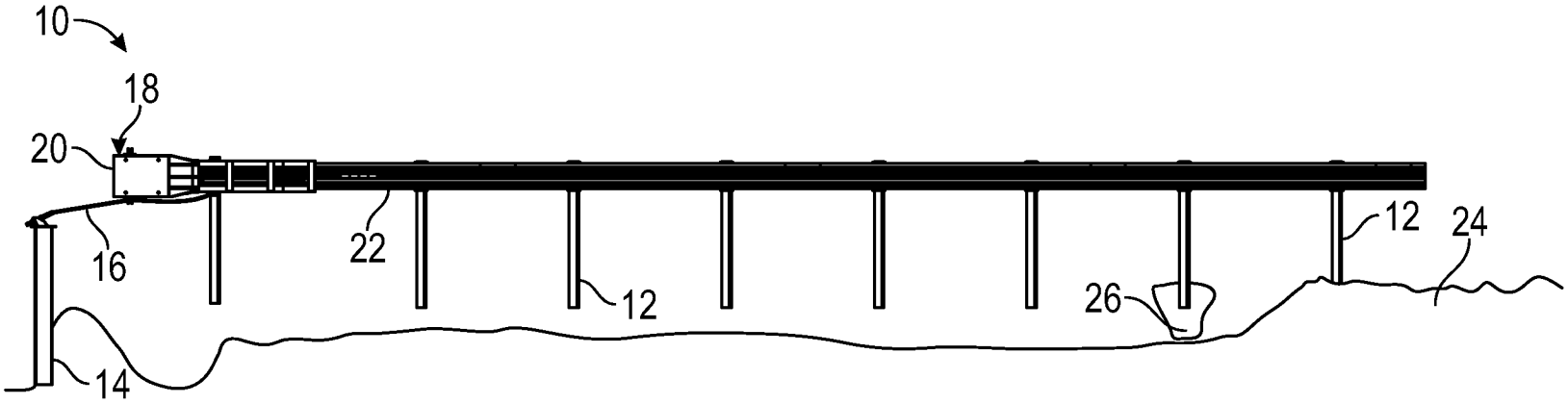
FIG. 1 shows an elevation view of a guardrail and guardrail terminal in accordance with an exemplary embodiment of the present disclosure.

The present disclosure presents embodiments of a folding guardrail terminal design that is configured to fold a guardrail beam from an unfolded state to a folded state during a collision or impact on an impact plate or face of a terminal of the guardrail. In other words, the guardrail of the present disclosure is in an unfolded state prior to a collision or impact with the guardrail terminals of the present disclosure, simplifying installation and assembly over designs that require partial or complete folding of the guardrail beam during assembly of the guardrail beam and the guardrail terminal while maintaining the advantages of predetermined folding of the guardrail beam during impact or collision. The folding guardrail terminal shows improved performance over conventional designs, decreasing the likelihood of serious injury and/or death from impact on a guardrail equipped with the presently disclosed guardrail terminals, especially such injuries and/or death that might otherwise occur due to gating through the guardrail during an impact. The present disclosure also includes embodiments of a reverse release mechanism to permit release of an equipped guardrail during an impact downstream of a terminal end.

In the context of this disclosure, the term "guardrail" and "guardrail beam" should be taken as being synonymous. The term "guardrail assembly" should be considered to be elements of a guardrail along with, for example, guardrail anchor or support posts, guardrail terminal, anchor cable, anchor cable support post, and release plate. To the extent that this disclosure may use the terms "unit," "member," and other such terms that may inappropriately be considered "nonce" terms, these terms should be considered to invoke, for example, guardrail, guardrail assembly, guardrail terminal, guardrail terminal assembly, anchor post, anchor cable, reverse release plate, and the like to the extent applicable in context to the description and related claims.

After deep study and analysis of existing terminal designs, Applicant came to understand that conventional designs, while they work well for their intended purpose, have certain limitations. For example, to steer an impacting vehicle, a tension-based guardrail terminal can utilize an impact head that buries itself into the front of an impacting vehicle. Because the impact head can only pull laterally on the front of the vehicle, there is a strong propensity for the vehicle to spin-out and become detached from the impact head. This propensity is magnified by the decelerating forces applied to the impact head as the guardrail is forced through it. If a terminal is to capture most vehicles striking the end of the impact head, considering the substantial variation in size, weight, center-of-gravity, etc., there must be a balance between the lateral forces that pull the front of the vehicle back toward the roadway and the deceleration forces applied to the impact head by the guardrail.

Applicant further came to understand that there is a relatively narrow range of lateral force (steering force) and longitudinal force (deceleration force) combinations that allow a guardrail terminal to safely capture most impacting vehicles. Because both lateral and longitudinal forces clearly affect the gating action of the terminal, and because these forces are relatively independent of one another as a matter of design, their combined effect becomes the critical determinant between gating and non-gating performance. Applicant conducted an extensive effort that included both a full-scale crash testing program and a non-linear finite element modeling analysis that were combined to identify the relationships between decelerations and various guardrail post designs that can be expected to prevent gating for most passenger vehicles impacting at angles of 15 degrees or less. The plot or graph shown in FIG. 74 identifies the combinations of average deceleration force during a 15 degree impact on the terminal and guardrail post plastic moment perpendicular to the guardrail that are most likely to produce a non-gating guardrail terminal. Note that any deceleration rate and post strength combination that falls within bounded region 300 shown in FIG. 74 produce a non-gating terminal design. Full-scale crash tests have shown that this figure is generally conservative, meaning that design combinations outside of bounded region 300 shown in FIG. 74 may also produce non-gating results. Accordingly, bounded region 300 is not a limit of a range, but an approximate limit of a range.

Figure 82:
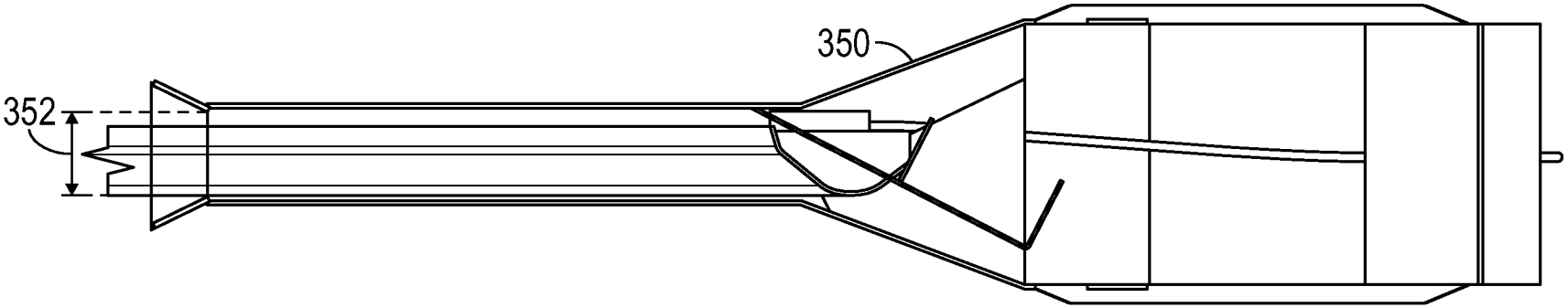
FIG. 82 shows a top plan view of a guard rail terminal in accordance with an exemplary embodiment of the present disclosure.
Figure 83:
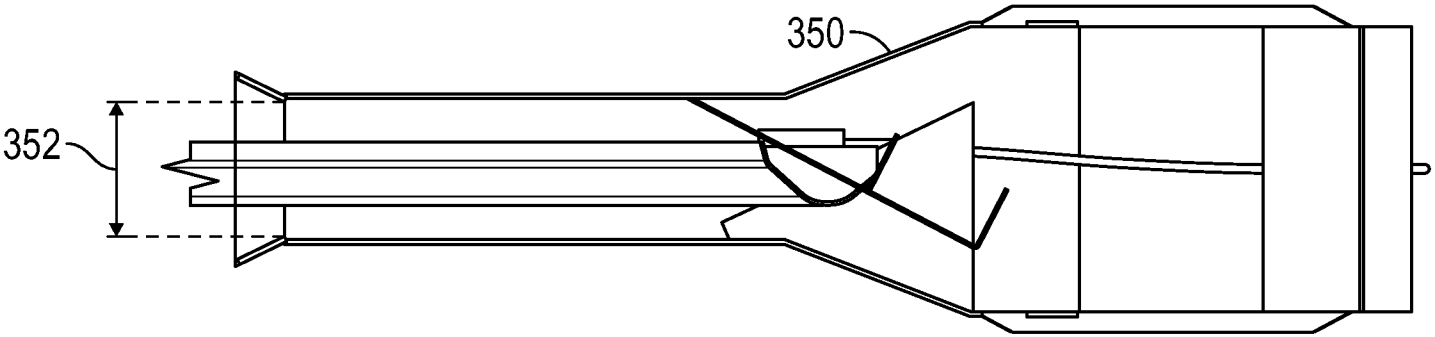
FIG. 83 shows a top plan view of a guard rail terminal in accordance with an exemplary embodiment of the present disclosure showing variation in a width of a throat input in comparison to FIG. 82.

As discussed above, the critical parameters for producing a safe guardrail terminal include deceleration force and the lateral force generated by guardrail posts. One advantage of the folding terminal design is the ability to adjust the deceleration forces from very low, less than 6,700 pounds, to relatively high, which can be more than 15,000 pounds. The primary methods for reducing or increasing deceleration force in this system include adjusting a width 352 of an entrance to a throat 350 of the terminal (e.g., see FIGS. 82 and 83) where the guardrail is folded in half; increasing a flare rate in a folding region of the terminal, and eliminating wedges, deflectors, and/or diverters that force a top and a bottom of the guardrail forward to complete the fold; see FIGS. 71 and 72. Through extensive testing and analysis, Applicant has determined that if the width of the throat entrance is 9 inches or greater, the guardrail will be allowed to fold in half without any restrictions, which minimizes friction on the guardrail as it is folded in half. If the throat width is reduced, friction between the guardrail and the impact head increases significantly. If the throat width is reduced to less than 5 inches, deceleration force will be more than double.

Figure 84:
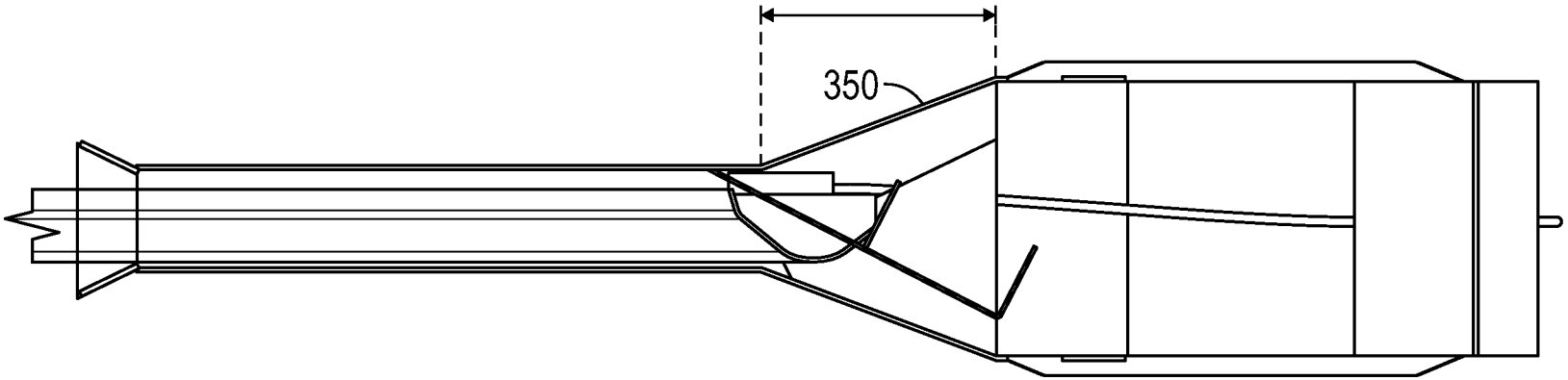
FIG. 84 shows a top plan view of a guard rail terminal in accordance with an exemplary embodiment of the present disclosure.
Figure 85:
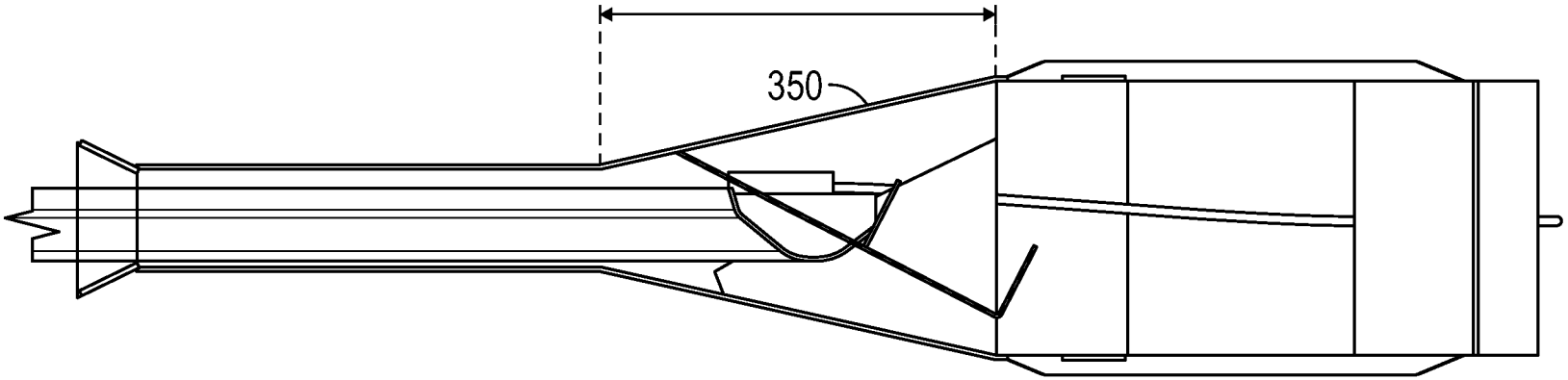
FIG. 85 shows a top plan view of a guard rail terminal in accordance with an exemplary embodiment of the present disclosure showing variation in a length of a throat in comparison to FIG. 84.

Applicant has further determined through extensive testing and analysis that another factor that controls the guardrail terminal deceleration force is the flare rate in throat 350 of the guardrail terminal; see FIGS. 84 and 85. The terminal must widen as the guardrail is folded and the final width and length of flared region has an effect on friction as the guardrail is folded. Eliminating the wedges, deflectors, or diverters that force the top and bottom of the guardrail forward to complete the fold also reduces the force required to push the head down the rail, as is discussed further herein. The wedges are not necessary to complete the fold because the W-beam warps into a folded shape when the valley of the rail is forced backward. Applicant has determined through extensive testing and analysis that these design changes enable the terminal deceleration forces to be adjusted over a wide range.

Other factors besides preventing gating can influence the desired deceleration force. For example, it may be necessary to increase deceleration forces in order to shorten the overall length of the terminal. Shorter guardrail terminals are generally less expensive and can be used in places where there is insufficient space for a longer system.

Establishing a strong mechanical interlock between a terminal impact head and an impacting vehicle is critical to providing non-gating behavior. Such an interlock is required to provide steering forces to direct impacting vehicles back toward the roadway. A preferred embodiment for creating interlock between a terminal impact head and an impacting vehicle incorporates steel plates on the top, bottom, and both sides of a rectangular impact plate. These plates act as teeth that bite into the front of the vehicle. The horizontal plates at the top and bottom of the impact plate prevent vertical motion of the impact head while also strengthening the plates on the side. The plates on the side of the impact head decrease, and preferably prevent horizontal movement of the vehicle relative to the terminal head. In order to provide adequate interlock, the impact head may preferably be 12 inches wide, or more, and the tooth plates preferably need to extend at least 2.5 inches beyond the impact plate. The teeth plates preferably need to be at least 0.2 inches thick. The teeth plates can be made from a single sheet of steel or thinner plates folded back on itself. In the case of folding, the teeth plates can be reinforced by bending them into A-shapes that more than quadruple the compressive buckling strength of the teeth. The volume of space between the teeth should preferably be empty so that forces on the teeth are maximized and not distributed across the impact plate. If intermediate plates are used in the interior of the impact head, the teeth plates will not dig into the front of the car but instead will crush the vehicle more or less uniformly across the face of the impact plate. Without the mechanical interlock between the teeth plates and the front of the vehicle, the impact head will tend to rotate about an axis parallel to the guardrail and become disengaged from the vehicle. In this case, all capability of redirecting the vehicle is lost. As indicated hereinabove, the preferred dimensions described herein were obtained by extensive modeling supplemented by full-scale crash testing.

Another important feature of the guardrail terminal is the ability to anchor the end of the W-beam to provide redirective capacity downstream of the terminal. When a vehicle strikes the guardrail near the terminal at high-speed and high-angle, it must also be capable of releasing when a vehicle strikes the terminal from the opposite direction. A widely used releasable cable anchor design incorporates a V-notched plated mounted at an acute angle with respect to the vertical direction such that the top of the plate is set further away from the guardrail head than the base of the plate. This design was successfully tested in the 1990's for both redirection impact downstream of the terminal as well as reverse direction strikes that require release of the anchor from the guardrail.

A new reverse release configuration has been developed for the presently disclose guardrail terminals. Note that in the present embodiments the cable anchor is mounted perpendicular to the anchor post. The cable anchor provides two mechanisms for release, (1) breaking of a bolt and (2) release of a slip base connection from the anchor post. If the impact head applies a vertical load on the end of a swaged fitting, a threaded stud at the end of the anchor will begin to bend. Because the threaded shank is preferably made from grade 5 bolt material, the bolt will have a propensity to fracture without absorbing much of the vehicle's impact energy. However, if the end of the impact head remains down, it will ride up a ramp in the front of the impact head and strike a release plate. The release plate is attached to the anchor post by two slip bolts and a vertical restraint. The vertical restraint prevents the slip mechanism from rotating upward and dislodging the anchor during redirective impacts on the guardrail.

The inventions described herein include a tension-based guardrail terminal that includes improvements over existing designs, shown generally in FIGS. 1-45. The following discussion will summarize the features of the new terminal system that has numerous performance improvements over conventional guardrail designs.

There are two basic approaches to improving guardrail technology. One technique involves using an impact head that collects the guardrail as the impact head is pushed down the barrier, similar to a conventional cannister system, as shown in, for example, FIGS. 12-16. The other technique involves drawing the guardrail through a series of plates configured to fold the rail in half, as shown in FIGS. 17-34.

One difference between the presently described system for collecting the guardrail and a competing guardrail system is that the energy management system relies on controlled buckling of a flattened W-beam, rather than pushing the guardrail into a round barrel. The new design flattens the W-beam and directs it into a polygonal shaped region (e.g., see FIGS. 6, and 12-16) with a bend at an obtuse angle directly in front of the flattened guardrail. The obtuse angled bend captures the end of the guardrail and forces the flattened rail to lay against one side of the interior of the polygon. When the guardrail reaches the end of the polygonal face, it is forced to reverse directions and lay down along the guardrail that is already there. The flattened guardrail will then continue across the entire width of the impact head and reverse directions again when it encounters the opposite side of the polygon. With each layer of flattened guardrail that is deposited in the polygon shaped chamber, the length of guardrail that must buckle when the lay down process reverses direction is shortened. Shortening of the buckling length increases the forces required to push the guardrail into the impact head. In addition, as the mass inside the terminal grows, more linear momentum must be transferred from the vehicle to the guardrail to accelerate the guardrail and decelerate the vehicle. Hence as the vehicle pushes the impact head farther down the rail, the resistance forces increase. This feature allows the terminal to provide low impact forces for small cars that do not have sufficient energy to push the impact head very far and higher stopping forces for heavy vehicles that can push the impact head to the end of the terminal.

One advantage of this design is that it can be restarted after an initial impact because guardrail can be forced into the polygon without moving any of the guardrail deposited in a prior impact. Hence, there is some residual safety benefit from the guardrail terminal after it has been struck, provided the impact head is still aligned with the guardrail.

One embodiment of the present guardrail terminal includes a cable that passes through the impact head to provide anchorage for the end of the guardrail and a mechanism for keeping the impact head aligned with the guardrail. In this case, the cable is attached to a deeply embedded end anchor near the front of the terminal. The cable then passes through an opening near the front of the impact head and passes through the interior of the impact head. The path of the cable through the impact head is relatively straight in order to keep the impact head aligned with the guardrail and minimize friction between the impact head and the cable. Note that the cable is attached to the end anchor such that it does not release during end on impacts with the terminal, but it does release during reverse direction impacts on the guardrail. The breakaway system incorporates a "boot jack" type of structure that positions the cable at an angle that is between horizontal with the ground and angled 25 degrees above the ground (e.g., see FIGS. 9-11 and 42-45). A threaded shank is swaged to the end of the cable and passed through the opening in the top of the boot jack structure. A nut and washer(s) are used to hold the end of the cable in the boot jack when the barrier is struck head-on. When the terminal is struck in a reverse direction with the impacting vehicle sliding toward the guardrail end, and contacting the downstream end of the impact head, the impact head strikes the top of the boot jack and releases the cable from the deeply embedded end anchor post. When the cable is released from the boot jack, the head is free to rotate out of the path of the impacting vehicle. Note this anchor is a new design that is an outgrowth of a design that has been in use for more than 30 years and was tested in the 1990's to assure it provided adequate anchorage and would release when struck in the reverse direction.

The opposite end of the cable is attached to the guardrail beam. This attachment may be a break away cable bracket similar to those used in compression-based terminals (e.g., see FIGS. 5-6, and 8), or it may be rigidly mounted to the guardrail (e.g., a welded button or a bolted BCT anchor). The length of the cable is controlled by the impact energy expected adjacent to the roadway where the terminal is installed. Along freeways with expected impact speeds up to 100 km/hour (62.5 MPH), the cables should extend to the $6^{th}$ post or beyond. This distance is shorter than conventional energy absorbing guardrail terminals.

Another unique feature that must be incorporated into a tension-based terminal that utilizes a cable along its length is a breakaway connection between the cable and the guardrail located near the impact head. The anchor needs to completely detach from the cable without incorporating a button or some other element that remains attached to the cable after the cable is detached from the guardrail. The preferred attachment system utilizes short rods welded to two different plates in a staggered pattern as shown in FIG. 8. The anchor cable is placed between the two plates with bolts passing through the guardrail and connecting the two plates at gaps between the rods. The plates, bolts, and rods can be described as a friction-inducing assembly or a ladder bracket assembly. When the bolts are tightened, the cable is bent around the rods and high friction develops. The friction is magnified by replacing the smooth rods with threaded rods. The bolts used to attach the bracket system are configured to be sheared off when the end of the impact head contacts the leading edge of the back-plate on the back side of the W-beam. The upstream anchor must be detachable to allow the cable to pass through the impact head during end-on terminal impacts. Upstream posts, i.e., posts toward the guardrail terminal, are preferably identical in orientation and assembly to downstream posts, i.e., posts away from the guardrail terminal.

More specifically, turning to FIGS. 1-16, a guardrail terminal assembly 10 is shown. Guardrail terminal assembly 10 includes a guardrail beam or barrier 22, which is supported by a plurality of guardrail anchor posts 12 that extend into ground 24, which is shown partially removed in FIG. 1 to expose an entirety of a bottom end of guardrail anchor posts 12. In an exemplary embodiment, guardrail anchor posts 12 can be secured by concrete 26 in ground 24.

Figure 2:
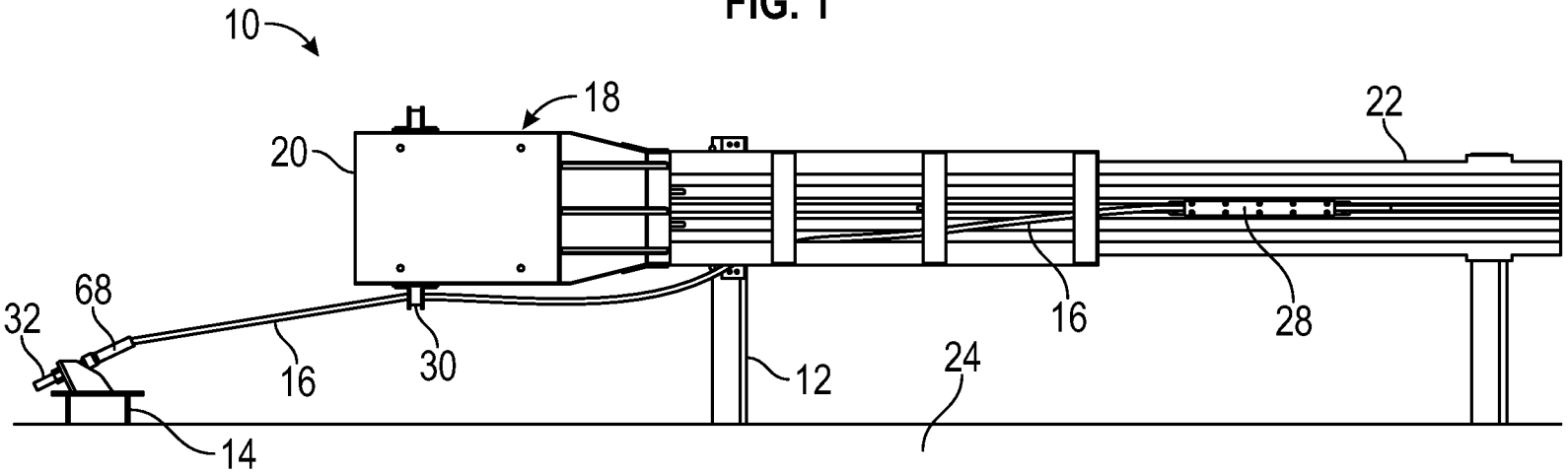
FIG. 2 shows the guardrail terminal and a portion of the guardrail of FIG. 1.
Figure 3:
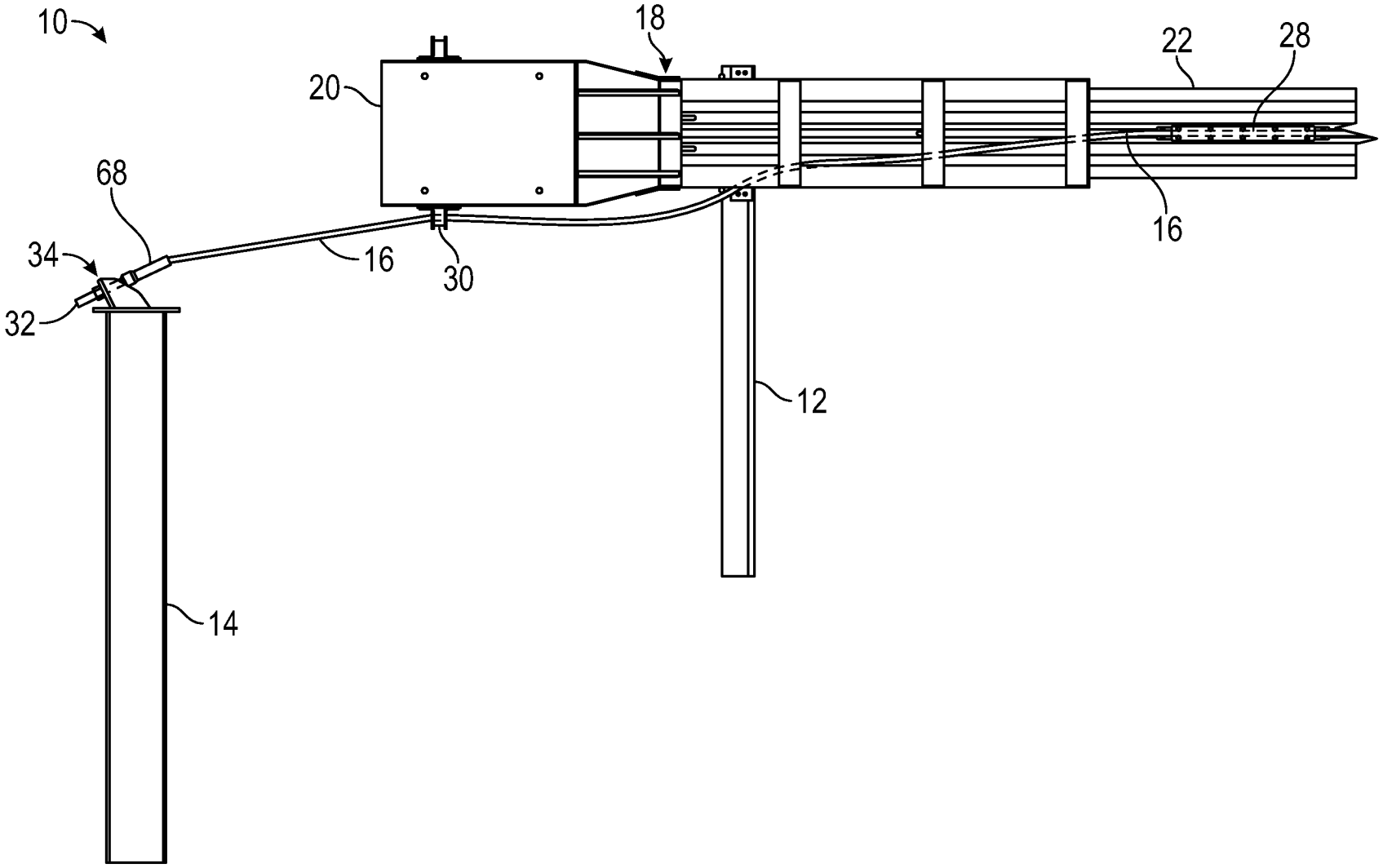
FIG. 3 shows a view similar to FIG. 2, with anchor posts exposed.

As shown in FIGS. 2 and 3, guardrail terminal assembly 10 can also include a friction mechanism 28, a cable guide or eyelet 30 positioned on an underside of guardrail terminal 18, a threaded shank 32, and a boot jack structure 34. Cable 16 can be secured to guardrail beam 22 by friction mechanism 28. Cable 16 can then be routed along guardrail beam 22 to and through cable guide 30. Cable 16 is mechanically clamped or swaged by a swaged connector 68 to threaded shank 32. Threaded shank 32 is then secured or attached to cable anchor post 14 by boot jack structure 34.

Figure 4:
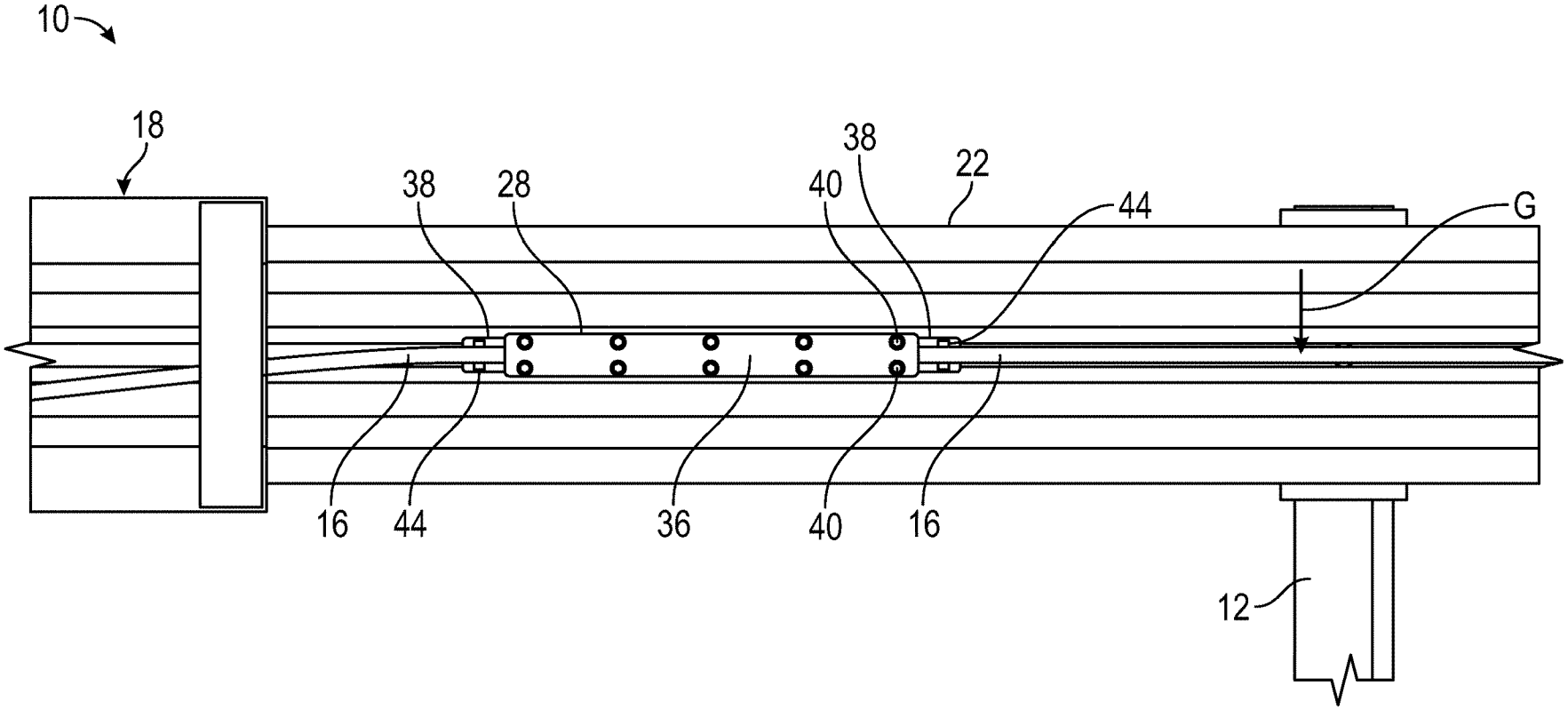
FIG. 4 shows a view of a portion of the guardrail and guardrail terminal of FIG. 1 that includes a friction-inducing subassembly for a guardrail cable.

Referring to FIGS. 4 and 8, cable friction mechanism 28 can include a first plate 36 and a second plate 38 positioned on a first side of guardrail beam 22. A support bracket 42 is positioned on an opposite side of guardrail beam 22 from first plate 36 and second plate 38. Cable 16 extends directly between first plate 36 and second plate 38. On alternating sides of cable 16, directly between either cable 16 and first plate 36 or directly between cable 16 and second plate 38, are a plurality of friction rods 44. Friction rods 44 can be welded to first plate 36 or second plate 38 in an alternating pattern to secure friction rods 44 to cable friction assembly mechanism 28. Shear bolts 40 extend from a first side of first plate 36, through second plate 38, into openings or holes 46 formed in support bracket 42. Shear bolts 40 can be secured in position by nuts 48, providing clamp force to cable 16 and friction rods 44, as shown in FIG. 8.

As described hereinabove, when a vehicle hits impact head 20, guardrail terminal 18 begins sliding down guardrail beam 22. As shown in FIG. 8, guardrail terminal 18 includes an end surface 78 positioned on a downstream end of guardrail terminal 18. When end surface 78 strikes support bracket 42, support bracket 42 shears plurality of shear bolts 40. The shearing of shear bolts 40 permits cable 16, which was secured to guardrail beam 22 by the frictional contact of cable 16 with first plate 36, and second plate 38, to release from guardrail beam 22. Accordingly, the risk of cable 16 binding with guardrail terminal 18 and breaking away from cable anchor post 14 is decreased substantially.

Conversely, in a reverse impact on guardrail terminal 18, the frictional force of cable 16 against friction rods 44, first plate 36, and second plate 38 helps to prevent instantaneous release of guardrail terminal 18 from guardrail assembly 10. Accordingly, a vehicle engaging guardrail terminal 18 in a reverse impact reduces the risk that guardrail terminal 18 uncontrollably releases from guardrail assembly 10 as well as providing some deceleration of a vehicle.

Figure 5:
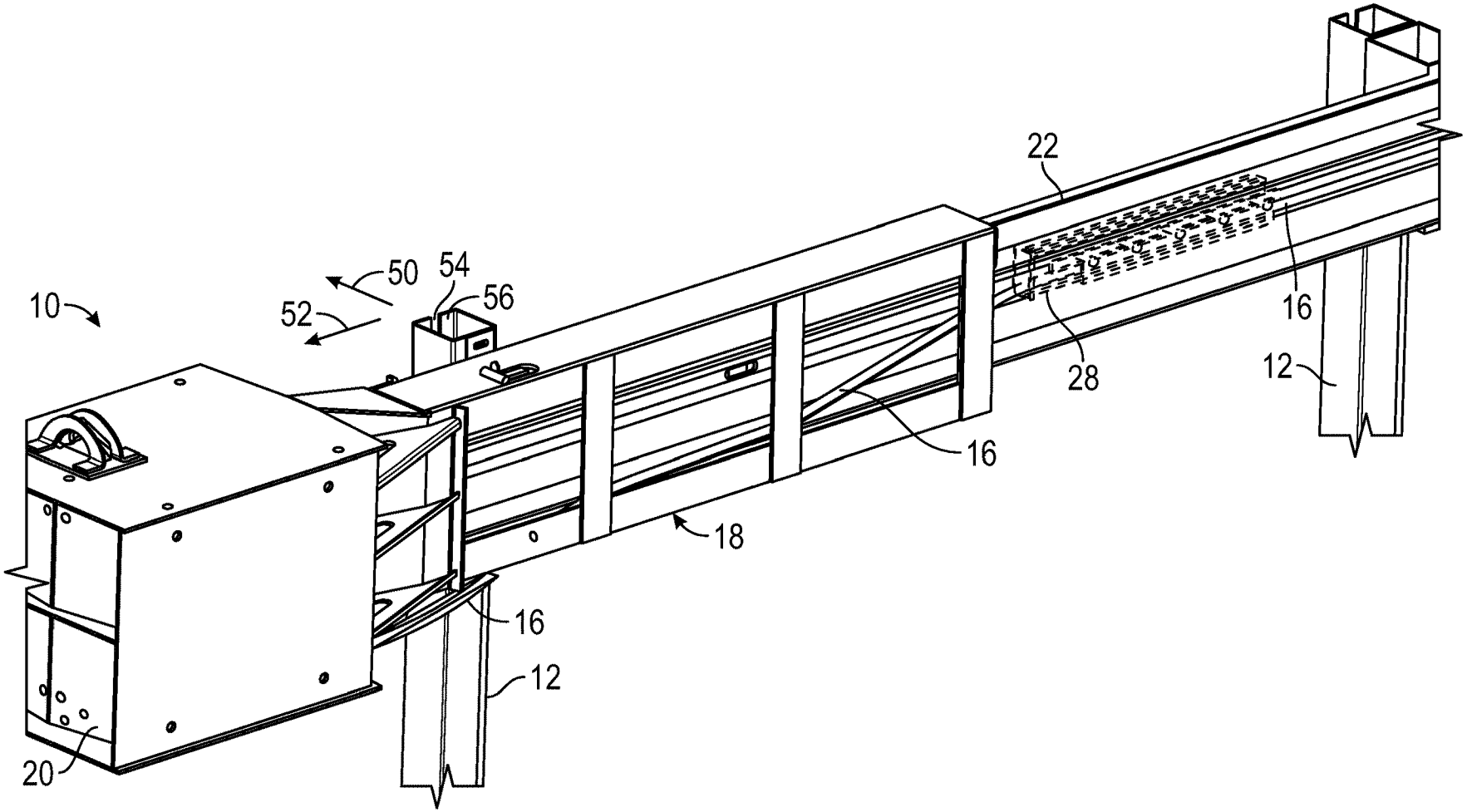
FIG. 5 shows a perspective view of the guardrail and guardrail terminal of FIG. 1.
Figure 6:
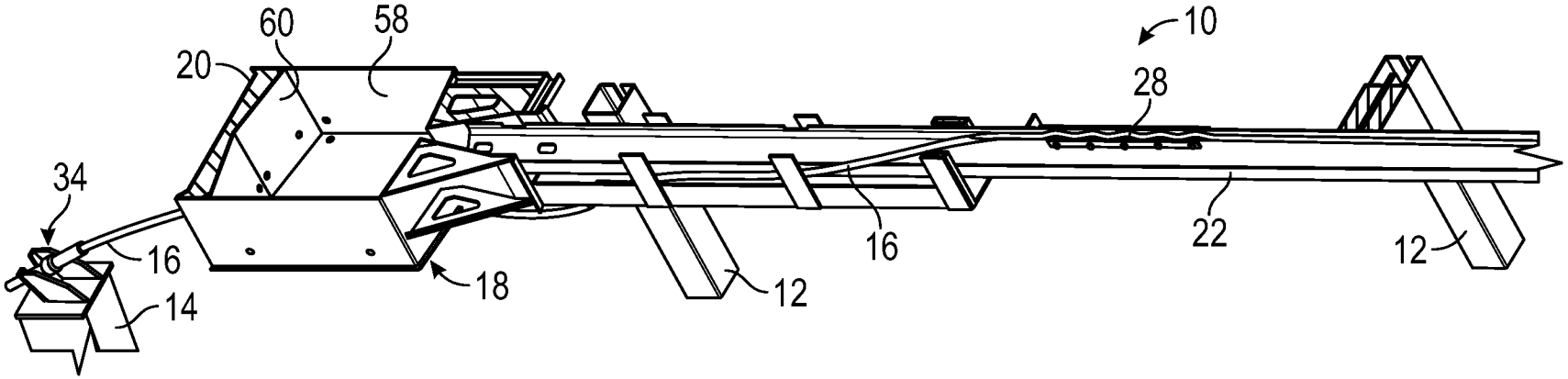
FIG. 6 shows another perspective view of the guardrail and guardrail terminal of FIG. 1.
Figure 7:
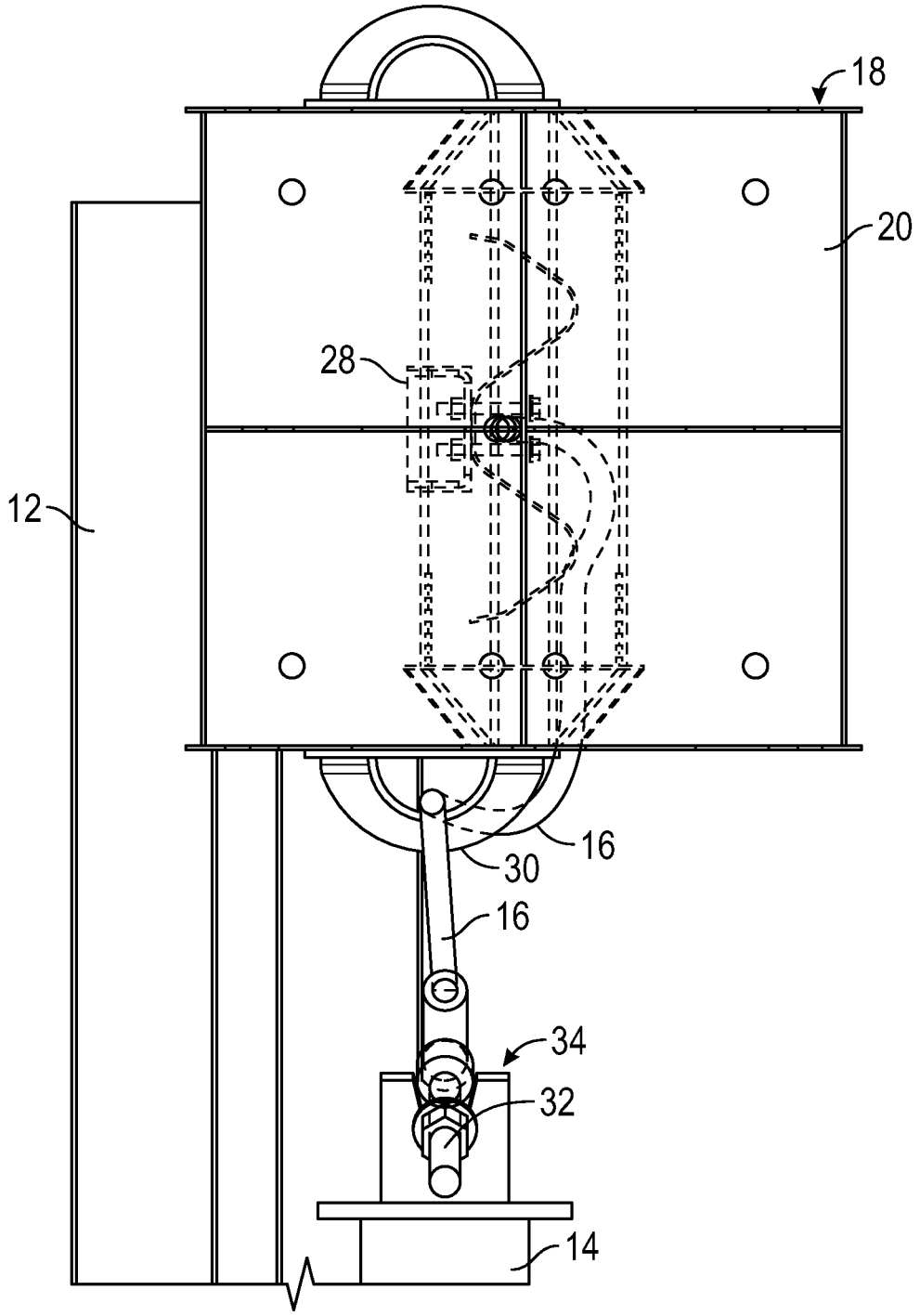
FIG. 7 shows a front view of a box terminal of the guardrail and guardrail terminal of FIG. 1.
Figure 12:
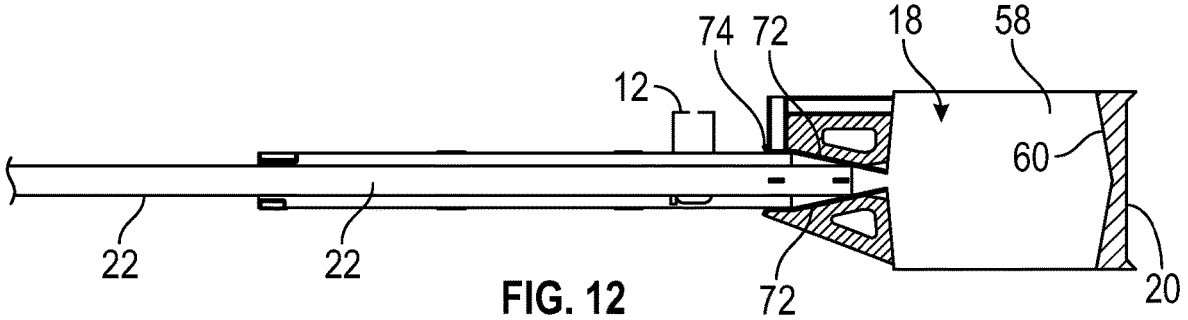
FIG. 12 shows a view of a portion of the guardrail and guardrail terminal of FIG. 1, in a configuration prior to a vehicle impact on the guardrail terminal.
Figure 13:
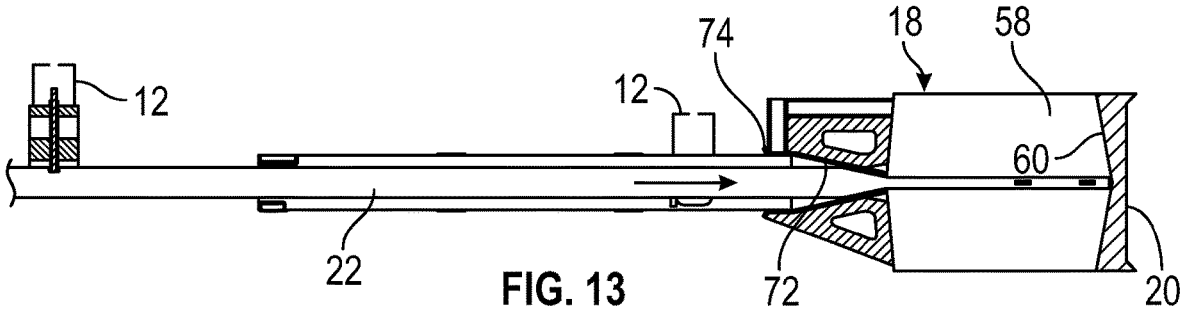
FIG. 13. shows a view of the guardrail and guardrail terminal of FIG. 12, with the guardrail terminal pushed toward a W-beam, just prior to contact of an interior wall of the guardrail terminal with the W-beam.
Figure 14:
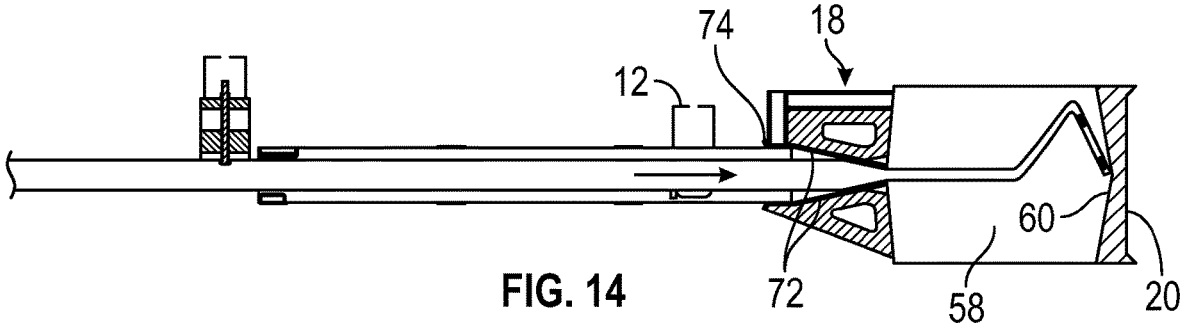
FIG. 14 shows a view of the guardrail and guardrail terminal of FIG. 12, with the guardrail terminal pushed toward the W-beam, with the W-beam collapsing due to contact of the W-beam with the interior wall of the guardrail terminal.
Figure 15:
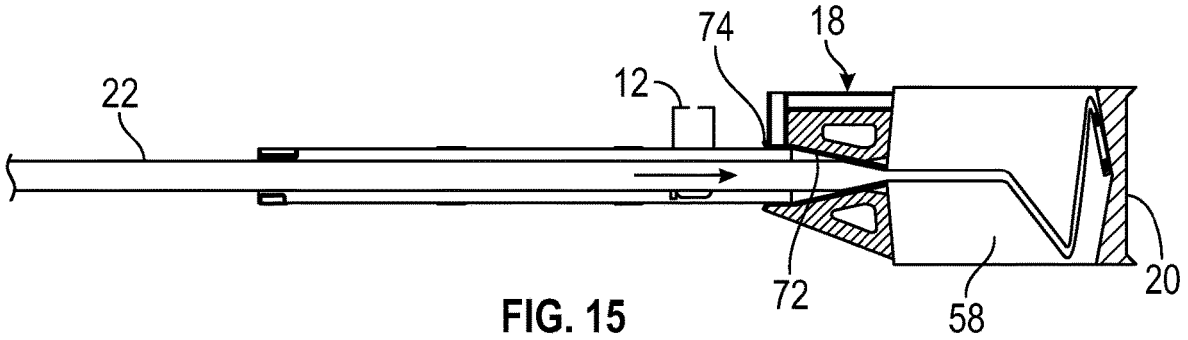
FIG. 15 shows a view of the guardrail and guardrail terminal of FIG. 14, with the guardrail terminal pushed further toward the W-beam than is shown in FIG. 14.
Figure 16:
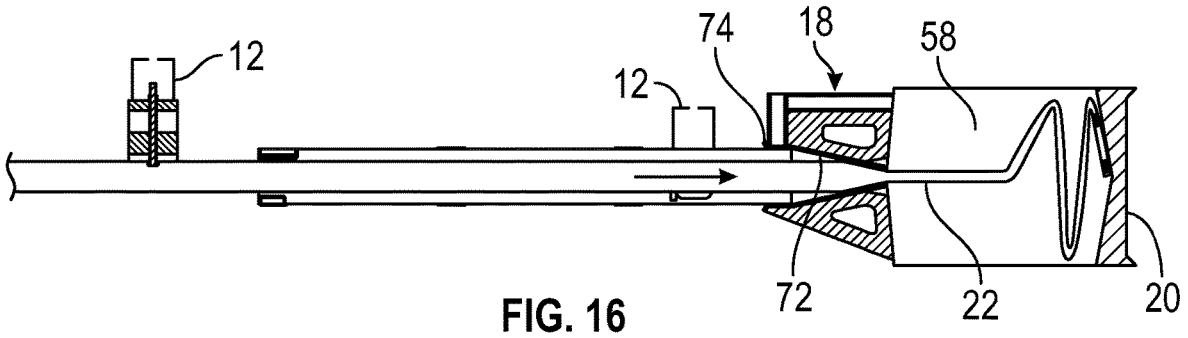
FIG. 16 shows a view of the guardrail and guardrail terminal of FIGS. 12-15, with the guardrail terminal pushed further toward the W-beam than in FIG. 15, showing multiple bends in the W-beam due to the force of collision with the guardrail terminal.

As can be seen in FIG. 5, the interface of guardrail post 12 with guardrail beam 22 can also be beneficial in deceleration of an impacting vehicle. Guardrail post 12 have a tubular shape that includes a cutout 54 on a back 56, which is on an opposite side of guardrail post 12 from guardrail beam 22. Cutout 54 and the bolting or connecting of guardrail post 12 to guardrail beam 22 leads to a strong post axis 50 in a transverse direction that is perpendicular to a longitudinal direction of guardrail beam 22, and a weak post axis 52 in a same direction that guardrail beam 22 extends. The benefit of these weak and strong axes is that guardrail beam 22 resisting gating through guardrail beam 22, maintaining an impacting vehicle on a same side of guardrail beam 22 as a road, and the weak axis permits guardrail beam 22 to give by flexing, shearing, and resisting as an impacting vehicle impacts guardrail terminal 18 and/or guardrail beam 22. Referring to, for example, FIG. 6, guardrail terminal 18 can include a polygonal interior 58, which can include a polygonal interior face 60.

Referring to FIGS. 9-11, boot jack 34 can include a pair of side walls 62 connected to an angled front wall 64 that can be at an angle of approximately 70 degrees with respect to the horizontal. The angle of front wall 64 includes a slot 70 and is set based on distance from cable guide or eyelet 30 and a height of cable guide or eyelet 30 above the ground. In a reverse impact on guardrail assembly 10, tension on cable 16 is released. When the release is significant, such as from a sustained reverse direction impact on guardrail assembly 10, the release of tension on cable 16 is sufficient to move threaded shank 32, which is secured to front wall 64 by a nut 66, away from front wall 64, releasing from slot 70 in front wall 64. Should the impacting vehicle continue to slide along guardrail assembly 10, cable 16 will no longer secure guardrail assembly 10 to cable anchor post 14 because of the release of cable 16 from slot 70, reducing the likelihood of damage to the impacting vehicle because guardrail terminal 18 is unable to disengage from cable anchor post 14.

Referring to FIGS. 12-16, guardrail terminal 18 includes flattening plates 72 positioned at either side of an opening 74 into polygonal interior 58. As shown, when a vehicle hits impact head 20, guardrail terminal 18 slides along guardrail beam 22. Guardrail beam 22 is forced into opening 74 and between flattening plates 72. Flattened guardrail beam 22 then extends into polygonal interior 58 to impact polygonal interior face 60. As guardrail terminal 18 continues to move along guardrail beam 22 under the force of an impacting vehicle, flattened guardrail beam 22 impacts interior polygonal face 60 and begins stacking up on polygonal interior face 60, remaining constrained in guardrail terminal 18, simultaneously increasing resistance to movement of guardrail terminal 18 and decelerating the impacting vehicle.

Other embodiments involve passing the guardrail through a set of deflector or diverter plates that folds the W-Beam in half (e.g. see FIGS. 17-34 and 70-85). The folding can be accomplished using two different approaches. One approach involves connecting a cable to the top and bottom edges of the W-beam and placing the bolted joints inside of guides that force the back edges of the rail to the front of the barrier. In this configuration, the center of the W-beam is forced over a wedge that pushes it toward the back of the rail. The guardrail exits the impact head folded in half with the top and bottom edges of the W-beam on the traffic side of the fold and the center on the back side.

An additional embodiment of this attachment includes swaging a button to the end of the cable and welding that button directly to the guardrail near the end of the guardrail (e.g., see FIGS. 45A-C and 46). This embodiment would include additional reinforcement around the button and crack arresting plates along the length of the first panel of guardrail beam. The welded button configuration is the preferred embodiment because mechanical fasteners and necessary attachments required to connect the cable to the guardrail beam can obstruct the initiation of the folding process, produce excessive deceleration forces, and destabilize the folding process.

Full-scale crash testing has identified two potential problems that can produce cracks in the guardrail, and design features have been developed to prevent these cracks from growing, should they occur in the field. When the guardrail strikes the V shaped deflector plate at the front of the terminal and the point of contact is near the peak of the V, a Mode II in-plane shear crack can develop. To reduce the likelihood of guardrail snagging near the peak of the V and inducing a Mode II in-plane shear crack, two triangular portions are cut away from the first section of guardrail (see FIGS. 45 and 46). A possible embodiment of the removed material is triangles with dimensions of 4 inches in the vertical direction and 7 inches in the horizontal direction. This results in a first section that is narrow in the vertical direction at the leading edge and expands to a standard W-beam cross-section after the first 7 inches. To further mitigate Mode II shear cracks a vertically oriented reinforcement plate can be used for arresting cracks. When post bolts pull through the guardrail, vertical cracks often develop, especially at posts 1 and 2 when large downward forces are still applied to the guardrail that are transmitted to the post bolts. In this situation, vertical cracks can grow as tension in the rail loads them in Mode I tension. These cracks can be arrested by horizontal reinforcements that are situated above and below the post bolt holes. Therefore, a series of additional plates were welded along the first panel of the guardrail (see FIGS. 45A-C and 46). First, a reinforcement plate around the swaged button was included in the traffic-side valley. This strengthens the cable connection, but it also stops Mode II fractures that begin at the leading edge of the guardrail. Another plate was installed over the valley of the guardrail but on the back side. It is located between the swaged button attachment and the hole for the second post. This arrestor is a redundant system in the event that the fracture that initiates on the leading edge propagates around the reinforcement plate. In this event, the fracture will propagate through the flat, non-strain hardened portion (the valley). The welded crack arrestor will be installed across this flat region to prevent any further crack opening, which, in turn, stops the growth of the crack. Finally, two parallel crack arresting plates will be installed above and below the hole for the attachment to the second post. This hole is located in a region that will experience high kinetic energy levels in the vehicle. As such, the hole may be subject to greater stresses than average and initiate a fracture as a result. The crack arrestors are long enough to prevent the crack from meandering around them. The arresters are also installed close to the hole, but far enough away to not interfere with the post blockout installation.

In another embodiment, deflector plates can push the top and bottom edges forward and the center of the guardrail beam is pulled across a wedge that pushes it back. Both of these configurations produce a folded W-beam with very little energy dissipation which produces low forces on impacting vehicles. Further, the low energy dissipation rates allow thicker W-beam to be used in the terminal which should provide better performance during impacts on the face of the guardrail near the terminal.

Once the guardrail has been folded, it would continue in a straight line. However, because it is attached to a cable that is tensioned and angled toward the ground, the folded guardrail will be pulled toward the ground as well. The amount that the folded guardrail is pulled down would not be sufficient to pass under the vehicle without interaction. Therefore, a deflector plate was designed to guide the folded guardrail down at a steeper angle (e.g., see FIG. 44). The proximity of the break point in the deflector plate must be sufficiently far from the end of the folding mechanism in order for the tension in the cable to deflect the folded guardrail below that break point. The deflector plate was configured to accomplish two additional tasks. First, it would provide an additional design element that can tune the deceleration force applied to the vehicle. As the face gets steeper, with the extreme being vertical, the resistance increases because the guardrail must deflect in a more tortuous manner. Second, the overall height of the deflector plate can ensure that the folded guardrail passes under the vehicle. This selected range of heights would be incorporated symmetrically such that the terminal can be used on either side of the road.

The folding terminal head has an opening through which the guardrail exits and passes under the vehicle. This opening also leads to contact between the terminal head and the folded guardrail beam when the angle of the impact is non-zero. The forces applied to the vehicle to redirect it while also slowing it down pass from guardrail and into the vehicle through the terminal head. The opening in the terminal head experiences stresses as a result, and stress concentration occur at the corners that can easily lead to fracture through the terminal head. If this happens, the terminal head can no longer transfer the redirecting forces from the guardrail to the vehicle. As such, the edge was constructed with a return where the opening was cut with a tab, and then the tab was bent at a 90-degree angle. This effectively increased the depth of the cross section, making it much stronger in bending. To further increase the strength of the design, a bar stock was welded behind the return, which greatly increase the resistance to the initiation of fracture as well as the bending strength. The embodiment can be seen in FIG. 42.

Another major advancement in tension-based guardrail terminal design is the development of a new post configuration (see FIGS. 5 and 35-41). The most common posts used in guardrail terminals are wide flange beams installed with the strong axis perpendicular to the guardrail. These posts have been proven to be too stiff when struck during head-on terminal crashes. The excessive post stiffness has been shown to lift the front of impacting vehicles which can cause impacting vehicles to rollover. Further, the flanges of I-beam shaped posts have cut into the floor pan, gas tanks, and oil pans of test vehicles during end-on impacts with a post. A new post configuration has been developed that allows the post to be optimized for lateral stiffness while substantially reducing the risk of cutting the floorboard, gas tank, or oil pan. The basic post configuration incorporates an open cross-section in the shape of a box with a small cutout in the back of the post (see FIGS. 5, 35, 37, 38, 40, and 41). The open cross-section provides a much larger ratio between the strong axis and weak axis of the post. When loaded perpendicular to the guardrail, the post loading delivers the lateral forces into the webs of the beam which allows a significant bending moment to develop. However, when struck parallel to the guardrail, the post collapses in a consistent manner and allows the post to be flattened without lifting up the front of a vehicle or sharp edges of the cross section cutting into critical vehicle components.

Additionally, this embodiment includes a new first-post configuration. One that uses the same open cross-section box shape as seen in FIGS. 5, 35, 38, and 39, but is attached directly to the terminal head. This first post has two through holes that are approximately ⅜" in diameter along the vertical centerline of the front face of the post. Similarly, the terminal head has two first-post tabs on the post-side of the feeder chute (one on the top and one on the bottom) that each have a ⅜"×1" slot centered vertically and spanning across the horizontal centerline of the tab. Grade 5 hardware (approximately 5⁄16" diameter) is used to attach the guardrail terminal to the first post, which shears easily on impact. This first post mounts the terminal head parallel to the ground and maintains that position prior to impact, even under the load of the high tension cable. Keeping the terminal head parallel to the ground optimizes the chances of the system functioning properly during an impact from a moving mass.

In most guardrail terminal systems, the first post must be especially design to break away or hinge when hit at a zero-degree angle. This is different than the rest of the posts used in these systems, which commonly employ standard line posts (e.g., a 6-ft long W6×9 steel post). The new post proposed in the previous paragraph is very similar to the square tube post described two paragraphs previous to the present paragraph, with the addition of the mounting holes. This small addition is very inexpensive. As such, the first post will be able to function properly, as any first post in other systems, without the large added expense.

Figures 73, 74:
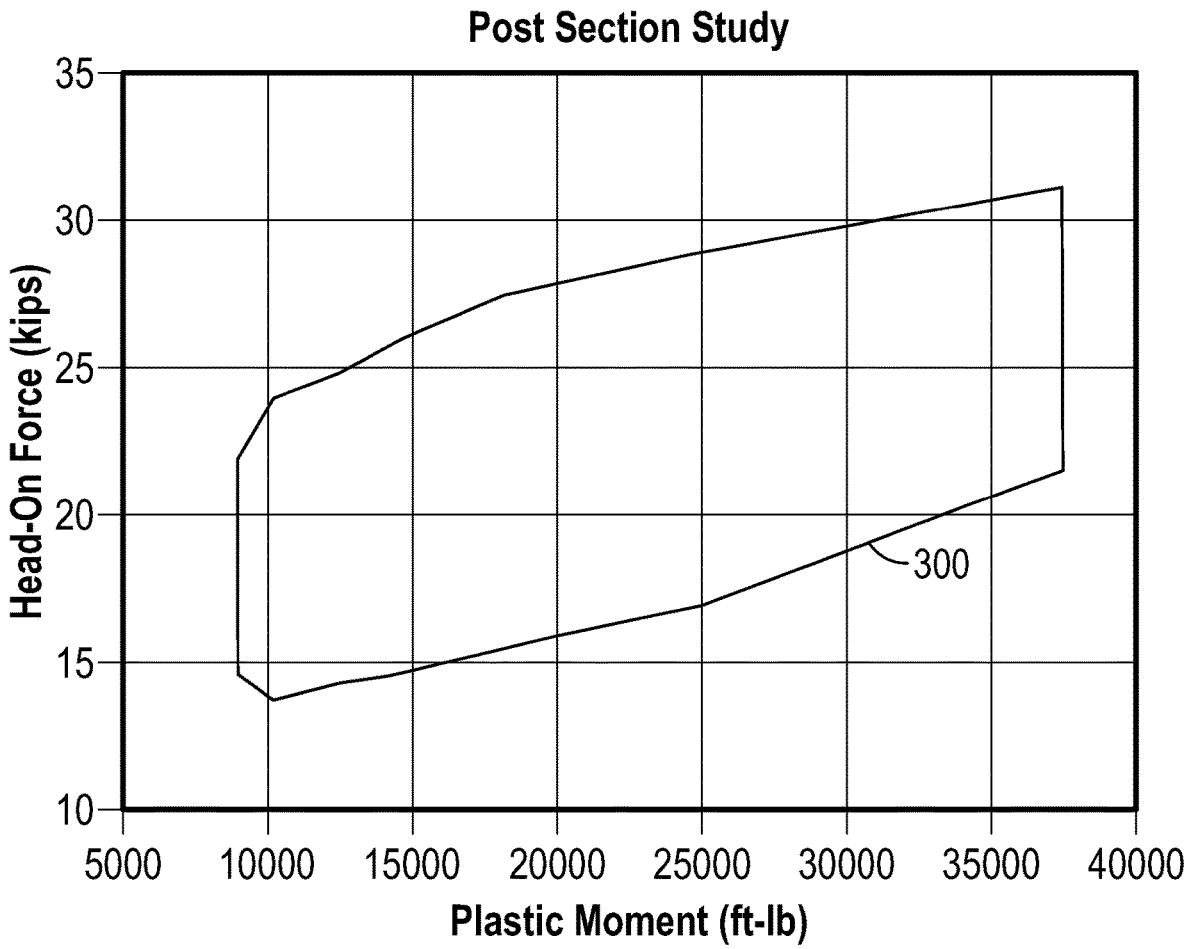
FIG. 73 shows a table of values of force of various versions of the guardrail and terminal of the present disclosure.
FIG. 74 shows a graph of preferable values of head-on force with respect to plastic moments of certain guardrails and guardrail terminals of the present disclosure.

Further, testing has shown that tuning the lateral stiffness of posts in a tension-based terminal can allow it to capture vehicles impacting at angles up to 15 degrees relative to the guardrail. It should be noted that approximately 85% of all ran-off-road impacts involve vehicle trajectories of 15 degrees or less relative to the roadway. The post stiffness must be tuned to match the energy dissipation rate of the terminal system. High energy dissipation rates require posts with greater bending strength perpendicular to the rail while designs with low energy dissipation rates can be made to capture more impacting vehicles when installed on posts with a lower bending strength. Modeling and full-scale crash testing has shown that terminals with average deceleration forces of 15 kips provide optimum capture capability when the yield strength of the post perpendicular to the guardrail is between 9,000 and 15,000 ft-lb. When the energy dissipation forces drop to 14 kips, optimal capture behavior can be obtained with the post yield strengths between 10,000 and 11,000 ft-pounds. When energy dissipation forces range from 18 to 22 kips, optimal capture behavior is obtained with post yield strengths between 9,000 and 20,000 ft-lb. FIG. 74 shows the desired ratios between energy dissipation rates (head-on force) and lateral post yield strengths, i.e., plastic moments, over a wide range of terminal designs. Incorporating a design that falls within bounded region 300 of FIG. 74 will greatly improve the degree of energy dissipation associated with a tension-based terminal and greatly increase the number of vehicles striking the end of the system that are captured and brought to rest adjacent to the barrier end.

Figure 17:
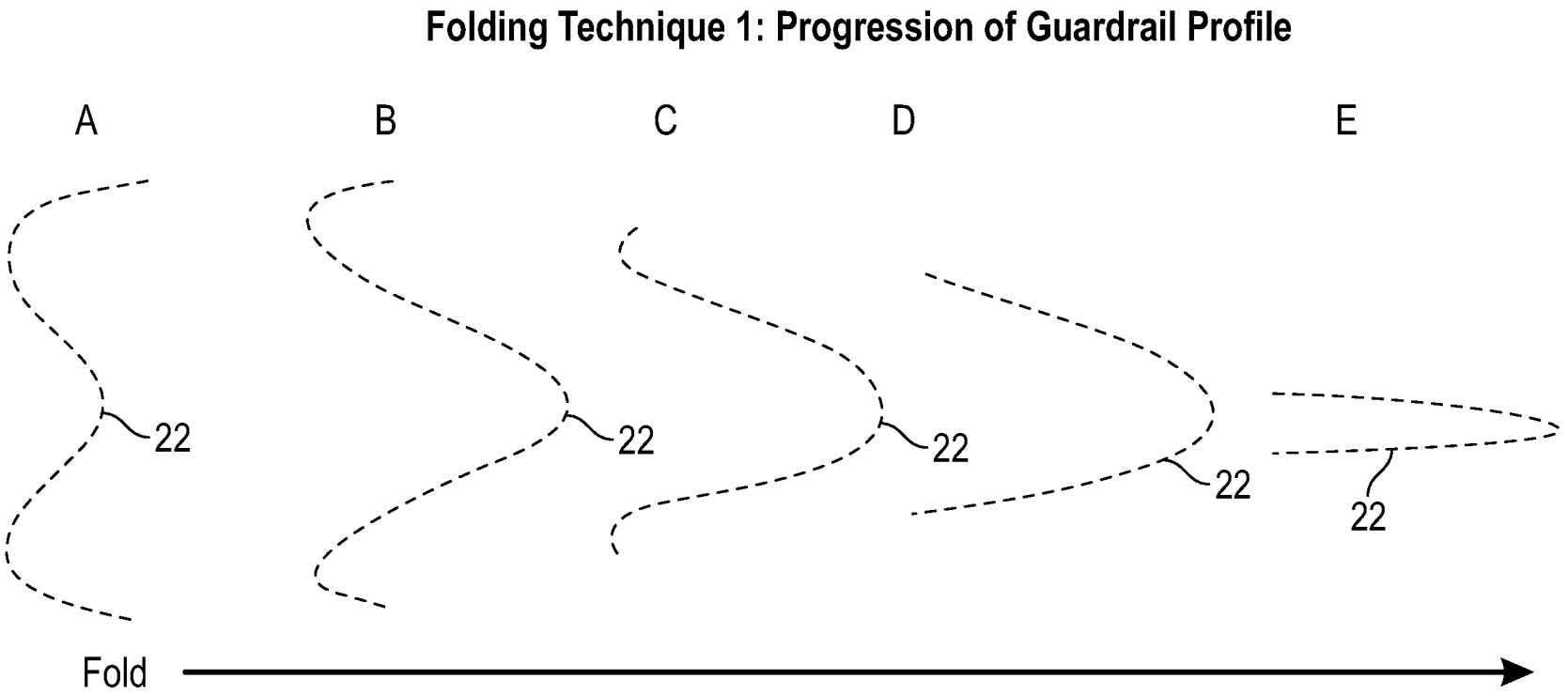
FIG. 17 shows a schematic view of folding of a W-beam according to an exemplary embodiment of the present disclosure.
Figure 18:
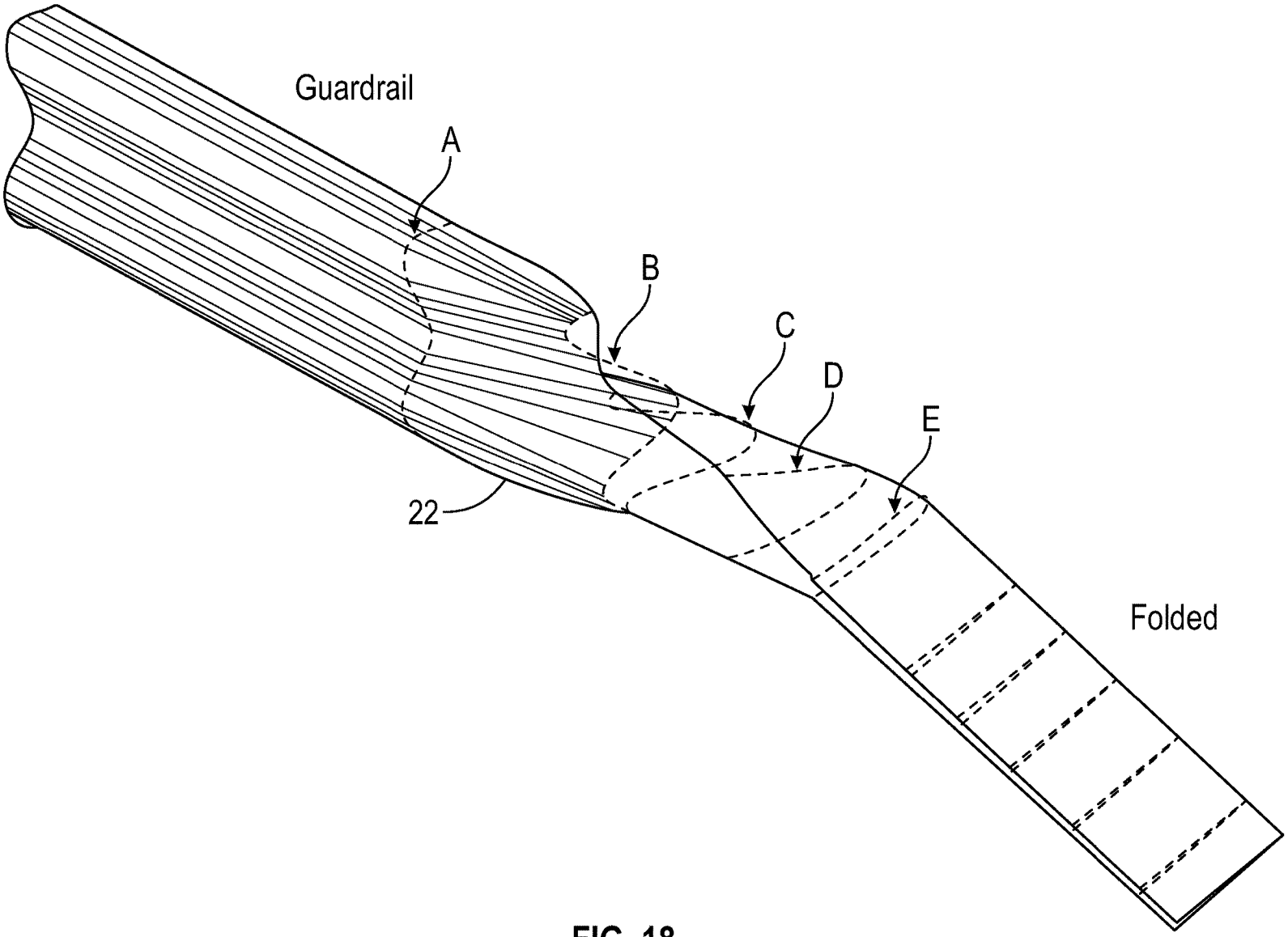
FIG. 18 shows a perspective view of a beam folded according to the embodiment of FIG. 17, with letters A-E showing a perspective view of the stages shown in FIG. 17.

Referring to FIGS. 17 and 18, a schematic view of guardrail or barrier 22 folding that occurs in embodiments of guardrail terminal to be described is shown. Broadly speaking, each letter in FIG. 17 corresponds to a location in FIG. 18, showing a progression of folding of guardrail beam 22 from a "W" shape to a folded, flattened shape.

Figure 19:
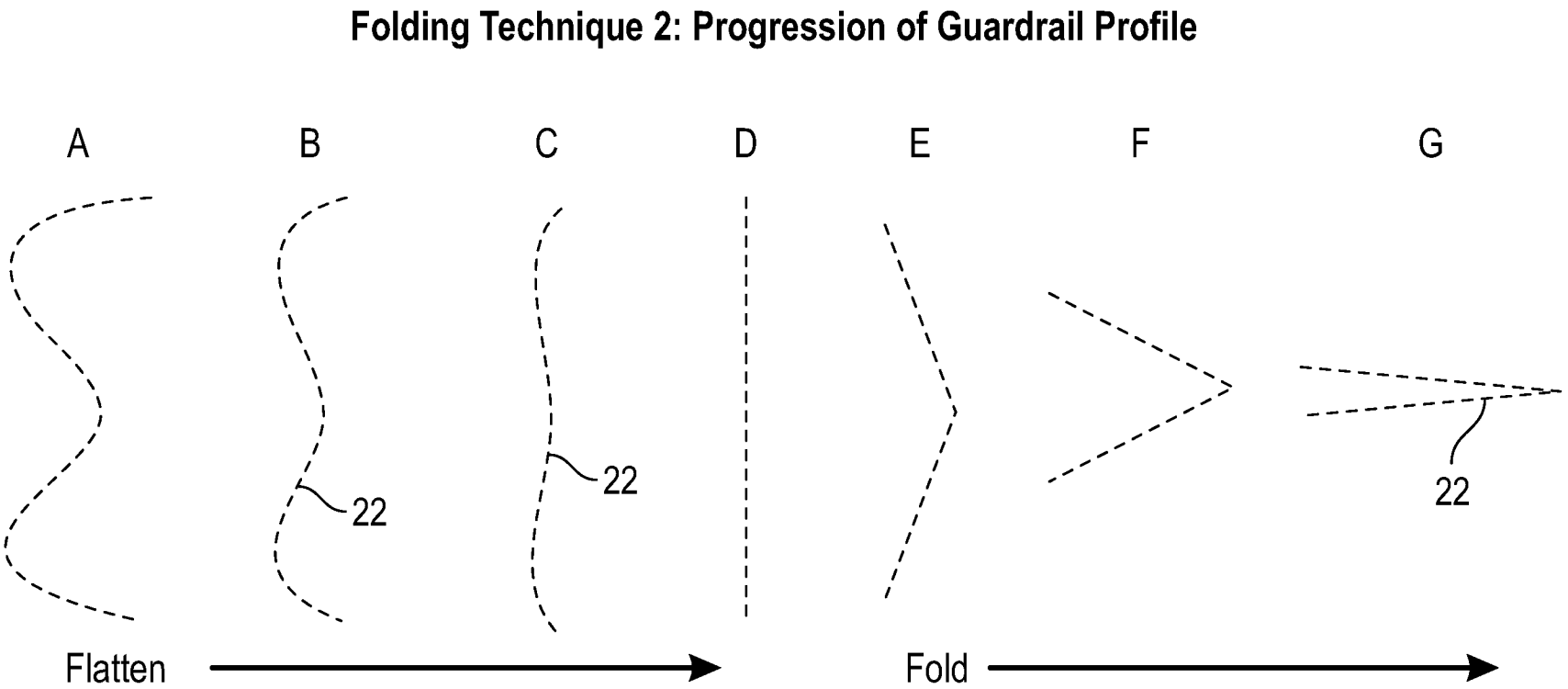
FIG. 19 shows a schematic view of folding of a W-beam according to another exemplary embodiment of the present disclosure.
Figure 20:
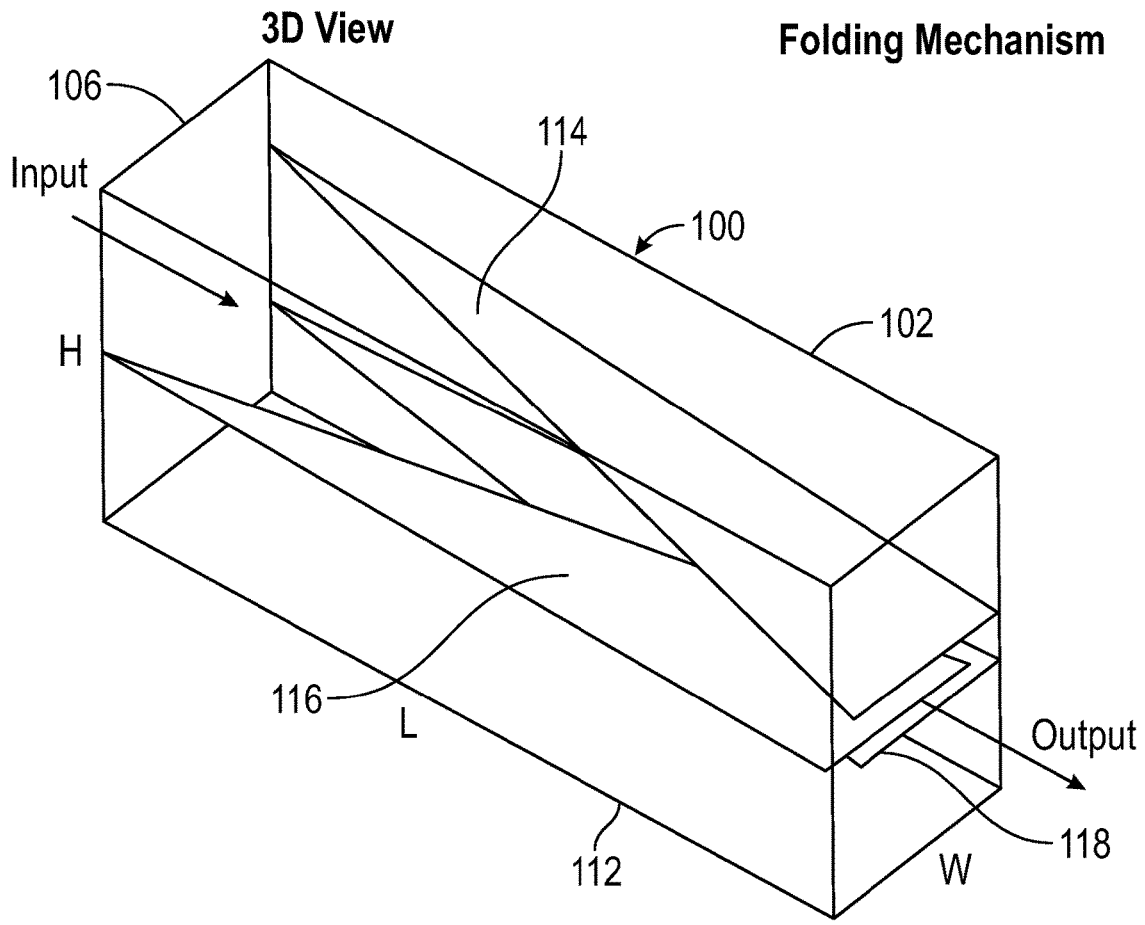
FIG. 20 shows a perspective view of a folding mechanism to obtain the folding configurations of FIGS. 17 and 18 in accordance with an exemplary embodiment of the present disclosure.
Figure 21:
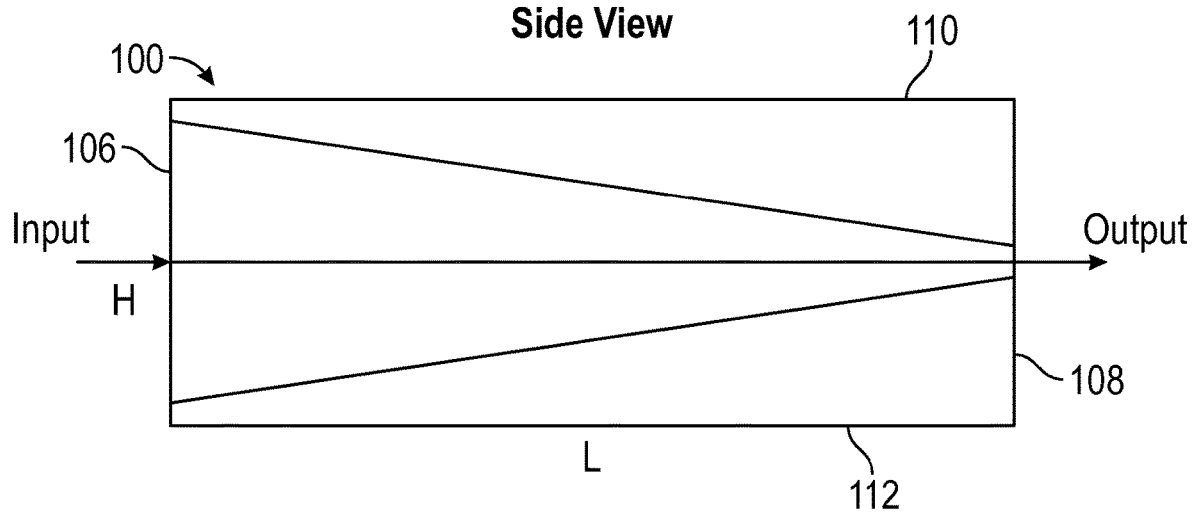
FIG. 21 shows a side or elevation view of the folding mechanism of FIG. 20.
Figure 22:
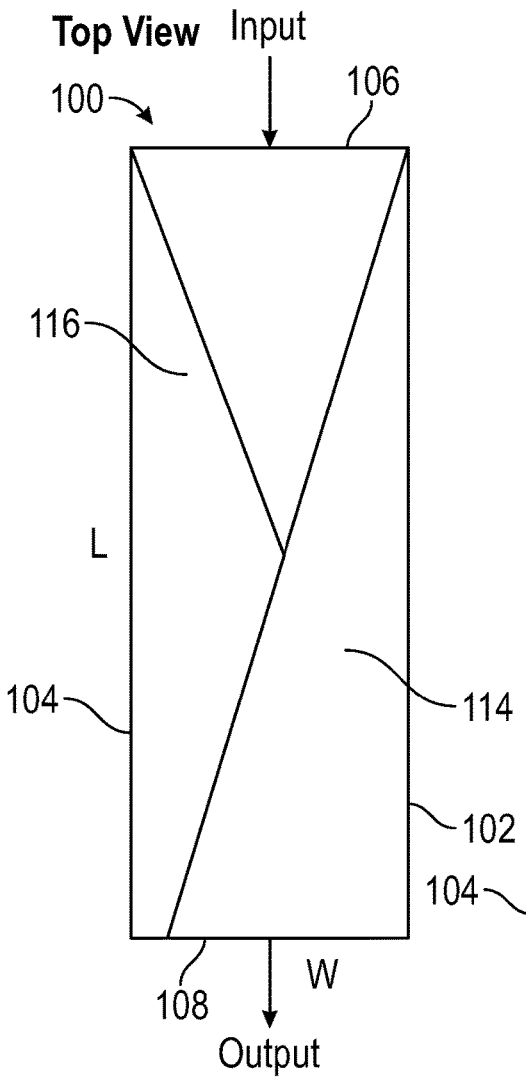
FIG. 22 shows a top or plan view of the folding mechanism of FIG. 20.
Figure 23:
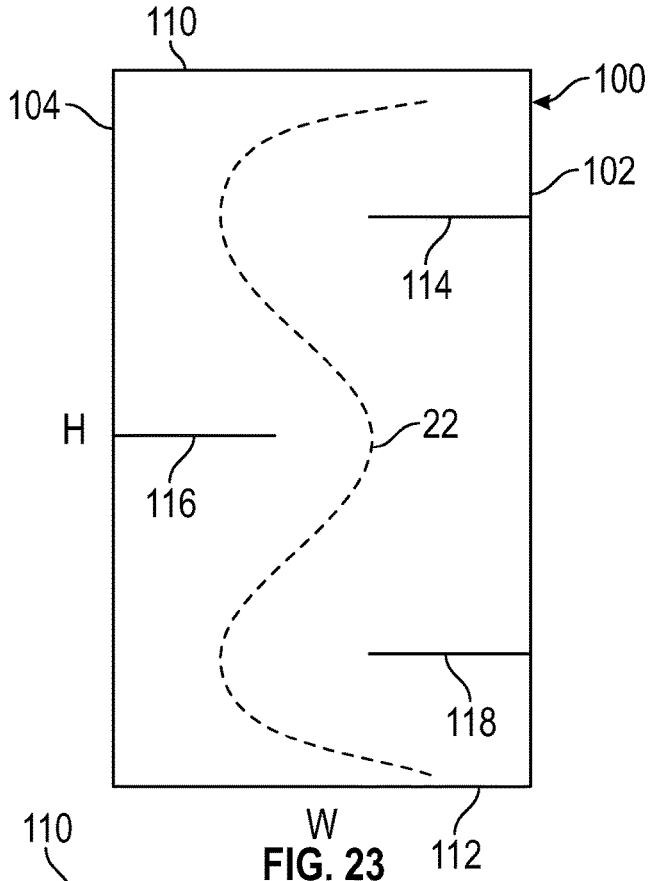
FIG. 23 shows a schematic cross-sectional view of a folded beam at location A of FIG. 17.
Figure 24:
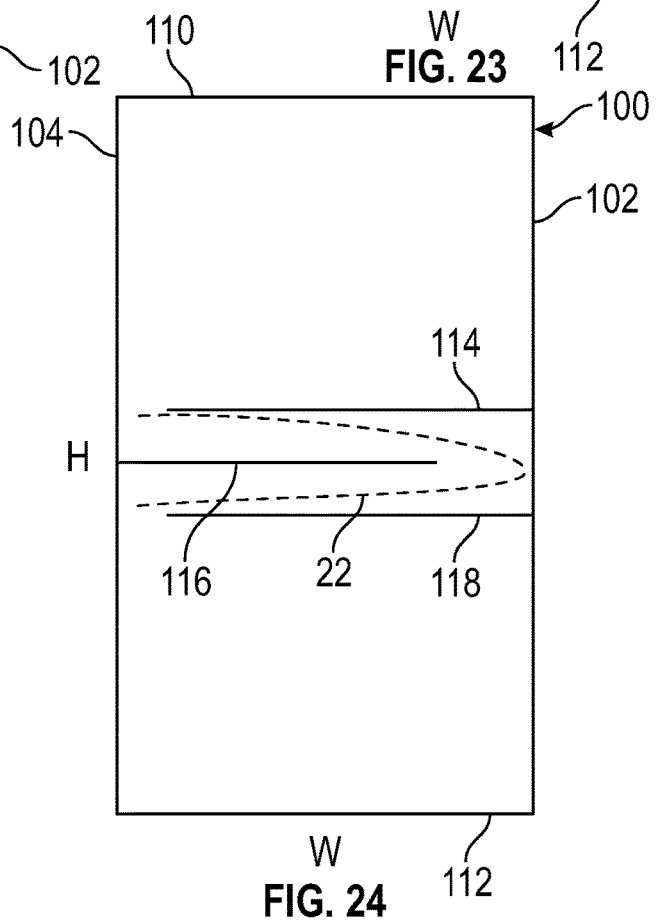
FIG. 24 shows a schematic cross-sectional view of a folded beam at location E of FIG. 17.
Figure 25:
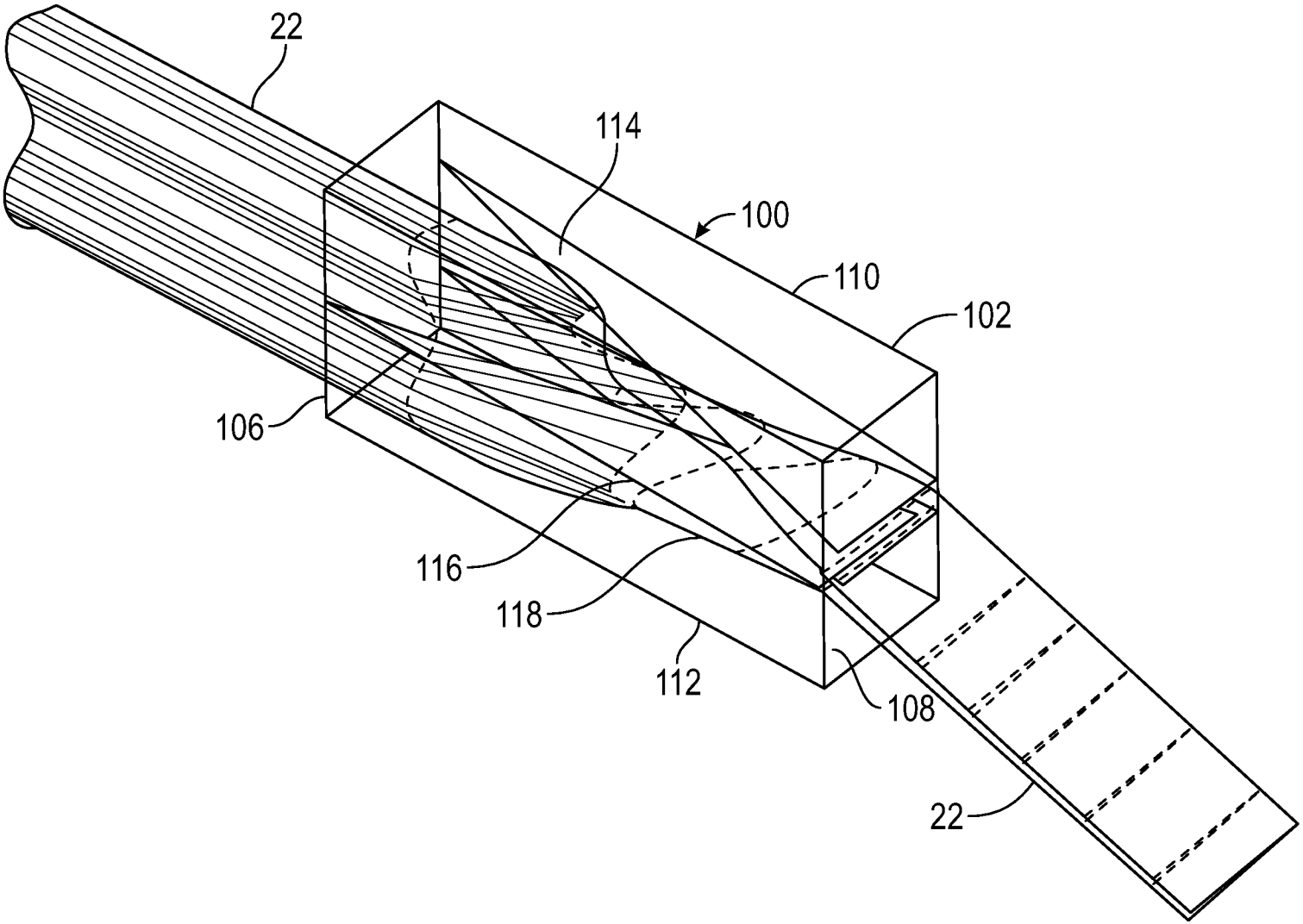
FIG. 25 shows a perspective view of the beam of FIG. 18 being folded by the folding mechanism of FIG. 20.

Referring to FIG. 19, an alternate progression of folding of guardrail beam 22 from a "W" shape to a folded, flattened shape is shown. One difference between embodiments of FIGS. 17 and 19 is that guardrail beam 22 is flattened into a nearly straight beam in FIG. 19 and then folded in half, while guardrail beam 22 in FIG. 17 is continuously folded into a "U" shape from a "W" shape and then folded by squeezing into a relatively narrow "U" shape while guardrail beam 22 in FIG. 19 is folded from a flattened shape into a relatively narrow "V" shape.

FIGS. 20-25 show schematic views of a guardrail terminal 100 in accordance with an exemplary embodiment of the present disclosure that folds guardrail beam 22 as shown in FIGS. 17 and 18. Schematic guardrail terminal 100 includes a top side 110, a bottom side 112, a first side 102 and a second side 104 extending from top side 110 to bottom side 112, a first, downstream end 106, and a second, upstream end 108. Attached to first side 102 is an upper deflector plate 114 and a lower deflector plate 118. Attached to second side 104 is a center deflector 116. Center deflector 116 can extend horizontally from first end 106 to second end 108. Upper deflector 114 and lower deflector 118 can be positioned within ⅓ of the distance from the top of guardrail terminal 100 and within ⅓ of the distance from the bottom of guardrail terminal 100 at first, downstream end 106, narrowing to a gap between upper deflector 114 and lower deflector 118 of approximately 1-3 inches at second, upstream end 108.

Figure 26:
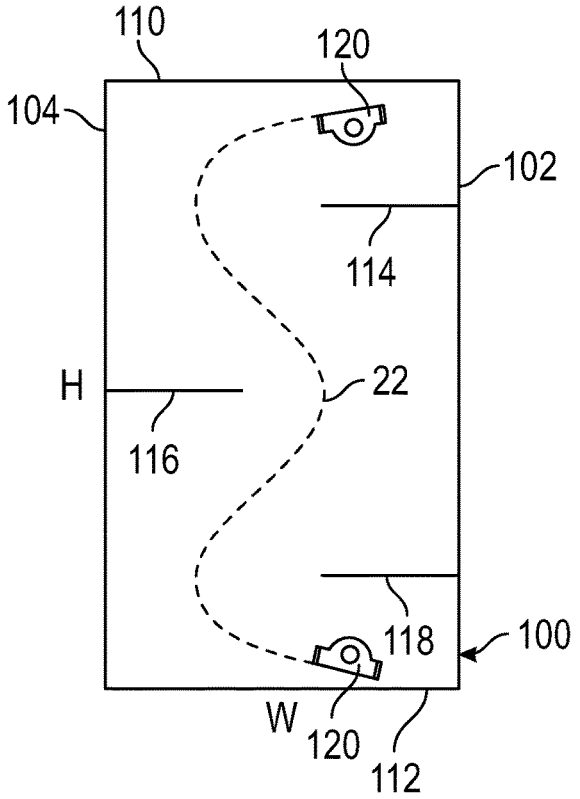
FIG. 26 shows the view of FIG. 23 with cable attachments.
Figure 27:
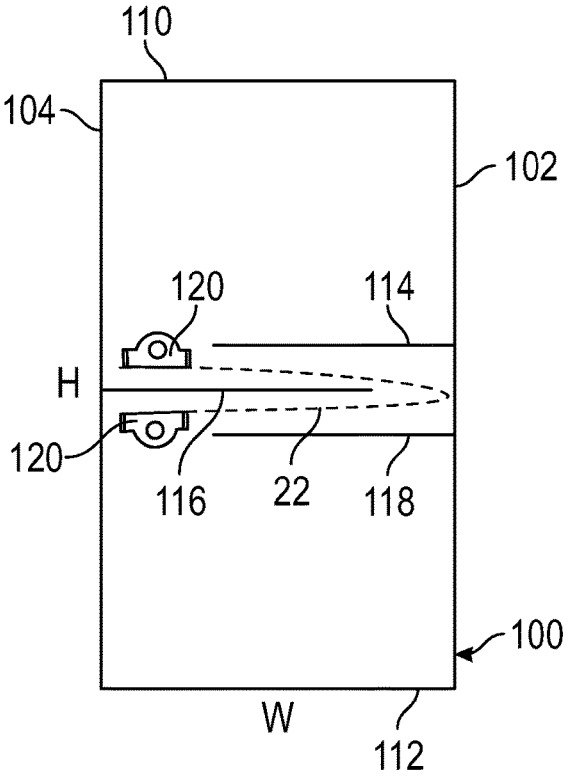
FIG. 27 shows the view of FIG. 24 with cable attachments.
Figure 28:
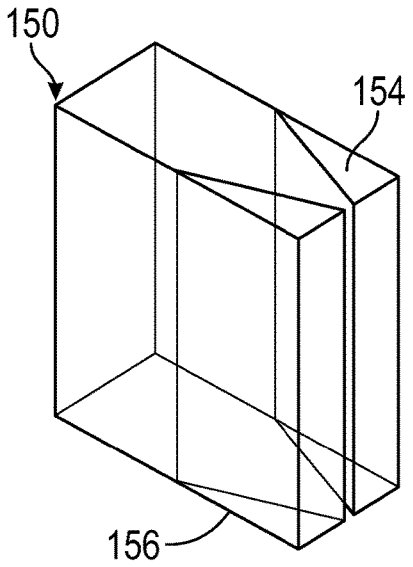
FIG. 28 shows a beam flattener in accordance with an exemplary embodiment of the present disclosure.
Figure 29:
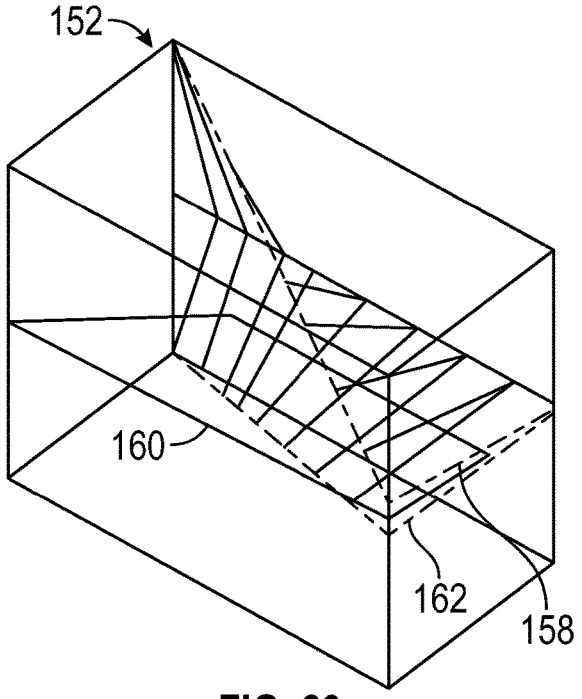
FIG. 29 shows a folding mechanism in accordance with yet another exemplary embodiment of the present disclosure.

While a single cable 16 can be attached to guardrail beam 22, FIGS. 26 and 27 show a configuration where two cables 16 are attached to guardrail beam 22. Two cables 16 can help keep an upper and a lower portion of guardrail beam 22 together during bending and exit from schematic guardrail terminal 100. Each attachment is by a welded cable bracket 120, to which a cable 16 is clamped, welded, or otherwise attached.

Figure 33:
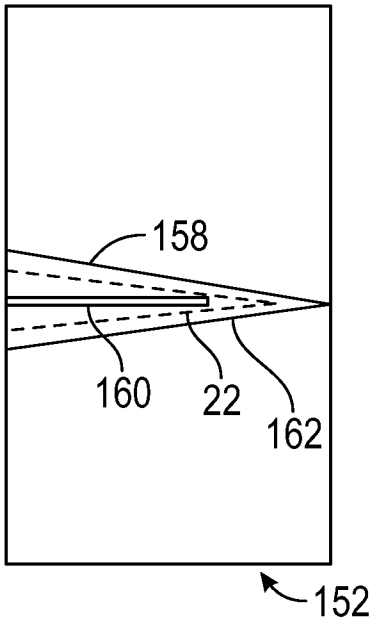
FIG. 33 shows a beam being folded by the folding mechanism of FIG. 29 at a fourth location in the folding mechanism.
Figure 32:
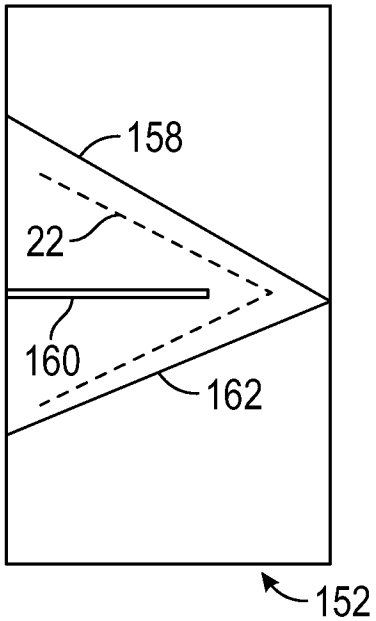
FIG. 32 shows a beam being folded by the folding mechanism of FIG. 29 at a third location in the folding mechanism.
Figure 31:
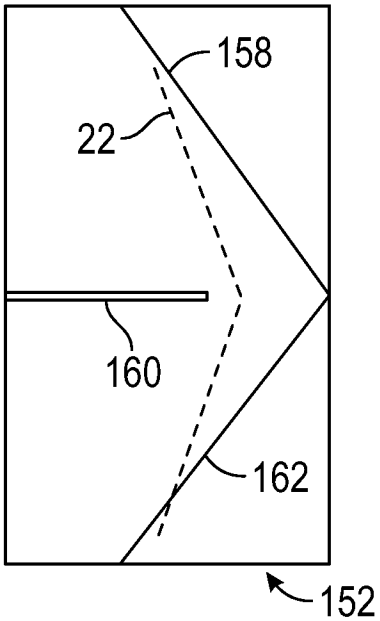
FIG. 31 shows a beam being folded by the folding mechanism of FIG. 29 at a second location in the folding mechanism.
Figure 30:
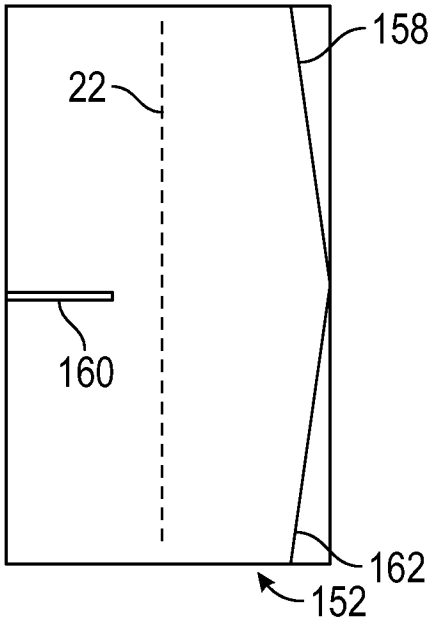
FIG. 30 shows a beam being folded by the folding mechanism of FIG. 29 at a first location in the folding mechanism.
Figure 34:
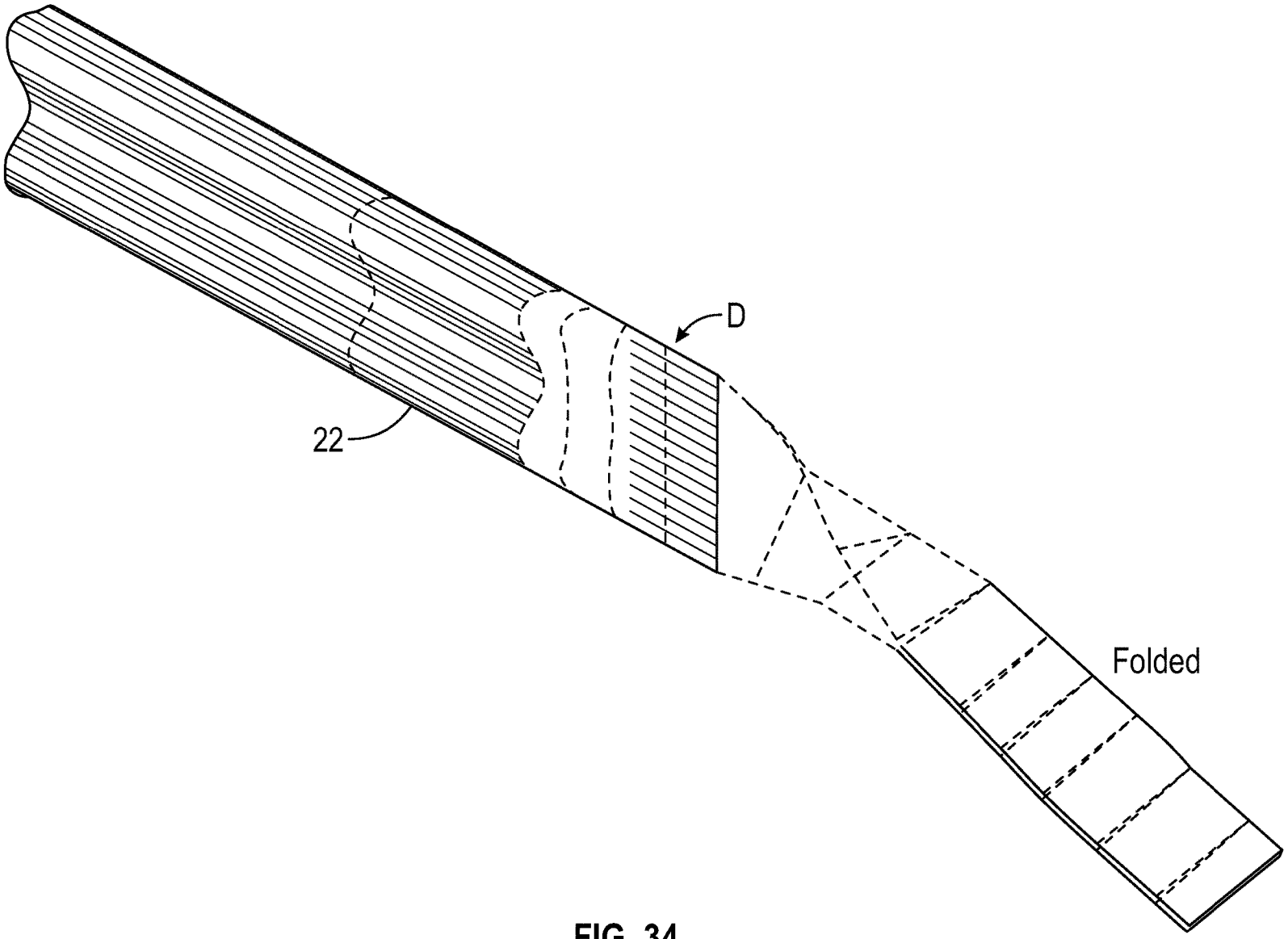
FIG. 34 shows a beam at various stages of being folded by the folding mechanism of FIG. 29, with letters corresponding to the locations shown in FIGS. 30-33.
Figure 35:
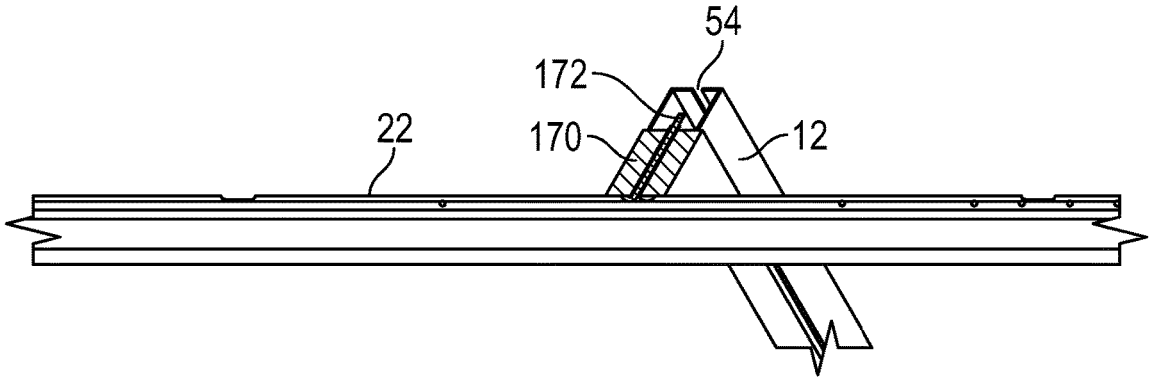
FIG. 35 shows a perspective view of a guardrail post attached to the guardrail in accordance with an exemplary embodiment of the present disclosure.
Figure 36:
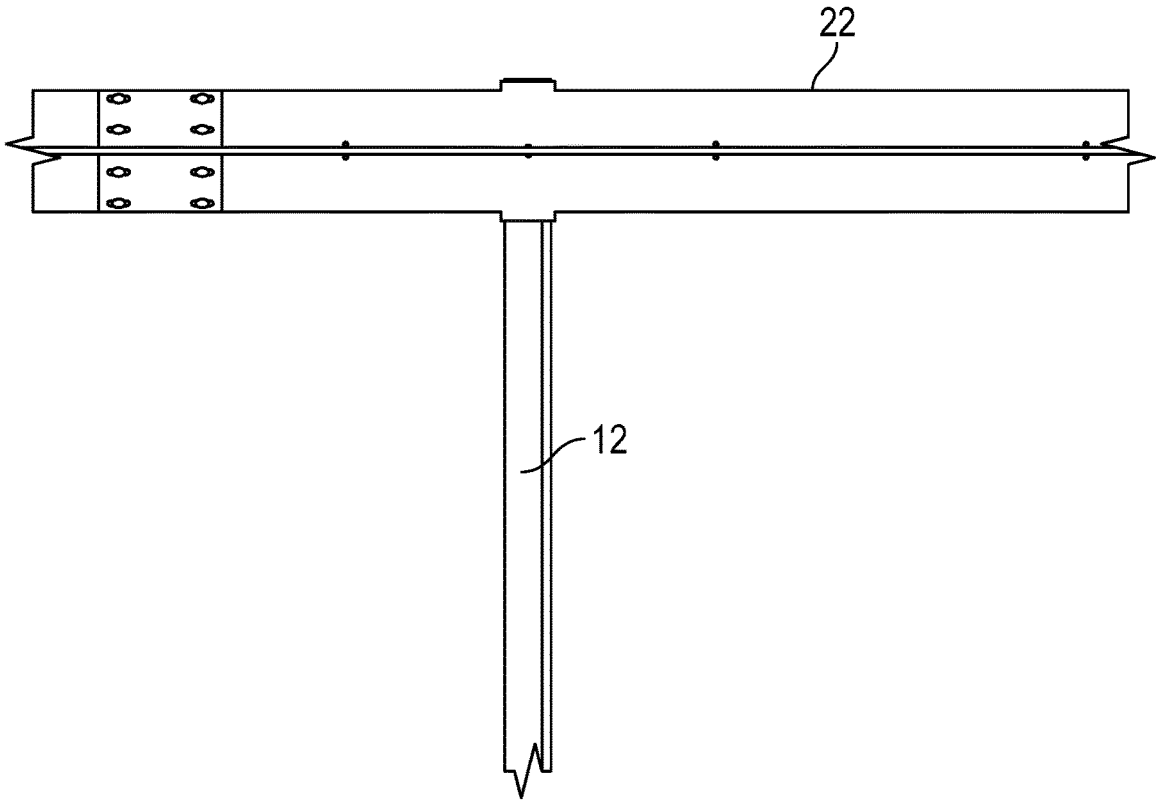
FIG. 36 shows an elevation view of the guardrail post and guardrail of FIG. 35.
Figure 41:
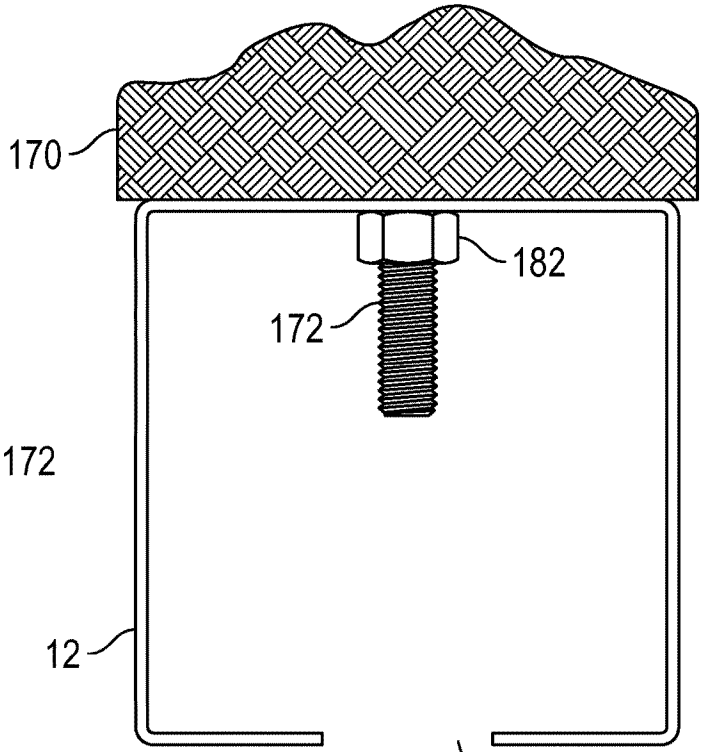
FIG. 41 shows an enlarged view of FIG. 40.
Figure 40:
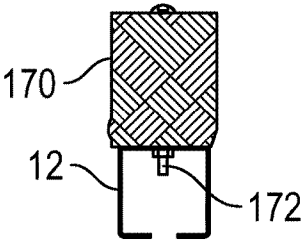
FIG. 40 shows a top view of the guardrail post of FIG. 37.
Figure 39:
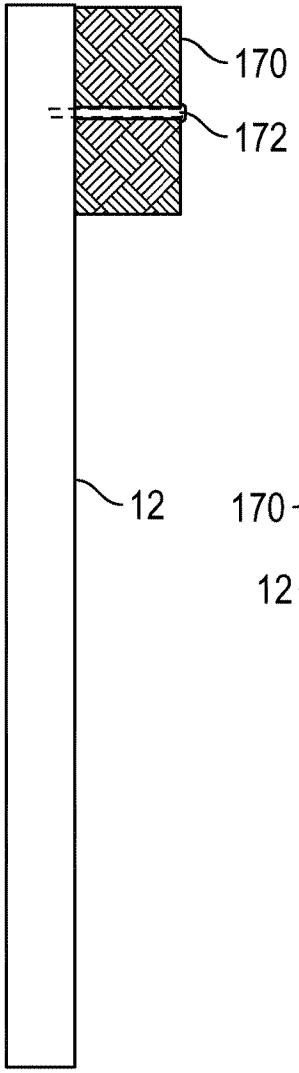
FIG. 39 shows a side elevation view of the guardrail post of FIG. 37.
Figure 38:
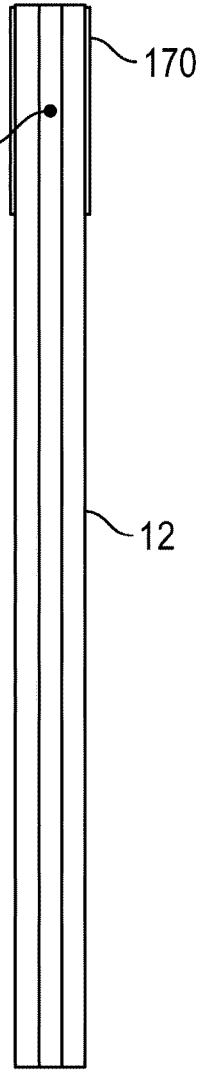
FIG. 38 shows an elevation view of the guardrail post of FIG. 37.
Figure 37:
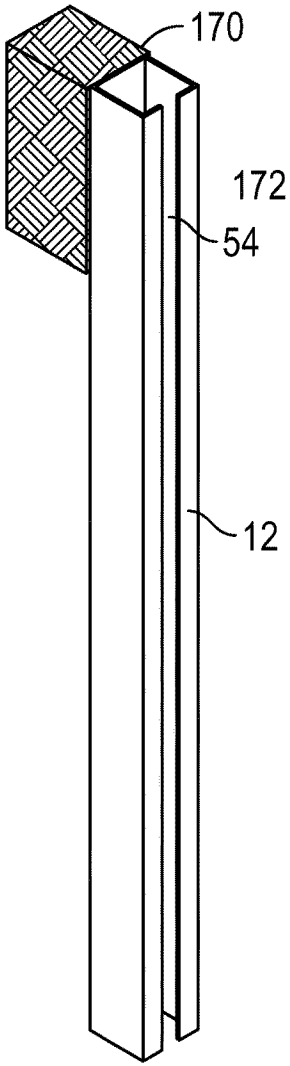
FIG. 37 shows a perspective view of another guardrail post in accordance with an exemplary embodiment of the present disclosure.

FIGS. 28-33 show schematic views of a flattener 150 and a folder 152 in accordance with an exemplary embodiment of the present disclosure that flattens and folds guardrail beam 22 as shown in FIG. 19. Flattener 150 includes two flattening deflectors 154 and 156 that flatten guardrail beam 22 vertically as shown in FIG. 30. Folder 152 includes an upper deflector plate 158, a lower deflector plate 162, and a horizontally extending center deflector plate 160. As with upper deflector 114 and lower deflector 118, upper deflector plate 158 slopes downwardly along a length of folder 152, and lower deflector plate 162 slopes upwardly along the length of folder 152, so that a narrow gap remains between upper deflector plate 158 and lower deflector plate 162 to leave guardrail beam 22 folded as shown in FIG. 33. Guardrail beam 22 shown in FIG. 34 is flattened and folded by flattener 150 and folder 152. Guardrail beam 22 is flattened at location D, and folded from location D toward the right in FIG. 34.

FIGS. 35-41 show views of guardrail beam 22 attached to guardrail anchor posts 12 by way of a post interface 170 and a fastener 172. Fasteners 172 can shear with a side force to release guardrail beam 22 from anchor posts 12. The force of release helps decelerate an impacting vehicle. Nut 182 secures bolt 172 to guardrail anchor post 12.

Figure 42:
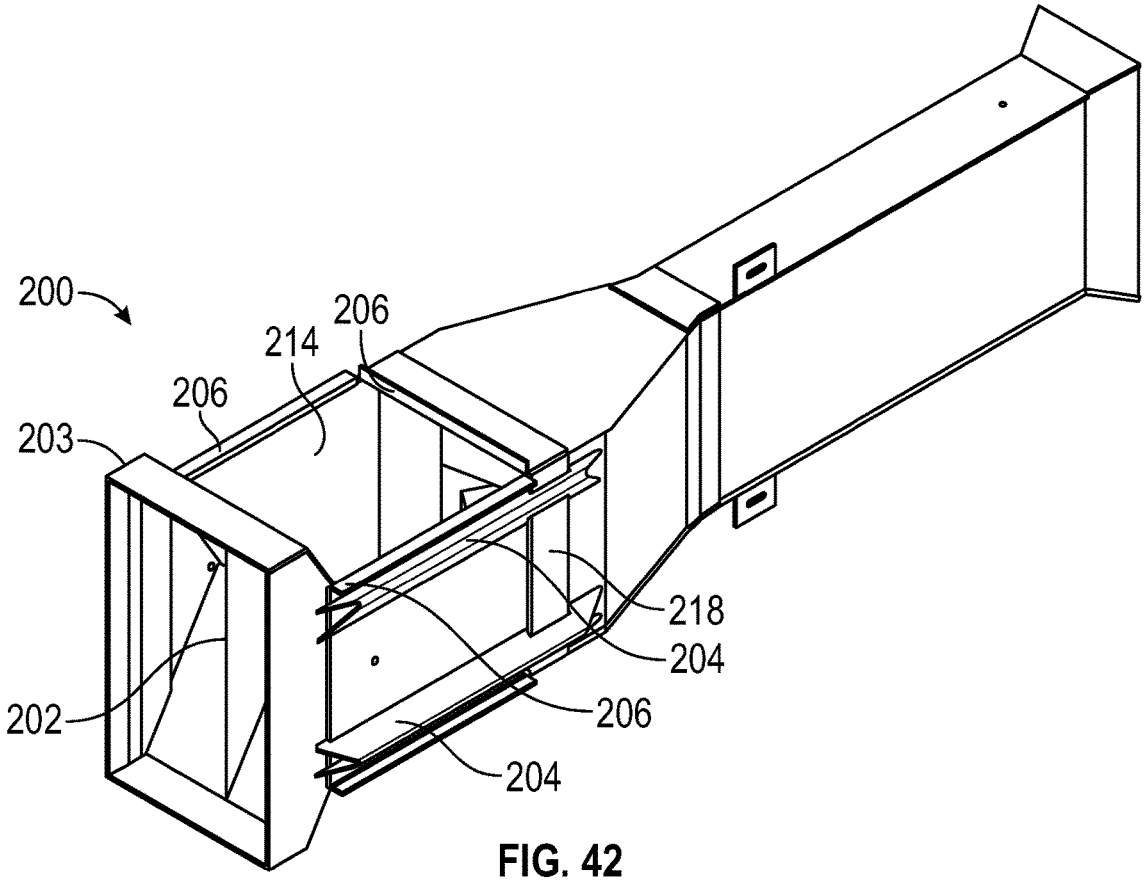
FIG. 42 shows a perspective view of a guardrail terminal in accordance with an exemplary embodiment of the present disclosure.
Figure 43:
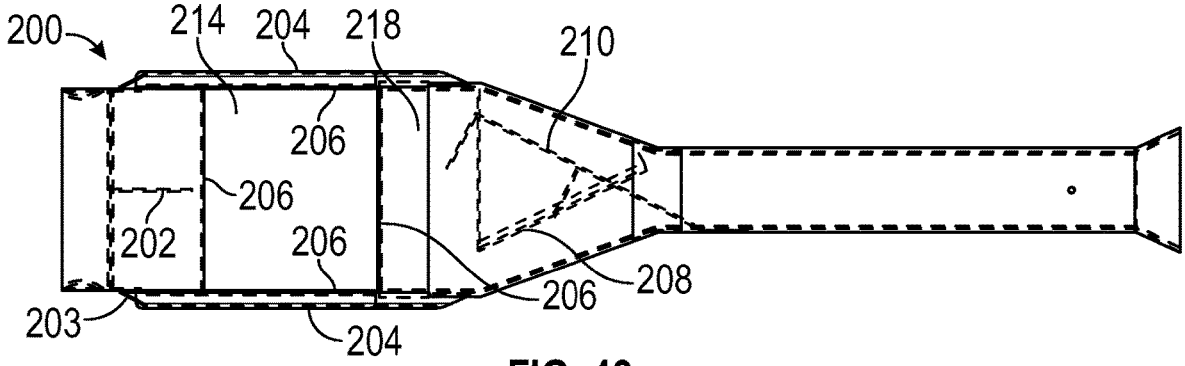
FIG. 43 shows a top or plan view of the guardrail terminal of FIG. 42.
Figure 44:
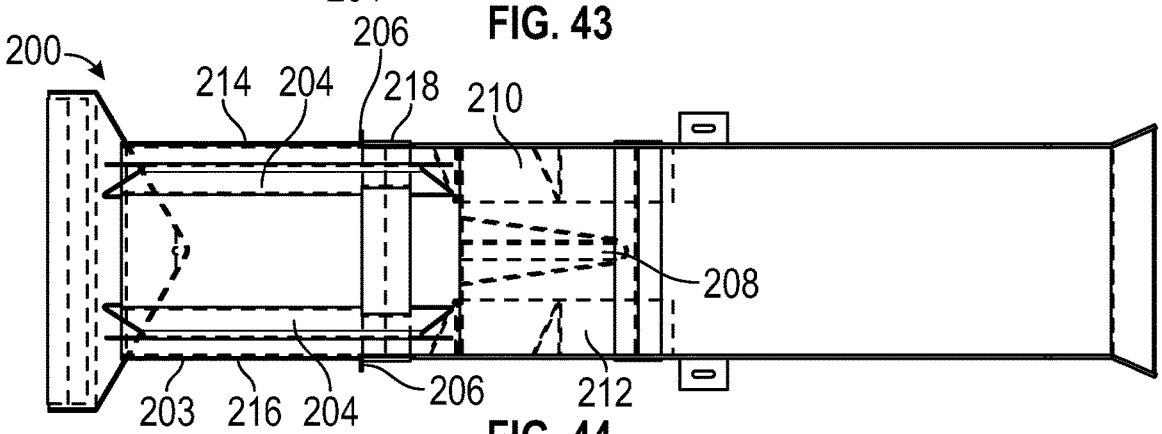
FIG. 44 shows a side or elevation view of the guardrail terminal of FIG. 42.

FIGS. 42-44 show views of a guardrail terminal 200 in accordance with an exemplary embodiment of the present disclosure. Guardrail terminal 200 includes an impact head gusset 202 positioned within impact head 203. Gusset 202 protrudes from impact head 203, and may protrude from a cavity formed at a most upstream end of impact head 203. Impact head gusset 202 allows reduced weight for impact head 203 while providing sufficient strength to sustain an impact during flattening of guardrail beam 22. A periphery of impact head 203 protrude outwardly from impact head 203, and the protruding edges, particularly the vertically extending edges, form a kind of teeth that engage an impacting vehicle to provide improved control of the vehicle as guardrail terminal 200 slides along guardrail beam 22. Guardrail terminal 200 also includes side gussets 204 positioned along a top and bottom side of guardrail terminal. Around each of a top opening 214 and a bottom opening 216, which is where flattened guardrail beam 22 exits guardrail terminal 200, a lip is folded away from each respective opening 214 and 216 to strengthen each opening during an impact. Further a support band 218 can extend about an entire periphery of guardrail terminal 200 to further strengthen guardrail terminal 200.

Figure 45A:
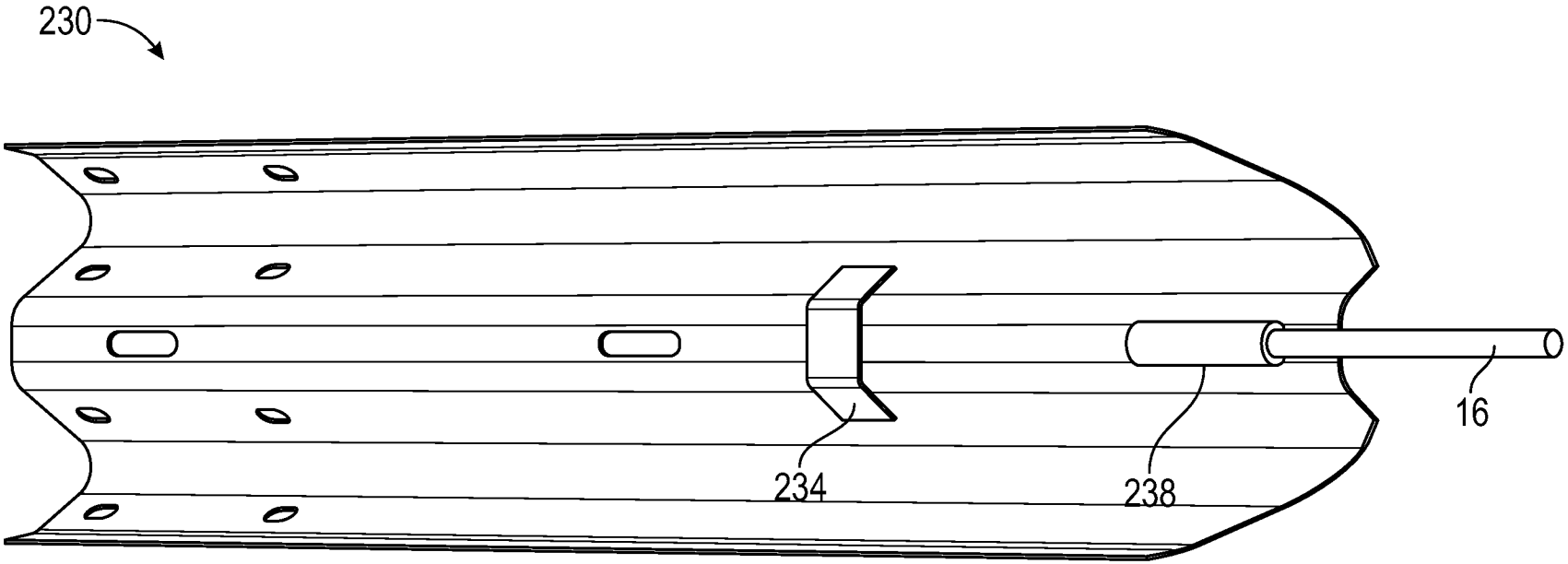
FIG. 45A shows a view of a guardrail in accordance with an exemplary embodiment of the present disclosure.
Figure 45B:
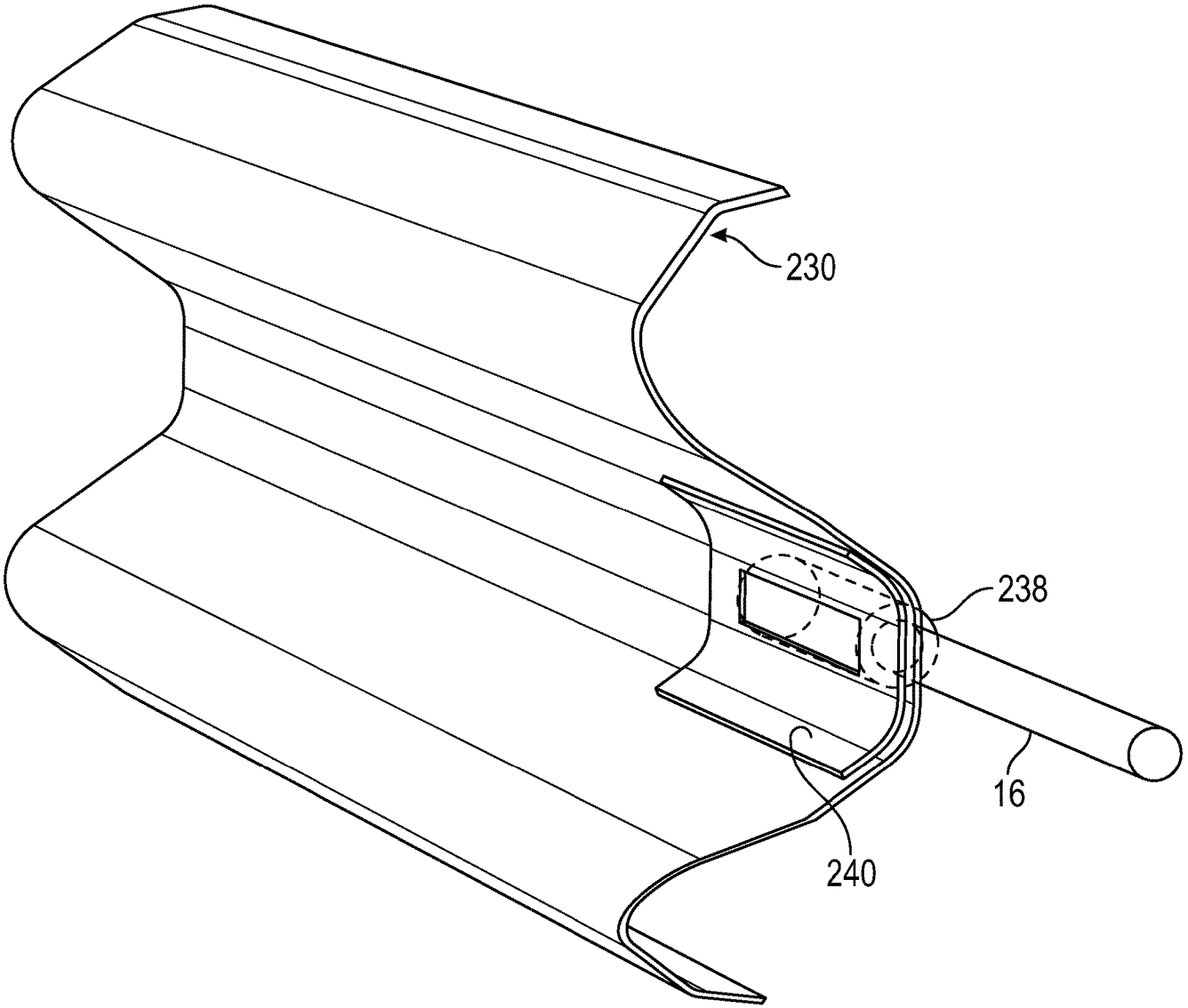
FIG. 45B shows a perspective view of the guardrail of FIG. 45A on an opposite side of the guardrail from FIG. 45A.
Figure 45C:
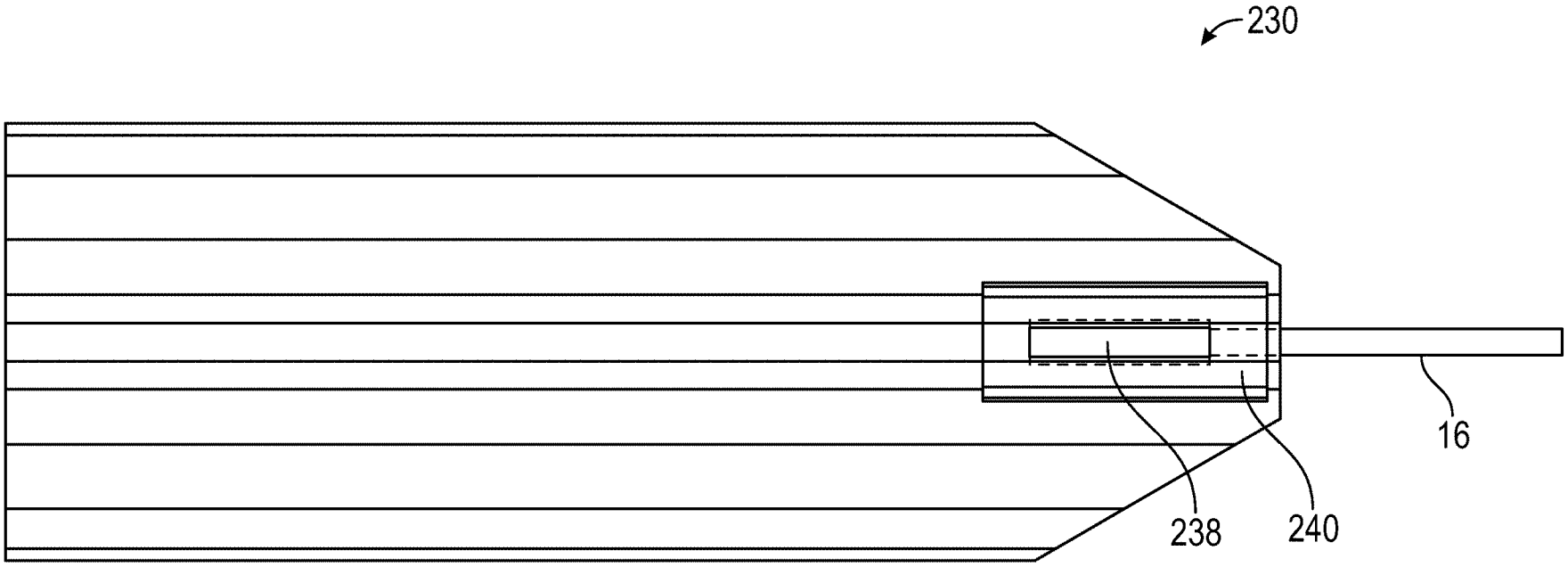
FIG. 45C shows an elevation view of the guardrail of FIG. 45B on a same side of the guardrail as FIG. 45B.
Figure 46:
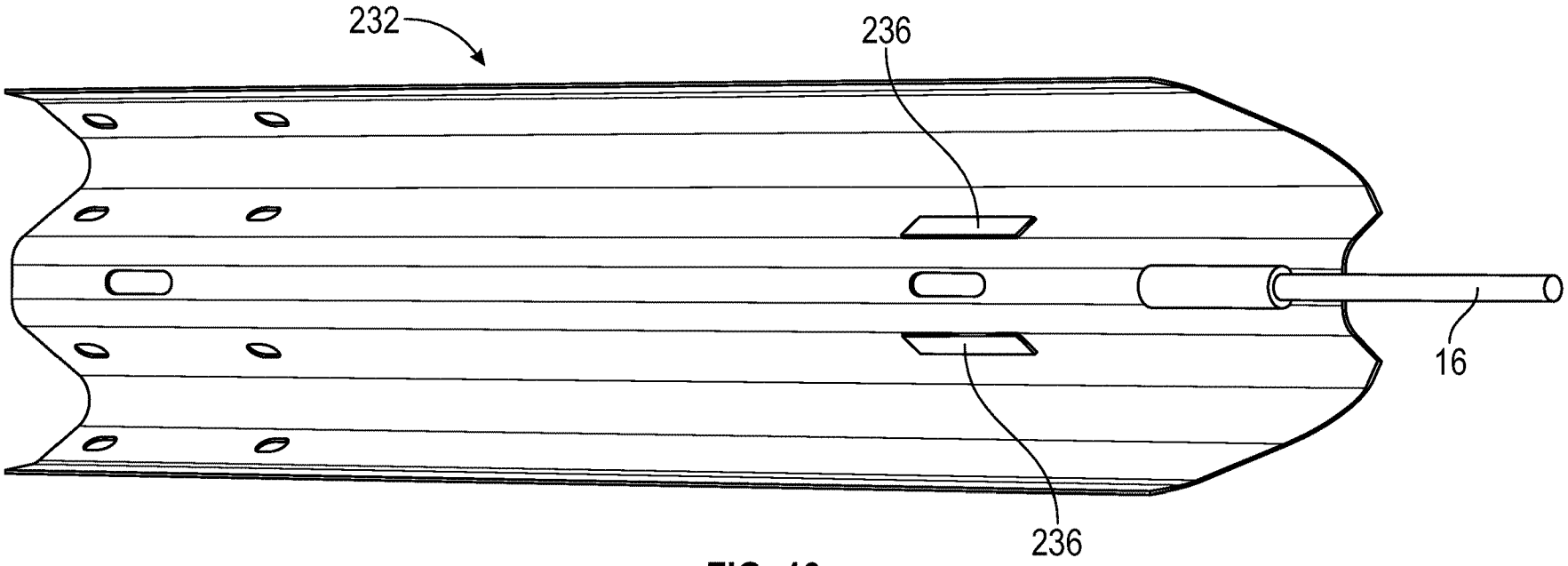
FIG. 46 shows a view of another guardrail in accordance with an exemplary embodiment of the present disclosure.
Figure 48:
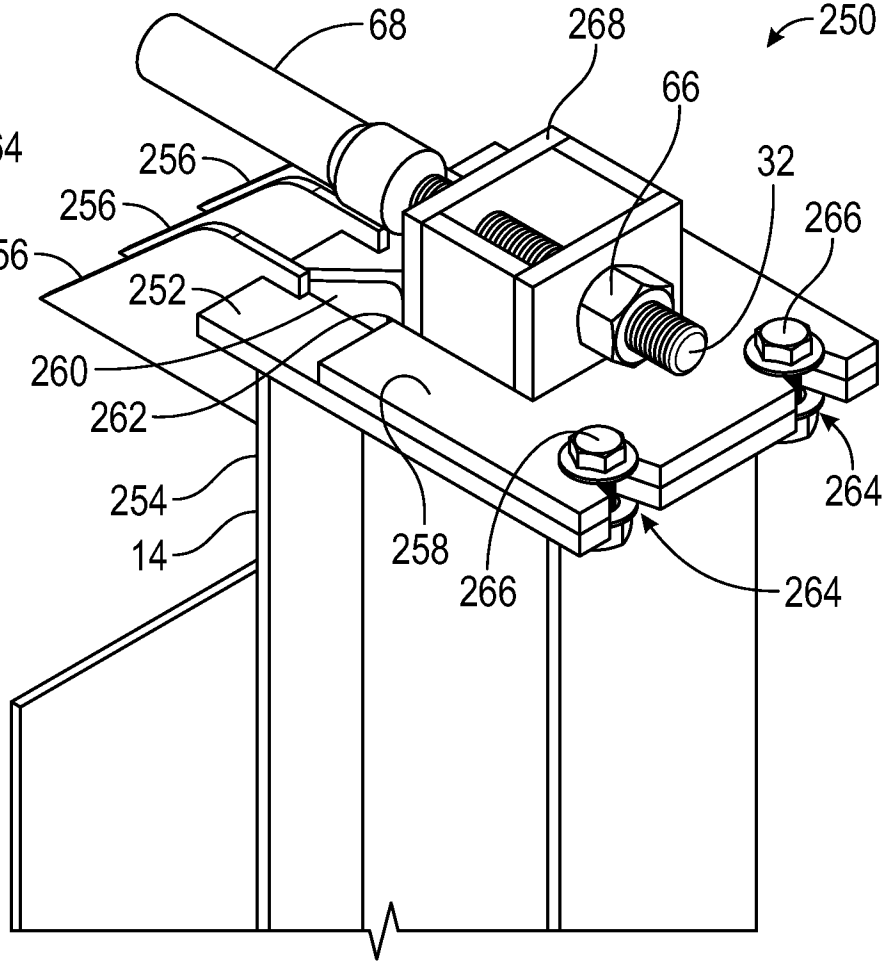
FIG. 48 shows another perspective view of the release plate and anchor post of FIG. 47.
Figure 47:
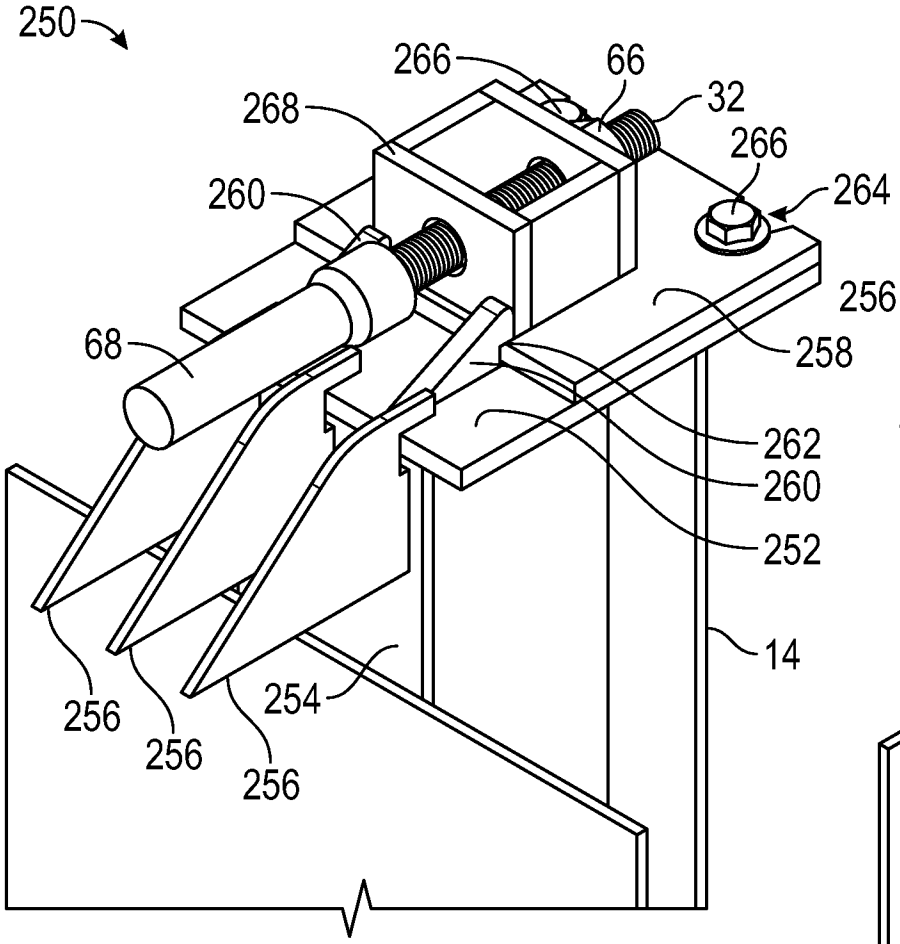
FIG. 47 shows a perspective view of a release plate positioned on an anchor post in accordance with an exemplary embodiment of the present disclosure.
Figure 49:
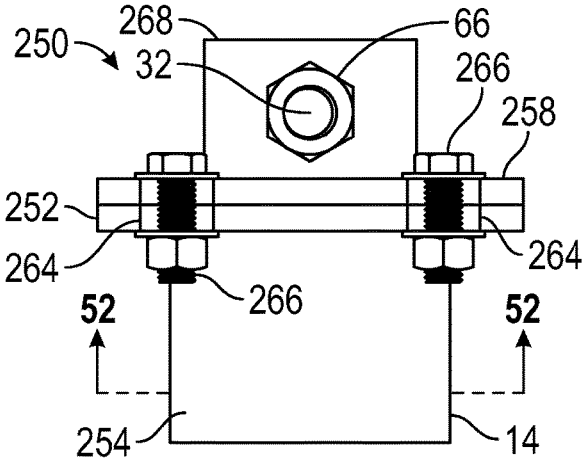
FIG. 49 shows an elevation view of the release plate and anchor post of FIG. 47.
Figure 50:
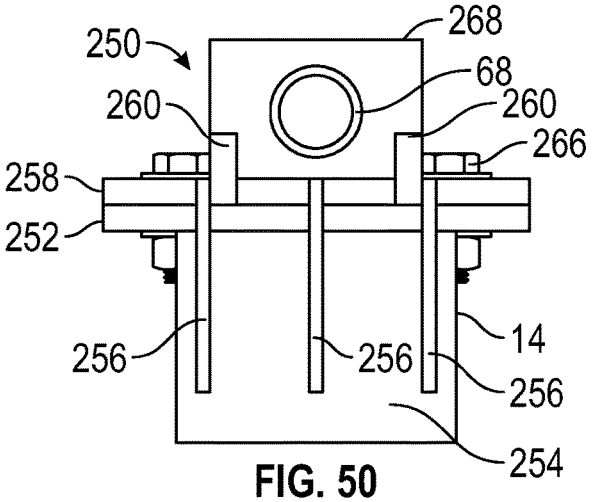
FIG. 50 shows another elevation view of the release plate and anchor post of FIG. 47.
Figure 51:
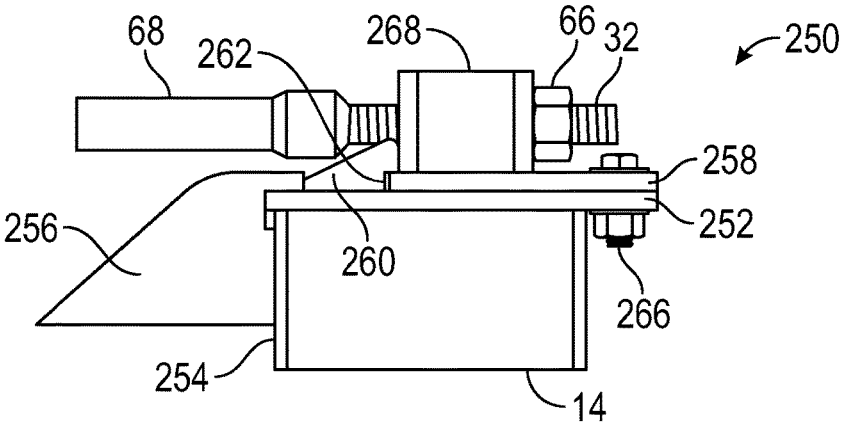
FIG. 51 shows a further elevation view of the release plate and anchor post of FIG. 47.
Figure 52:
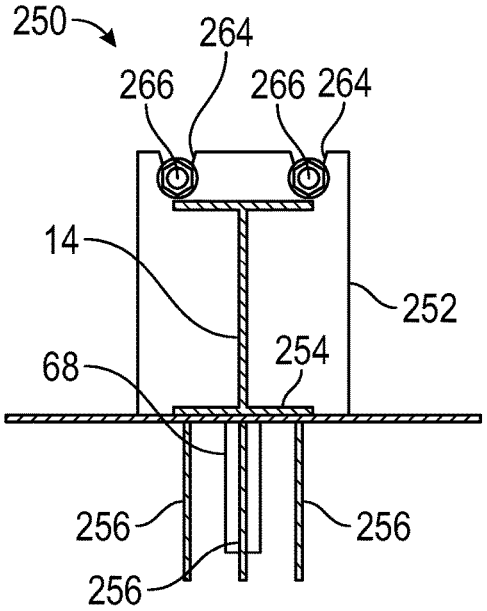
FIG. 52 shows a section view of the release plate and anchor post of FIG. 49 along the lines 52-52.
Figure 53:
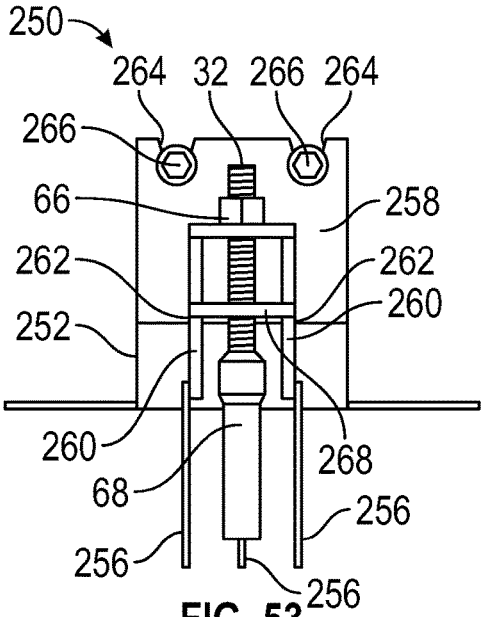
FIG. 53 shows a plan view of the release plate and anchor post of FIG. 47.
Figure 54:
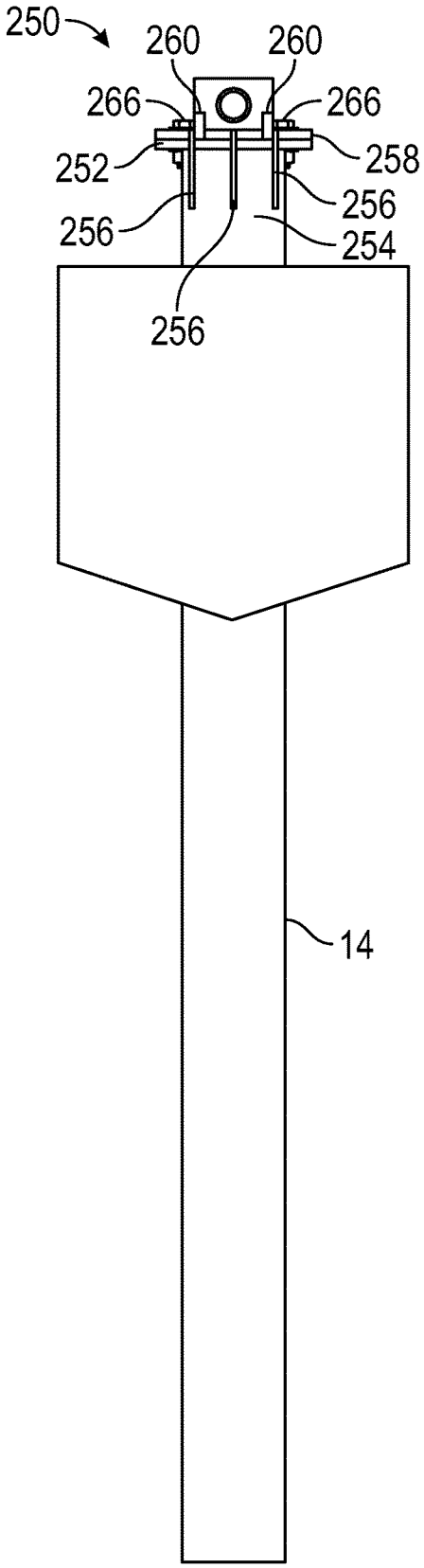
FIG. 54 shows a still further elevation view of the release plate and anchor post of FIG. 47.
Figure 55:
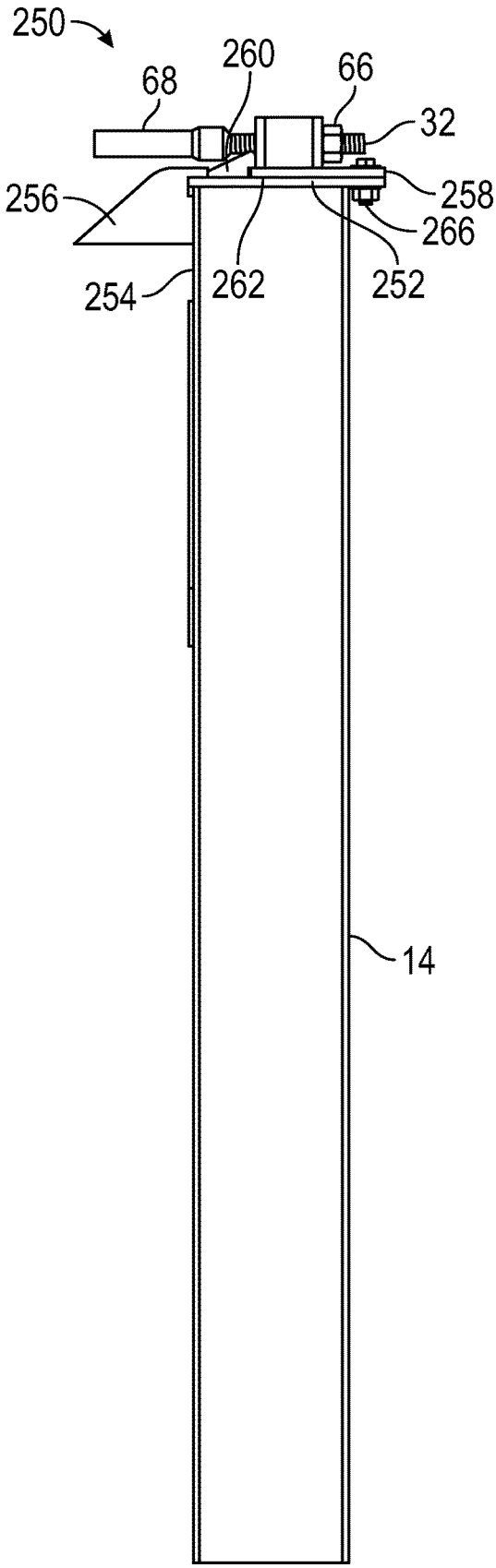
FIG. 55 shows a still further yet elevation view of the release plate and anchor post of FIG. 47.

FIGS. 45A and 46 show guardrail beams 230 and 232 with two different types of strengthening gusset. Guardrail beam 230 includes a strengthening gusset 234 that extends vertically across a center of guardrail beam 230. Guardrail beam 232 includes longitudinally extending strengthening gussets 236. Strengthening gussets 234 and 236 are attached or welded to respective guardrail beam 230 and guardrail beam 232 to help keep guardrail beam 230 from splitting or otherwise coming apart during an impact.

Guardrail beam 230 also includes a cable button 238 to which cable 16 is secured, such as by swaging or clamping. Cable button 238 is then secured to guardrail beam 230 such as by welding. Guardrail beam 230 also includes a reinforcement plate 240 welded to guardrail beam 230 at a location that is on an opposite side of guardrail beam 230 from the location where cable button 238 is welded. As described elsewhere herein, strengthening gusset or reinforcement plate 236 strengthens the connection of cable 16 to guardrail beam 230, but it also stops Mode II fractures that begin at a leading edge of the guardrail. Reinforcement plate 240 is installed over the valley of the guardrail on the back side from cable button 238, between the location where swaged button 238 is attached and a hole for the second post.

FIGS. 47-55 show various views of a boot jack interface assembly 250 that connects cable 16 to cable anchor post 14. Boot jack interface assembly 250 is positioned on an end plate 252 and a side flange 254 of cable anchor post 14. Boot jack interface assembly 250 includes three deflector plates 256 welded to side flange 254. Deflector plates 256 extend over a top of end plate 252. Deflector plates 256 serve to guide guardrail terminal 18 in a reverse impact, reducing the likelihood of that guardrail terminal 18 will bind with cable anchor post 14.

Boot jack interface assembly 250 also includes a pair of vertically extending fingers 260 that include a small notch 262 under which is positioned a release plate 258. Each of end plate 252 and release plate 258 include matching, overlapping slots 264. After release plate 258 is inserted into notches 262, fasteners 266 secure release plate 258 to end plate 252. During a reverse impact on guardrail 22, when a vehicle collides with guardrail terminal 18, guardrail terminal 18 can release from guardrail beam 22. Guardrail terminal 18 can then fall to the ground on an upstream side. However, guardrail terminal 18 can then undesirably impact cable anchor 14 and remain constrained by cable 16. Instead, guardrail terminal 18 slides along deflector plates 256 until guardrail terminal 18 impacts a fastener bracket 268 welded to release plate 258. The force of impact from guardrail terminal 18 forces release plate 258 out from under notches 262 and fasteners 266 from slots 264 formed in end plate 252, at which point release plate 258 no longer engages with cable anchor post 14. It is also possible for the cable 16 forces to bend the swaged connection 68 upward, creating a large tensile stress that results in fracture of the threaded rod and the controlled release of the boot jack interface assembly 250 from the guardrail terminal 200.

Fingers 260 also provide a useful function in a forward impact. Since fingers 260 are welded to release plate 258 along their length, fingers 260 are resistant to shearing due to force applied by cable 16 on fastener bracket 268 that is then directed into fingers 260. Accordingly, fingers 260 increase the strength of release plate 258 in resisting release of cable 16 from cable anchor post 14 during a forward impact on an associated impact head.

Figure 68:
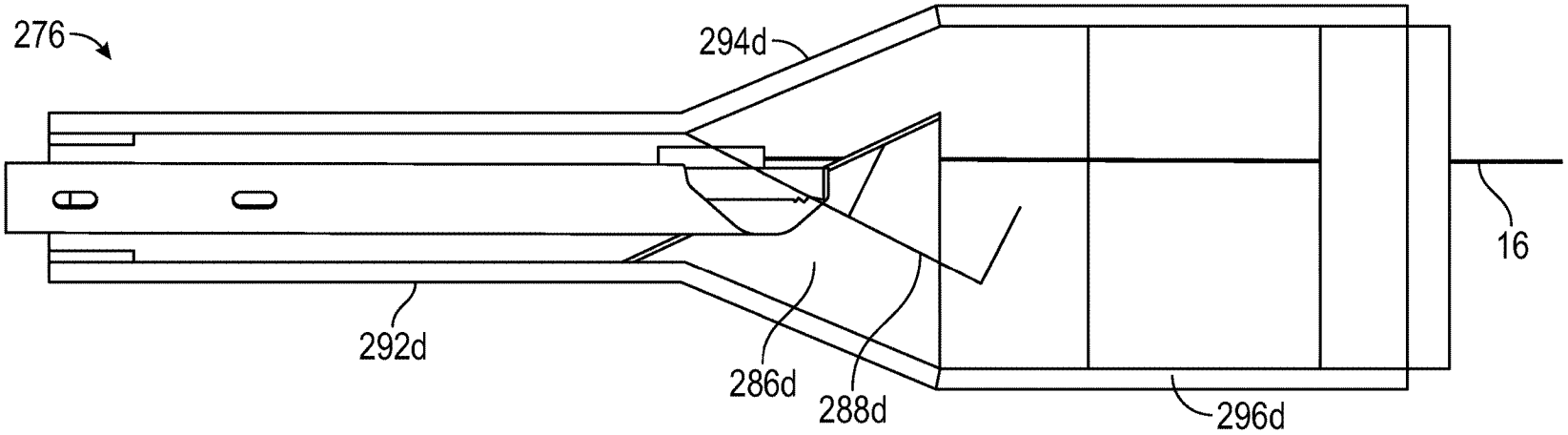
FIG. 68 shows a top, plan view of a guardrail and guardrail terminal with a top of the guardrail terminal removed in accordance with yet another exemplary embodiment of the present disclosure.
Figure 69:
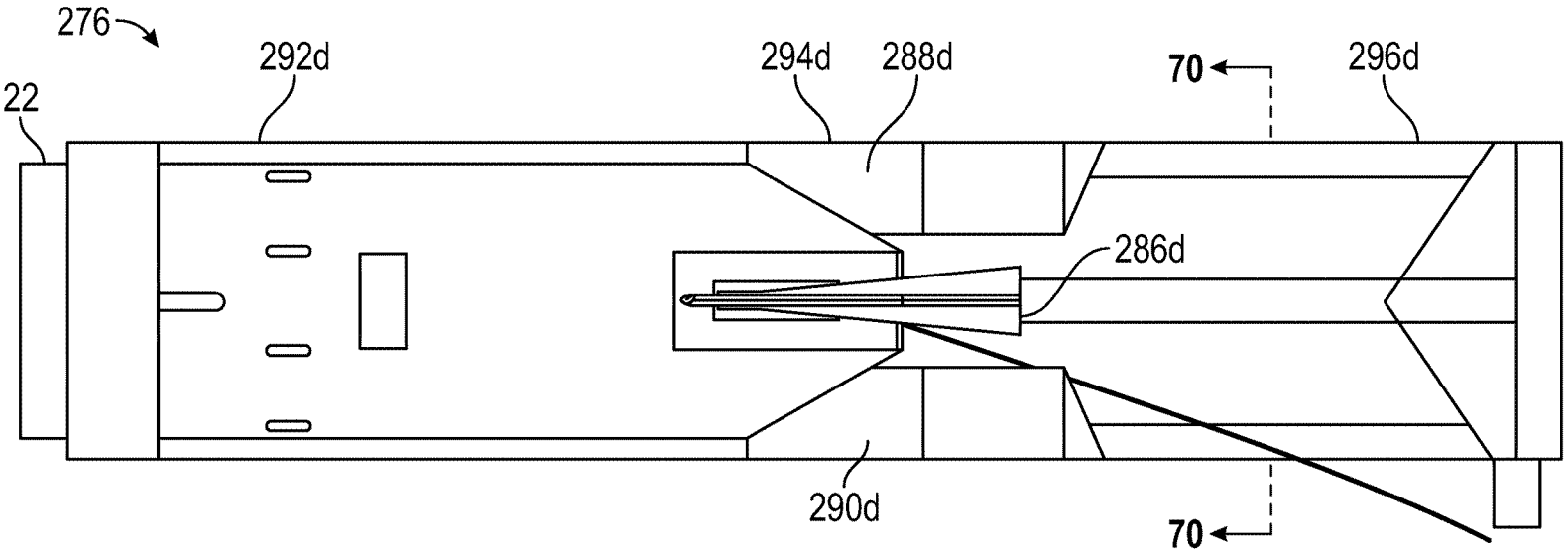
FIG. 69 shows an elevation view of the guardrail and guardrail terminal of FIG. 68.
Figure 70:
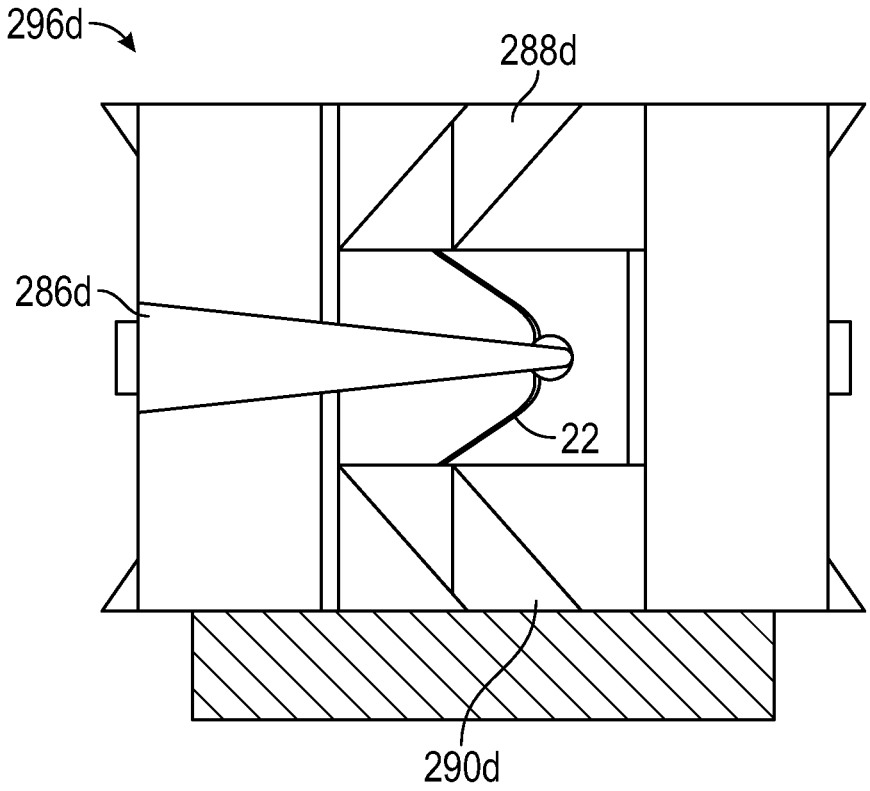
FIG. 70 shows a sectional view of the guardrail and guardrail terminal of FIG. 69 along the lines 70-70.
Figure 72:
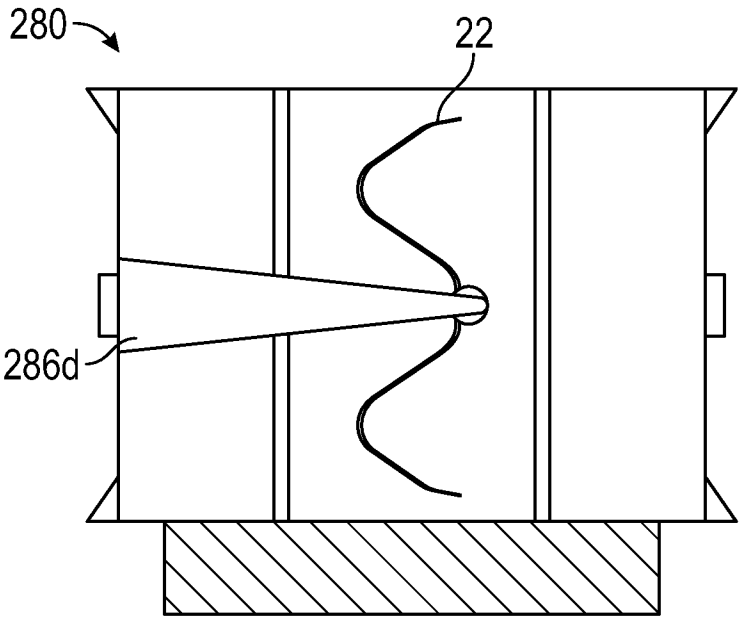
FIG. 72 shows a further sectional view of the guardrail and guardrail terminal of FIG. 71.
Figure 71:
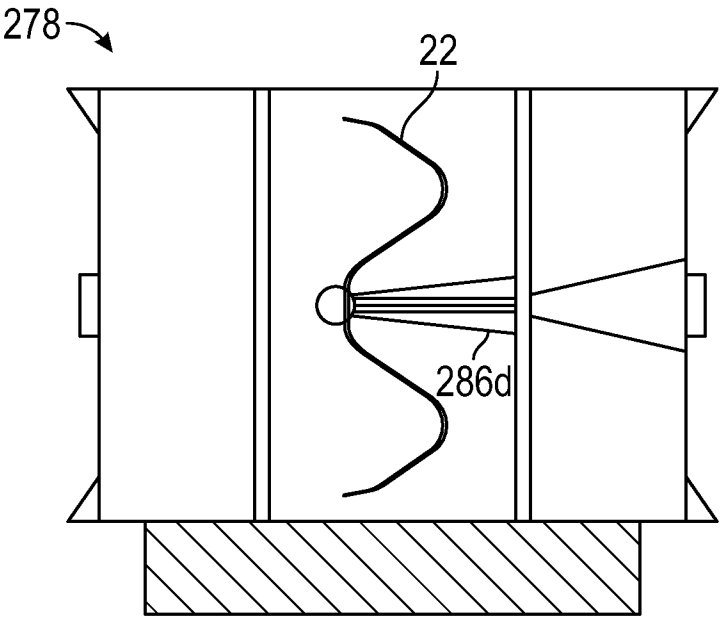
FIG. 71 shows a sectional view of a guardrail and guardrail terminal in accordance with still yet another exemplary embodiment of the present disclosure.
Figure 75:
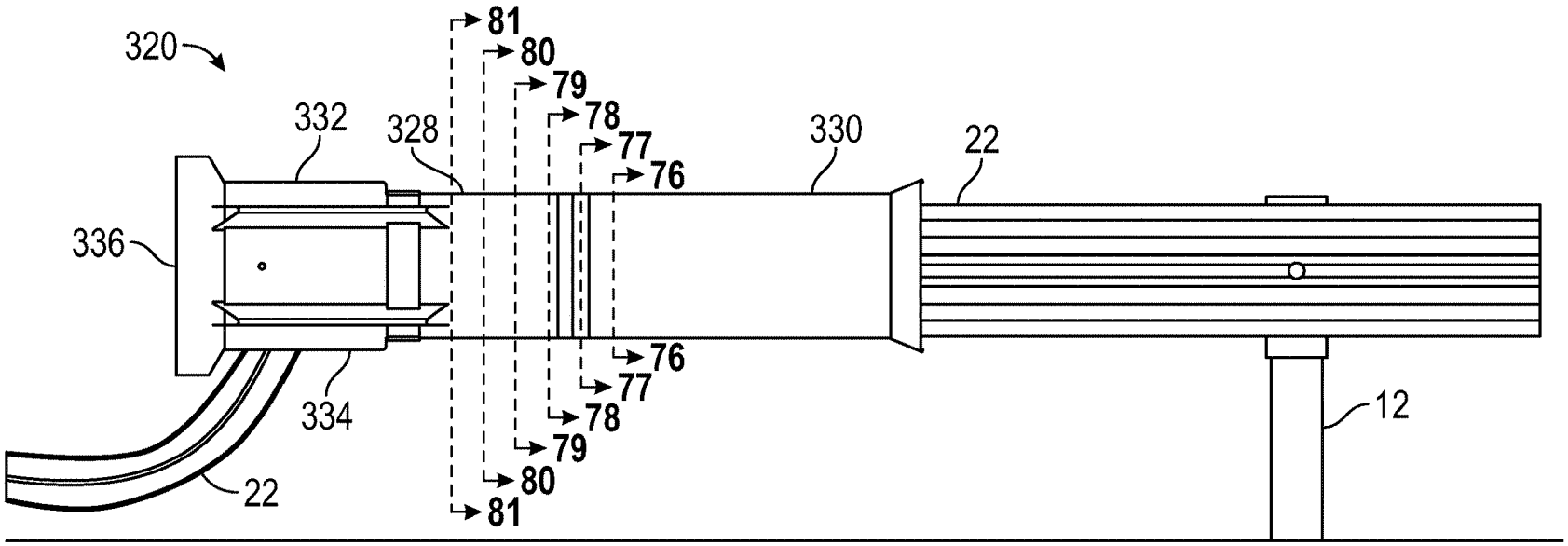
FIG. 75 shows a plan view of a portion of a guardrail and a guardrail terminal of the present disclosure in accordance with an exemplary embodiment of the present disclosure.
Figures 76, 77, 78, 79, 80, 81:
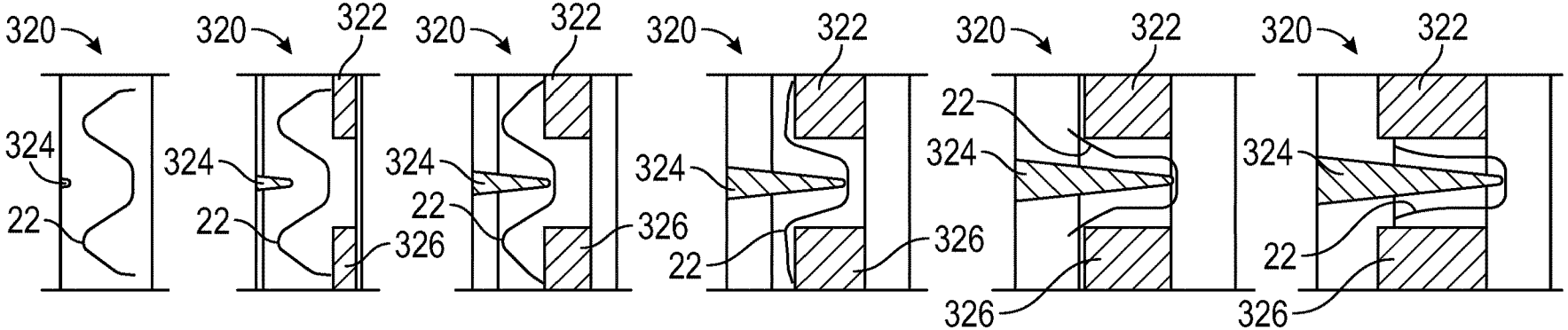
FIG. 76 shows a sectional view of the guardrail and guardrail terminal of FIG. 79 along the lines 76-76.
FIG. 77 shows a sectional view of the guardrail and guardrail terminal of FIG. 79 along the lines 77-77.
FIG. 78 shows a sectional view of the guardrail and guardrail terminal of FIG. 79 along the lines 78-78.
FIG. 79 shows a sectional view of the guardrail and guardrail terminal of FIG. 79 along the lines 79-79.
FIG. 80 shows a sectional view of the guardrail and guardrail terminal of FIG. 79 along the lines 80-80.
FIG. 81 shows a sectional view of the guardrail and guardrail terminal of FIG. 79 along the lines 81-81.

FIGS. 56-76 show guardrail terminals in accordance with exemplary embodiments of the present disclosure. FIGS. 56-59 show a guardrail terminal 270 in accordance with one exemplary embodiment. FIGS. 60-63 show a guardrail terminal 272 in accordance with another exemplary embodiment. FIGS. 64-67 show a guardrail terminal 274 in accordance with still another exemplary embodiment. FIGS. 68-70 show a guardrail terminal 276 in accordance with yet another exemplary embodiment. FIG. 71 shows a guardrail terminal 278 in accordance with an even further exemplary embodiment. FIG. 72 shows a guardrail terminal 280 in accordance with one still yet another exemplary embodiment. FIG. 73 shows a guardrail terminal 282 in accordance with an even yet another embodiment. FIG. 74-76 shows a guardrail terminal 284 in accordance with a further exemplary embodiment.

Each guardrail terminal includes at least a horizontally extending center deflector 286. Some guardrail terminals include an upper deflector 288 and a lower deflector 290. Each of the exemplary embodiments of FIGS. 56-76 fold guardrail beam 22 in a shape that is approximately similar to the shapes shown in FIGS. 17 and 18.

Figure 56:
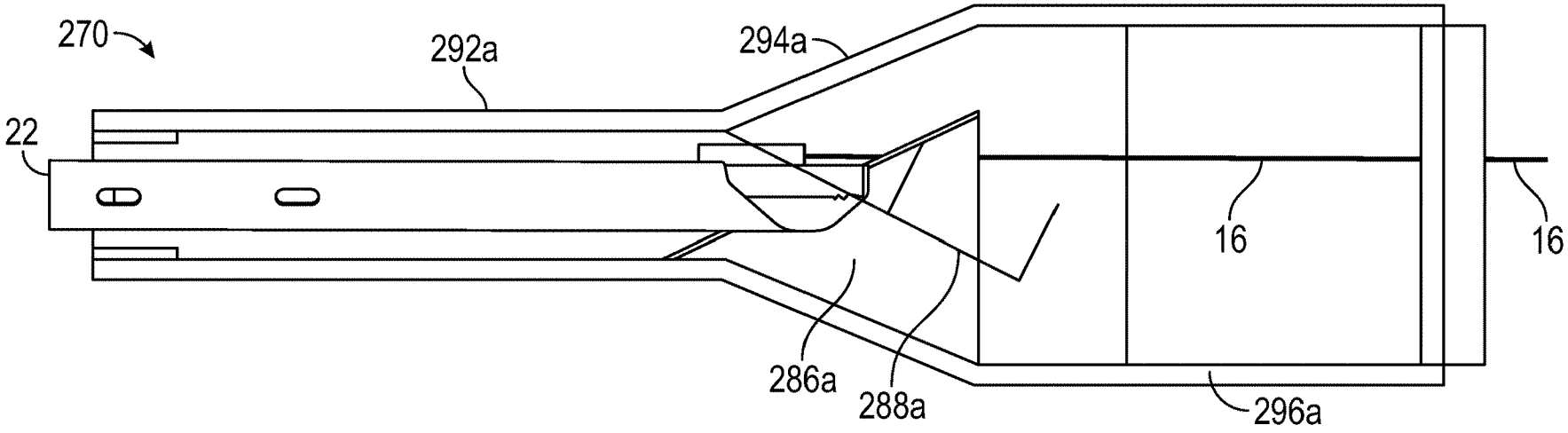
FIG. 56 shows a top, plan view of a guardrail and guardrail terminal with a top of the guardrail terminal removed in accordance with another exemplary embodiment of the present disclosure.
Figure 57:
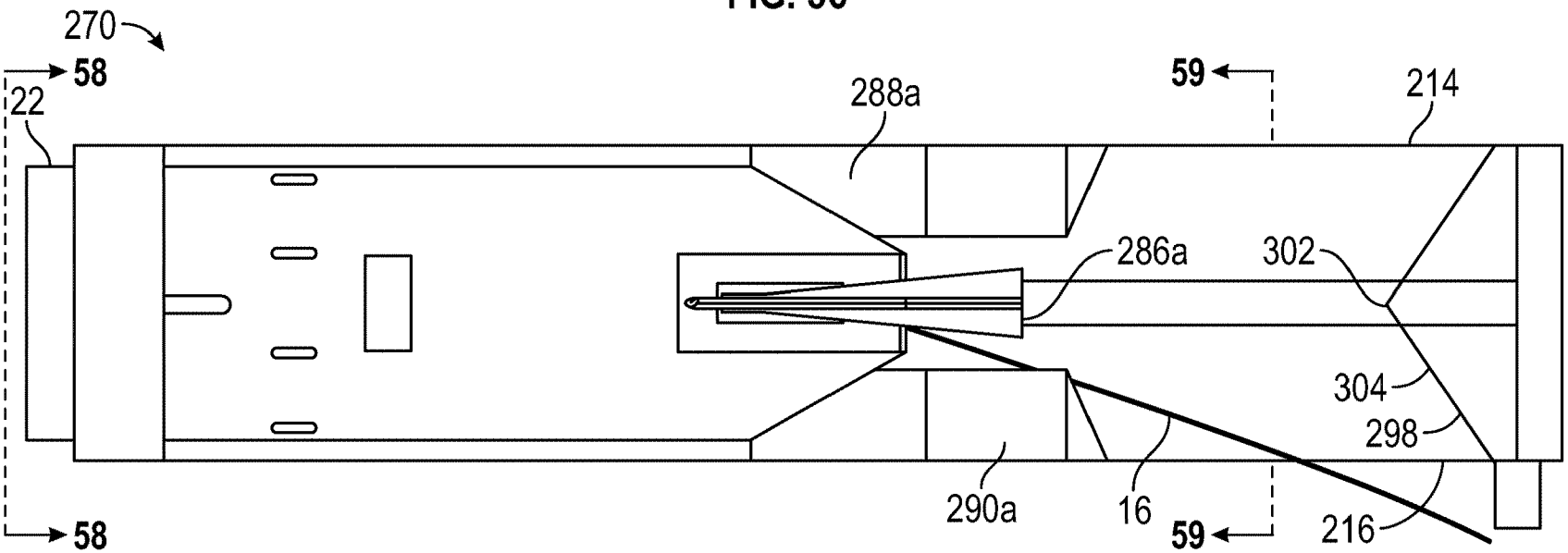
FIG. 57 shows an elevation view of the guardrail and guardrail terminal of FIG. 56.
Figure 59:
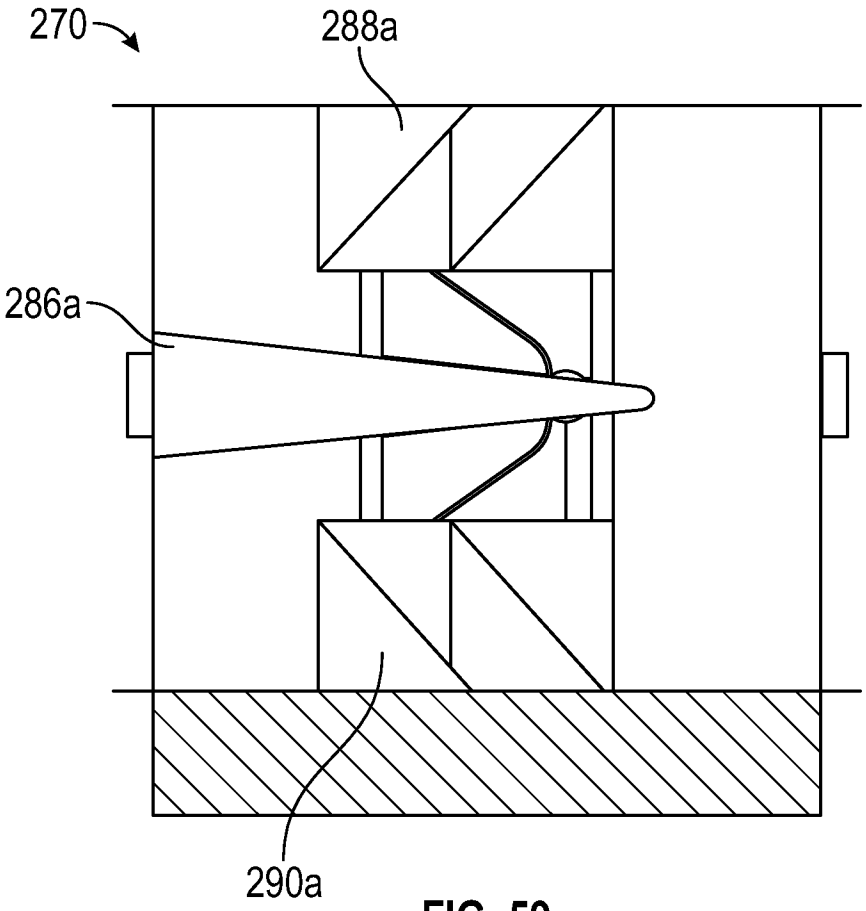
FIG. 59 shows a sectional view of the guardrail and guardrail terminal of FIG. 57 along the lines 59-59.
Figure 58:
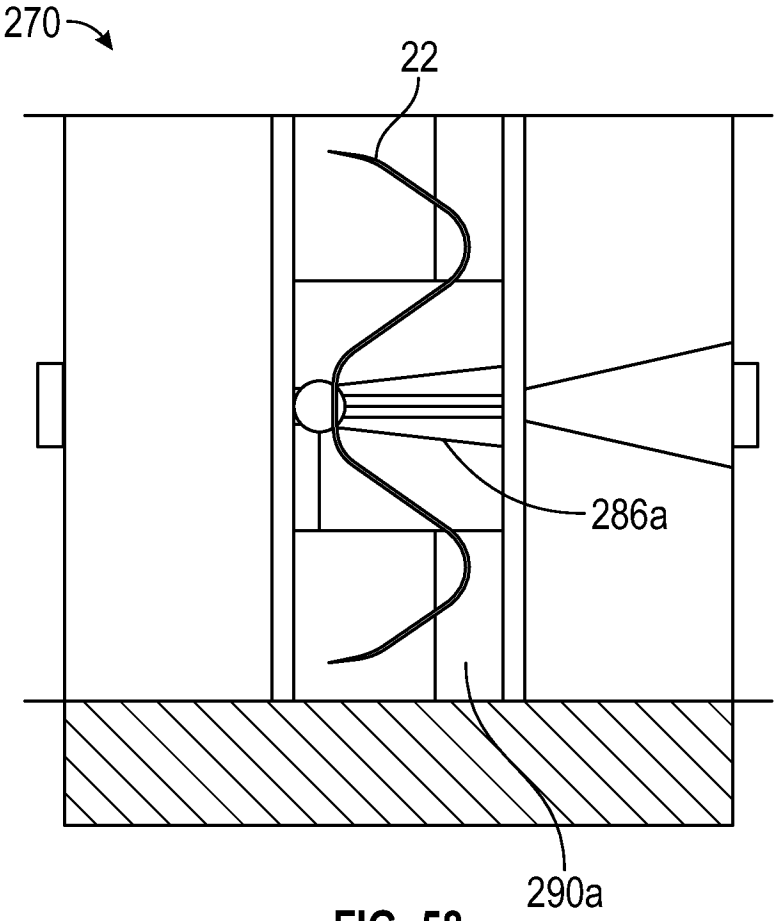
FIG. 58 shows a sectional view of the guardrail and guardrail terminal of FIG. 57 along the lines 58-58.
Figure 60:
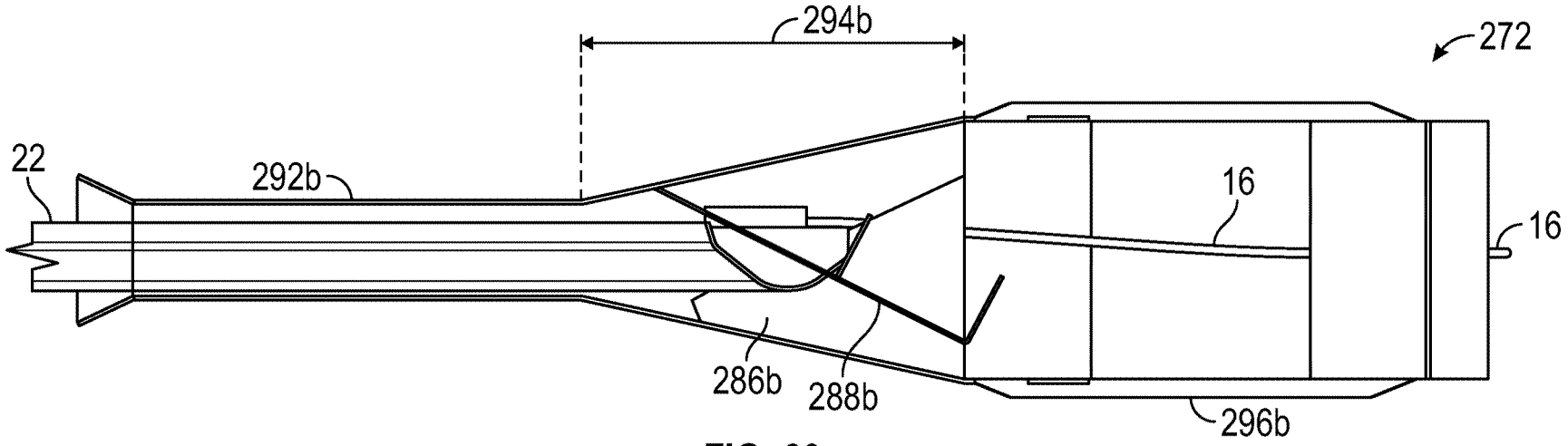
FIG. 60 shows a top, plan view of a guardrail and guardrail terminal with a top of the guardrail terminal removed in accordance with a further exemplary embodiment of the present disclosure.
Figure 61:
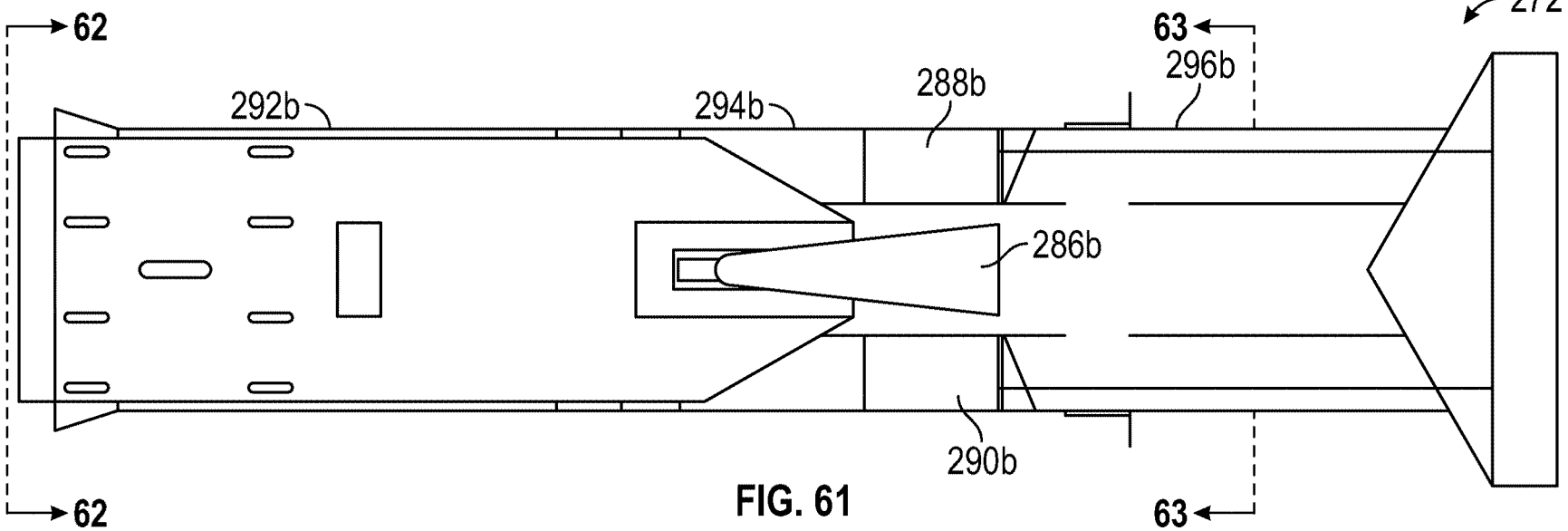
FIG. 61 shows an elevation view of the guardrail and guardrail terminal of FIG. 60.
Figure 63:
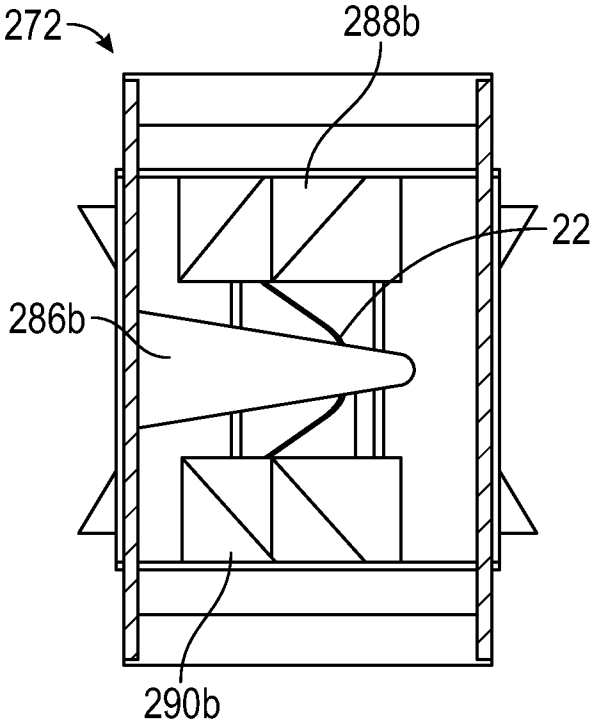
FIG. 63 shows a sectional view of the guardrail and guardrail terminal of FIG. 61 along the lines 63-63.
Figure 62:
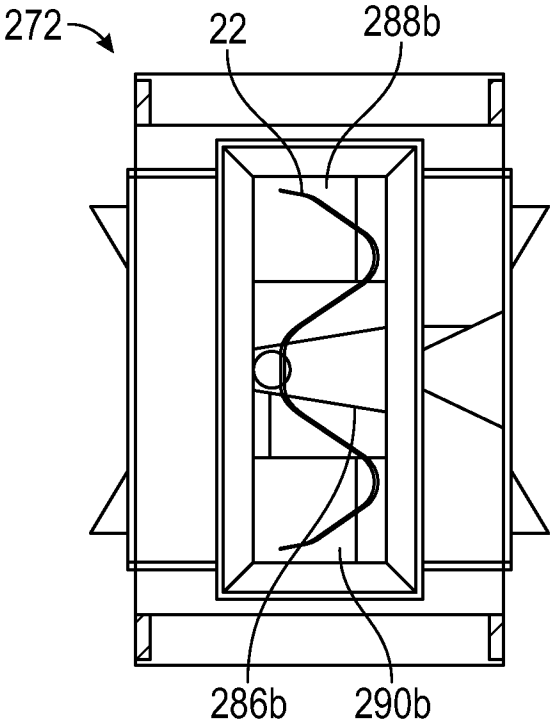
FIG. 62 shows a sectional view of the guardrail and guardrail terminal of FIG. 61 along the lines 62-62.
Figure 64:
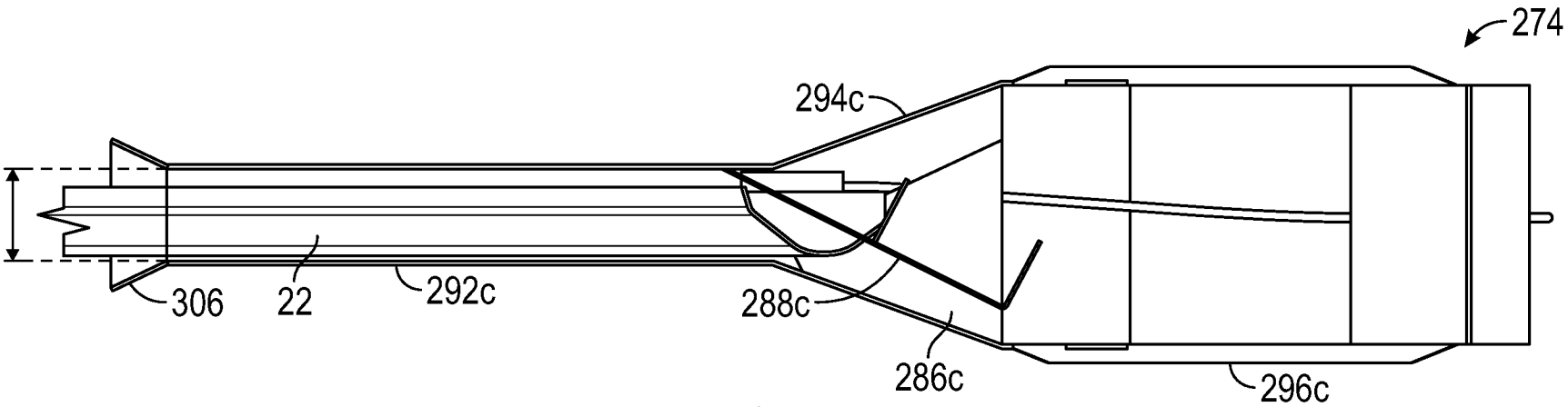
FIG. 64 shows a top, plan view of a guardrail and guardrail terminal with a top of the guardrail terminal removed in accordance with a still further exemplary embodiment of the present disclosure.
Figure 65:
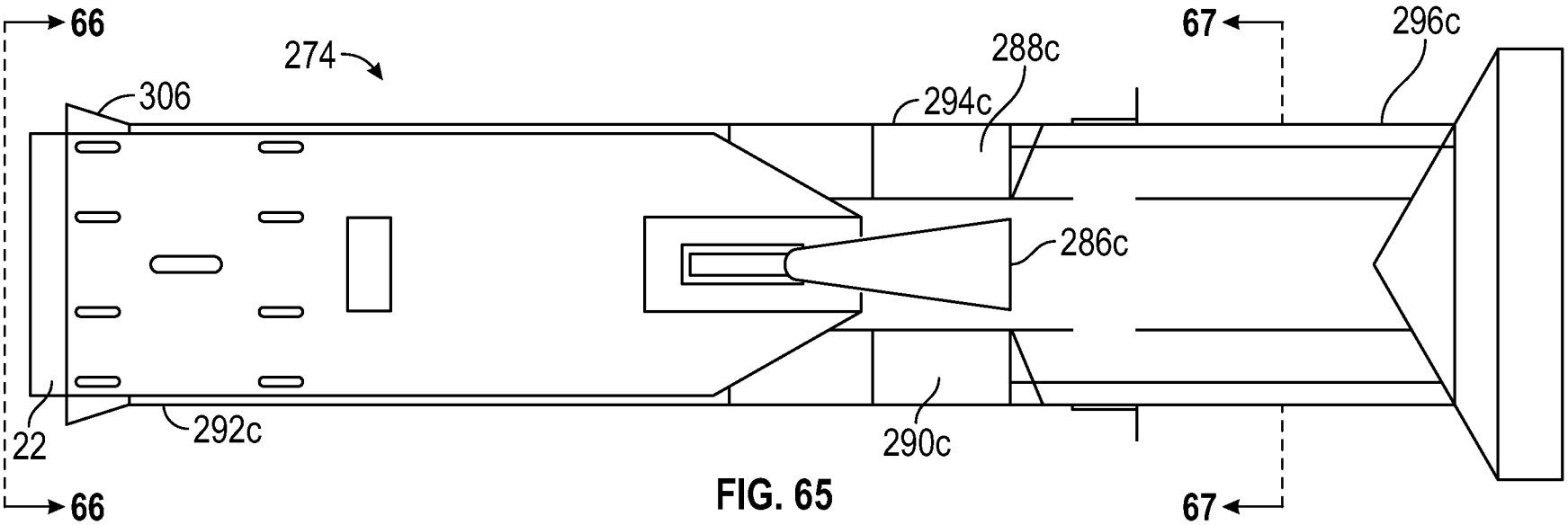
FIG. 65 shows an elevation view of the guardrail and guardrail terminal of FIG. 64.
Figure 67:
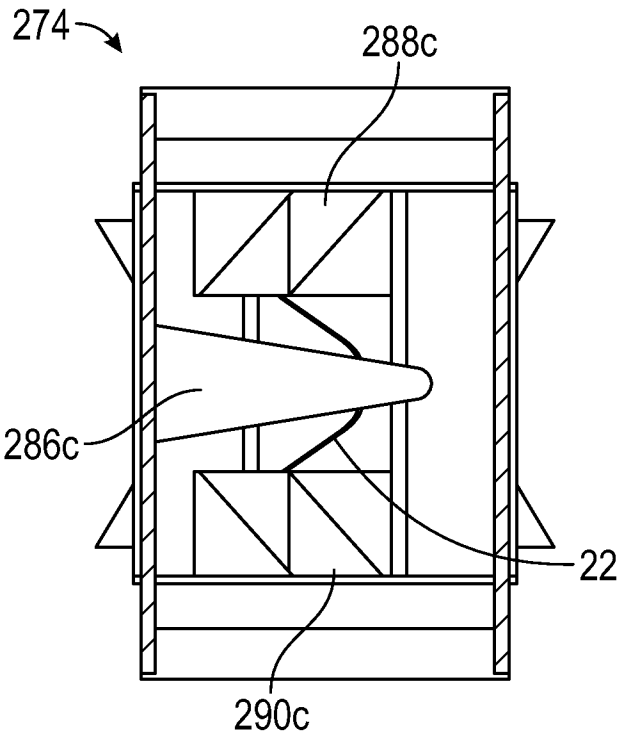
FIG. 67 shows a sectional view of the guardrail and guardrail terminal of FIG. 65 along the lines 67-67.
Figure 66:
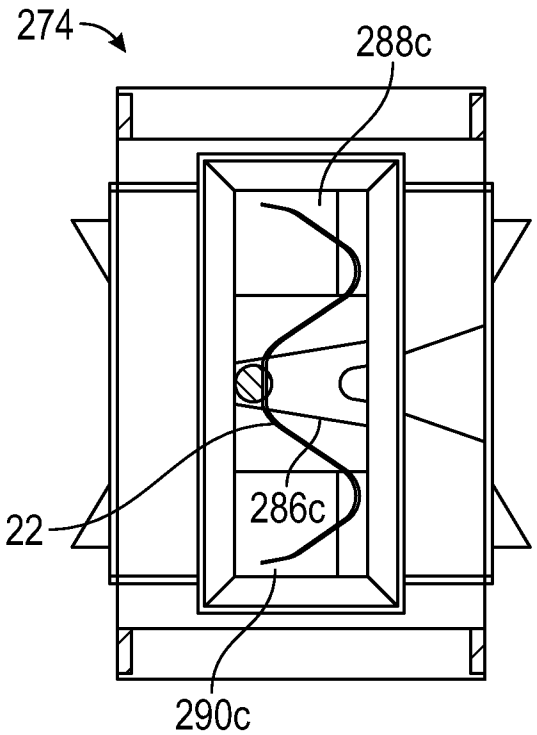
FIG. 66 shows a sectional view of the guardrail and guardrail terminal of FIG. 65 along the lines 66-66.

In addition, referring to FIG. 56, each guardrail terminal includes a feeder chute 292, in which guardrail 22 is positioned at a location prior to any deflectors positioned in the guardrail terminal, a throat 294, and an impact head 296. The deflectors generally extend from an upstream end of feeder chute 292, through throat 294, partially into impact head 296. Impact head 296 includes an interior wedge deflector 298 that assists in guiding flattened guardrail beam 22 downwardly to bottom opening 216. Center deflector 286 may be located approximately at a midpoint in a vertical direction of a height of throat 294, extending from an interior wall of throat 294. In a plan view, at one end center deflector **286*a* may be positioned away from guardrail 22. At a second, opposite end of throat 294*a*, center deflector can extend beyond a width of input chute 292**.

Feeder chute 292 can include an input flair 306 (e.g., see FIGS. 64 and 65), which is present on many of the presently disclosed embodiments. As guardrail terminal 270 slides along guardrail beam 22 due to a forward impact, guardrail beam 22 can bend and/or otherwise distort locally due to, for example, shearing of various bolts that secure guardrail beam 22 to anchor posts 12 and shearing of bolts that secure support bracket 42 to guardrail beam 22. Such local distortions can cause guardrail beam to bind with guardrail terminal 270, stopping all movement of guardrail terminal 270 with respect to guardrail beam 22. Flairs 306, which extend entirely around an opening to feed chute 292, help guide guardrail beam 22 into an interior of feed chute 292 as guardrail beam 22 slides along guardrail beam 22. It should be apparent that by extending around an entire periphery of feed chute 292, flairs 306 strengthen each other as well as strengthening feed chute 292. Flairs 306 can also reduce tolerance-related binding due to variations in guardrail 22. In an exemplary embodiment, flairs 306 can be formed of quarter inch thick steel plate at an angle of about 18 degrees from the horizontal, though angles can be in any range that extends from about 10 degrees to 45 degrees or less.

FIGS. 56-59 show version 1 guardrail terminal 270 having a 6 inch wide feeder chute **292*a* in a top plan view, a 12 inch long throat 294*a*, and a 16 inch wide impact head 296*a*** in a top plan view.

FIGS. 60-63 show version 2 guardrail terminal 272 having a 4.75 inch wide feeder chute **292*b* in a top plan view, an extended 18.9 inch long throat 294*b*, and a 12.5 inch wide impact head 296*b*** in a top plan view.

FIGS. 64-67 show version 3 guardrail terminal 274 having a 4.75 inch wide feeder chute **292*c* in a top plan view, an 11 inch long throat 294*c*, and a 12.5 inch wide impact head 296*c*** in a top plan view.

FIGS. 68-70 show version 4 guardrail terminal 276 having a 9 inch wide feeder chute **292*d* in a top plan view, a 12 inch long throat 294*d*, and a 19 inch wide impact head 296*d*** in a top plan view.

FIGS. 71 and 72 show version 5 guardrail terminal 278, which is similar to version 4 guardrail terminal 276, only upper deflector **288*d* and lower deflector 290*d* are removed. Applicant determined through extensive testing and analysis that performance of guardrail terminal 278 changed only a relatively small amount (see FIG. 73) as compared to guardrail terminal 276, with the advantage being that versions 1-5 provided a range of forces. Referring to FIG. 74, preferable forces are within bounded region, though with the variations shown in FIG. 73**, the design of a particular guardrail terminal can be selected based on potential application.

FIGS. 75-81 show a guardrail terminal 320 generally representative of any of the guardrail terminals presented herein that includes an upper deflector 322, a center deflector 324, a lower deflector 326, a feeder chute 330, a throat 328, and an impact head 332. Impact head 332 further includes a bottom opening 334 that is similar to top opening 214 and bottom opening 216 shown in FIG. 44, and impact head 332 includes an impact face 336.

Upon installation alongside a road, guardrail beam 22 is positioned within feeder chute 330 at a location downstream from throat 328. When a vehicle collides with impact face 336, guardrail terminal 320 is driven by the force of the collision to the right in FIG. 75. The movement of guardrail terminal 320 to the right forces guardrail beam 22 into throat 328. Contact of guardrail beam 22 with deflectors 322, 324, and 326 cause progressive bending and then folding of guardrail beam 22. Progression of bending and folding of guardrail beam 22 as it progresses through a throat 328 is shown in FIGS. 76-81. It should be apparent that guardrail beam 22 is folded from a "W" shape shown in FIG. 76 to a "U" shape in FIG. 81.

As guardrail terminal 320 continues to be forced to the right in FIG. 75, flattened guardrail 22, which is now in a "U" shape, which can be a "V" shape in an alternative embodiment, passes from throat 328 to impact head 332. The weight of guardrail beam 22 causes guardrail beam 22 to deflect downwardly as guardrail terminal 320 continues to move relative to the fixed guardrail beam 22. Impact head 332 includes a wedge deflector 298, which can be seen in more detail in FIG. 57. Wedge deflector 298 includes a ridge or vertical halfway point 302 that is at or above a vertical halfway point of guardrail beam 22 when guardrail beam 22 is supported within guardrail terminal 320. Thus, when flattened guardrail beam 22 reaches wedge deflector 298, the force of gravity pulls flattened guardrail beam 22 downwardly enough such that flattened guardrail beam 22 contacts an angled lower face 304 of wedge deflector 298. As guardrail terminal 320 continues to drive to the right, angled lower face 304 pushes flattened guardrail beam 320 toward bottom opening 216 and then out from impact head 296. After exiting impact head 296, cable 16 tends to keep flattened guardrail beam 22 at or above ground 24.

While various embodiments of the disclosure have been shown and described, it should be understood that these embodiments are not limited thereto. The embodiments may be changed, modified, and further applied by those skilled in the art. Further, elements of embodiments can be interchanged and combined to create new embodiments. Therefore, these embodiments are not limited to the detail shown and described previously, but also include all such changes and modifications.

We claim:

1. A guardrail assembly, comprising:

a w-shaped guardrail extending longitudinally, the w-shaped guardrail including a first, upper end and a second, lower end, each of the first, upper end and the second, lower end extending from the w-shaped guardrail in a first direction that is horizontally transverse to a longitudinal direction; and a guardrail terminal having a first end and a second end, the guardrail terminal configured to receive the w-shaped guardrail at the first end of the guardrail terminal, the guardrail terminal including a deflector positioned between the first end of the guardrail terminal and the second end of the guardrail terminal, the deflector configured to fold the w-shaped guardrail such that the first, upper end and the second, lower end of the w-shaped guardrail are repositioned from extending in the first direction to extending in a second direction that is horizontally transverse to the longitudinal direction while the w-shaped guardrail is within the guardrail terminal, the second direction being is opposite to the first direction.

2. The guardrail assembly of claim 1, including a downwardly oriented opening positioned between the deflector and the second end of the guardrail terminal.

3. The guardrail assembly of claim 1, the guardrail terminal including a feeder chute positioned to extend from the first end of the guardrail terminal, and the feeder chute is configured to receive the w-shaped guardrail.

4. The guardrail assembly of claim 3, the guardrail terminal including a throat positioned between the feeder chute and the second end of the guardrail terminal, the feeder chute has a first width, and the throat has a second width that is greater than the first width, and the second width of the throat increases with distance from the feeder chute.

5. The guardrail assembly of claim 1, wherein the deflector extends a first width from an interior wall of the guardrail terminal at a first end of the deflector and a second width greater than the first width from the interior wall of the guardrail terminal at a second end of the deflector upstream from the first end.

6. The guardrail assembly of claim 5, including a feeder chute positioned to extend from the first end of the guardrail terminal, and the feeder chute is configured to receive the w-shaped guardrail.

7. The guardrail assembly of claim 6, wherein the deflector is angled from an end of the deflector that is closest to the feeder chute to an end of the deflector that is closest to the second end of the guardrail terminal, and the deflector is widest at the end of the deflector that is closest to the second end of the guardrail terminal.

8. The guardrail assembly of claim 1, wherein the guardrail terminal includes a downwardly oriented opening positioned between the deflector and the second end of the guardrail terminal.

9. The guardrail assembly of claim 1, wherein the w-shaped guardrail initially includes three reversals of direction along a transverse length of the w-shaped guardrail, and after the first, upper end and the second, lower end of the guardrail terminal are repositioned, the w-shaped guardrail includes only a single reversal of direction and is no longer in the w-shape.

10. A guardrail terminal, comprising:

a first end configured to receive a w-shaped guardrail including a first end and a second end, each of the first end and the second end of the w-shaped guardrail extending in a first direction;

a second end, a downwardly oriented opening positioned adjacent the second end of the guardrail terminal; and a first deflector positioned between the first end of the guardrail terminal and the downwardly oriented opening, the first deflector configured to fold the w-shaped guardrail such that the first end and the second end of the w-shaped guardrail are repositioned from extending in the first direction to extending in a second direction that is opposite to the first direction.

11. The guardrail terminal of claim 10, including an upwardly oriented opening positioned on an opposite side of the guardrail terminal from the downwardly oriented opening.

12. The guardrail terminal of claim 10, including a feeder chute extending from the first end of the guardrail terminal, and the feeder chute is configured to receive the w-shaped guardrail.

13. The guardrail terminal of claim 10, including an upper deflector positioned within the guardrail terminal on a first side of the first deflector and a lower deflector positioned within the guardrail terminal on an opposite side of the first deflector from the first side.

14. The guardrail terminal of claim 10, wherein energy dissipation of the guardrail terminal when positioned on the w-shaped guardrail supported by a plurality of posts having plastic moments in a range from about 9,000 ft-lb to about 38,000 ft.-lbs. is in a range of about 14 kilopounds (kips) to about 31 kips with an impact on the second end of the guardrail terminal at 15 degrees or less relative to the w-shaped guardrail.

15. The guardrail terminal of claim 10, wherein the first deflector is configured to reshape the w-shaped guardrail from a configuration including three reversals of direction along a transverse length of the w-shaped guardrail to a shape having only a single reversal of direction.

16. A guardrail assembly, comprising:

a w-shaped guardrail;

a guardrail terminal configured to receive the w-shaped guardrail, the guardrail terminal including an impact face and a deflector extending horizontally from an interior wall of the guardrail terminal, the guardrail terminal and deflector configured to fold the w-shaped guardrail; and a plurality of posts supporting the w-shaped guardrail, the plurality of posts having plastic moments perpendicular to the w-shaped guardrail in a range from about 9,000 ft-lb to about 38,000 ft.-lbs.

17. The guardrail assembly of claim 16, wherein the plastic moments are achieved with a head-on force of about 14 kilopounds (kips) to about 31 kips.

18. The guardrail assembly of claim 17, wherein the plastic moments and the head-on force are at an impact angle of 15 degrees or less relative to the w-shaped guardrail.

19. The guardrail assembly of claim 16, wherein the deflector folds the w-shaped guardrail such that a first end and a second end of the w-shaped guardrail in a transverse direction to a longitudinal extent of the w-shaped guardrail are repositioned from extending in a first direction to extending in a second direction that is opposite to the first direction.

20. The guardrail assembly of claim 16, wherein the w-shaped guardrail initially includes three reversals of direction along a transverse direction of the w-shaped guardrail, and after the w-shaped guardrail is folded, the w-shaped guardrail includes only a single reversal of direction along the transverse direction of the w-shaped guardrail.

* * * * *